United States Patent [19]

Hollander

[11] Patent Number: 5,029,214

[45] Date of Patent: Jul. 2, 1991

[54] ELECTRONIC SPEECH CONTROL APPARATUS AND METHODS

[76] Inventor: James F. Hollander, 7219 Cornell Avenue, St. Louis, Mo. 63130

[21] Appl. No.: 894,928

[22] Filed: Aug. 11, 1986

[51] Int. Cl.[5] ..... G10L 9/00; A63H 30/00

[52] U.S. Cl. ..... 381/51; 446/175; 446/297; 446/303

[58] Field of Search ..... 381/36, 51-53, 381/41; 446/175, 270, 299, 297, 302, 303, 327, 456

[56] References Cited

U.S. PATENT DOCUMENTS

| | | | |
|---|---|---|---|
| 3,298,130 | 1/1967 | Ryan | 446/299 |
| 3,748,750 | 7/1973 | Viemeister | 434/236 |
| 3,971,142 | 7/1976 | Hollander | 434/236 |
| 4,009,525 | 3/1977 | Hollander | 434/237 |
| 4,041,617 | 8/1977 | Hollander | 434/237 |
| 4,093,821 | 6/1978 | Williamson | 381/41 |
| 4,142,067 | 2/1979 | Williamson | 381/41 |
| 4,221,927 | 9/1980 | Dankman et al. | 381/51 |
| 4,318,245 | 3/1982 | Stowell et al. | 381/51 |
| 4,429,367 | 1/1984 | Ikeda | 381/51 |
| 4,455,551 | 6/1984 | Lemelson | 381/51 |
| 4,458,110 | 7/1984 | Mozer | 381/51 |
| 4,480,602 | 11/1984 | Rose | 446/175 |
| 4,489,437 | 12/1984 | Fukuichi et al. | 381/51 |
| 4,516,950 | 5/1985 | Berman et al. | 446/297 |
| 4,624,012 | 11/1986 | Lin et al. | 381/51 |
| 4,661,916 | 4/1987 | Baker et al. | 381/52 |
| 4,675,840 | 6/1987 | Raymond et al. | 364/513.5 |
| 4,675,904 | 6/1987 | Silverman | 381/41 |
| 4,696,653 | 9/1987 | McKeefrey | 446/175 |

OTHER PUBLICATIONS

*Am. J. Psych., XLII, 1930, pp. 110, 111.*

*The Emotions,* R. Plutchik, pp. 12-43, 70-85, 94-107, 110-125 (date unknown).

"Group Behavior of Robots", M. Kochen, *Computers and Automation,* vol. 6 #3, 1957, pp. 16-21, 48.

"A Computer Experiment in Elementary Social Behavior", J. T. Gullahorn et al., *IEEE Trans. Sys. Sci. & Cyb.,* SSC-1, #1, Nov. 1965, pp. 45-51.

*Depression,* A. T. Beck, 1967, pp. 6-7.

"Motivation System for a Robot", J. Koplowitz et al., *IEEE Trans. Sys. Man & Cyb.,* Jul. 1973, pp. 425-428.

"Punish/Reward . . . ", B. Widrow et al., *IEEE Trans. Sys. Man & Cyb.* vol. SMC-3 #5, 9/73, pp. 455-457.

"Linear Models in Decision Making", R. M. Dawes et al., Psych. Bull., vol. 81 #2, Feb. 1974, pp. 95-96.

"The Aboutness of Emotions", R. M. Gordon, *Am. Phil. Qtly.,* vol. II, #1, Jan. 1974, p. 27.

*Perspectives on Cognitive Dissonance,* R. A. Wicklund et al., 1976, pp.1-10.

*Feelings,* W. Gaylin, 1979, entire book.

"High Tech . . . Talking Toaster", M. Golden, Ms., Oct. 1981, 4 pp.

"The Structure in Persons' Implicit Taxonomy of Emotions", J. A. Russell et al., *J. Res. Personality,* vol. 16, 1982, pp. 447-469.

AMI advertisement and "A Single-Chip LPC Speech Synthesizer", D. Parikh, *Speech Technology,* Sep./Oct. 1982, pp. 85-89.

(List continued on next page)

*Primary Examiner*—Emanuel S. Kemeny

*Assistant Examiner*—David D. Knepper

[57] ABSTRACT

Electronic speech control apparatus that includes a circuit for establishing and changing over time a subject code and an utterance index. The subject code generally indicates one of a plurality of sets of utterances. The utterance index identifies an utterance of at least one word in the set indicated by the subject code. Combined with the circuit is another circuit responsive thereto for generating the utterance identified by the utterance index in the set indicated by the subject code. The apparatus also repeatedly computes an emotion and generates an utterance representing the emotion so computed. The various utterances are made in an alternating conversational fashion in response to a person's speech. These and other aspects of apparatus and method are described in greater detail herein.

116 Claims, 28 Drawing Sheets

OTHER PUBLICATIONS

"Build the Microvox Text-to-Speech Synthesizer", S. Ciarcia, *Byte,* Sep. 1982, pp. 64–66, 70, 72, 74, 76–80, 82, 84, 86, 88.

"Minspeak", B. Baker, *Byte,* Sep. 1982, pp. 186–188, 192, 194, 196, 198, 202.

"The Cognivox VIO-1003", *Byte,* Sep. 1982, pp. 231 ff., 4 pp., W. Murray.

"Heath's HERO-1 Robot", S. Leininger, *Byte,* Jan. 1983, p. 86 ff., 6pp.

"LM170 . . . AGC/Squelch Amplifier", undated data sheet.

General Instrument data sheets for SPRooo and SPO256A-AL2, 1984, 9pp+10pp.

General Instrument, "Allophone Speech Synthesis Technique", J. May, 1982, 17pp.

Archer "CTS256A-AL2 Code-To-Speech Processing Chip", 7/85, 9pp.

"TMS5220C", Texas Instruments Manual, 1984, 42pp.

"Toy Soldiers Go High-Tech", *Newsweek,* 5/5/86, pp. 54 and 57.

Worlds of Wonder, Prospectus, 6/20/86, pp. 1–4, 14–16.

FIG. 4A RDCC
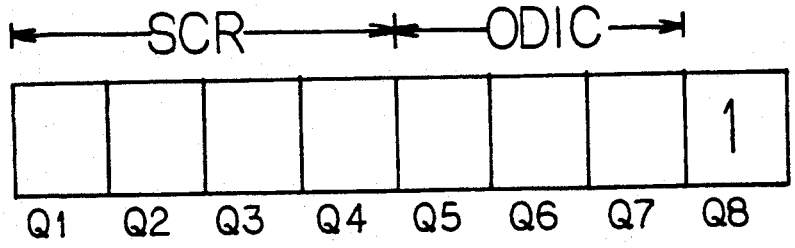
FIG. 4B
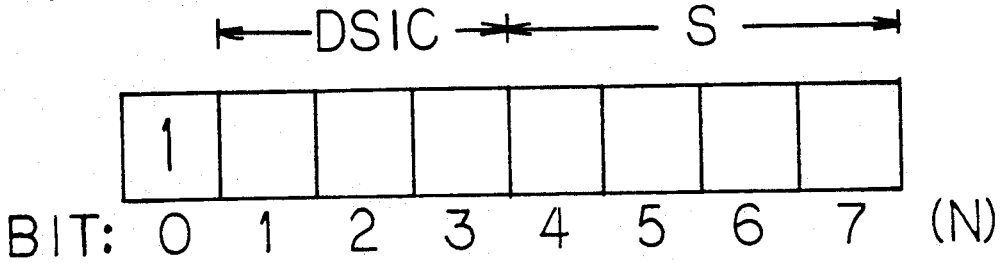
FIG. 6B
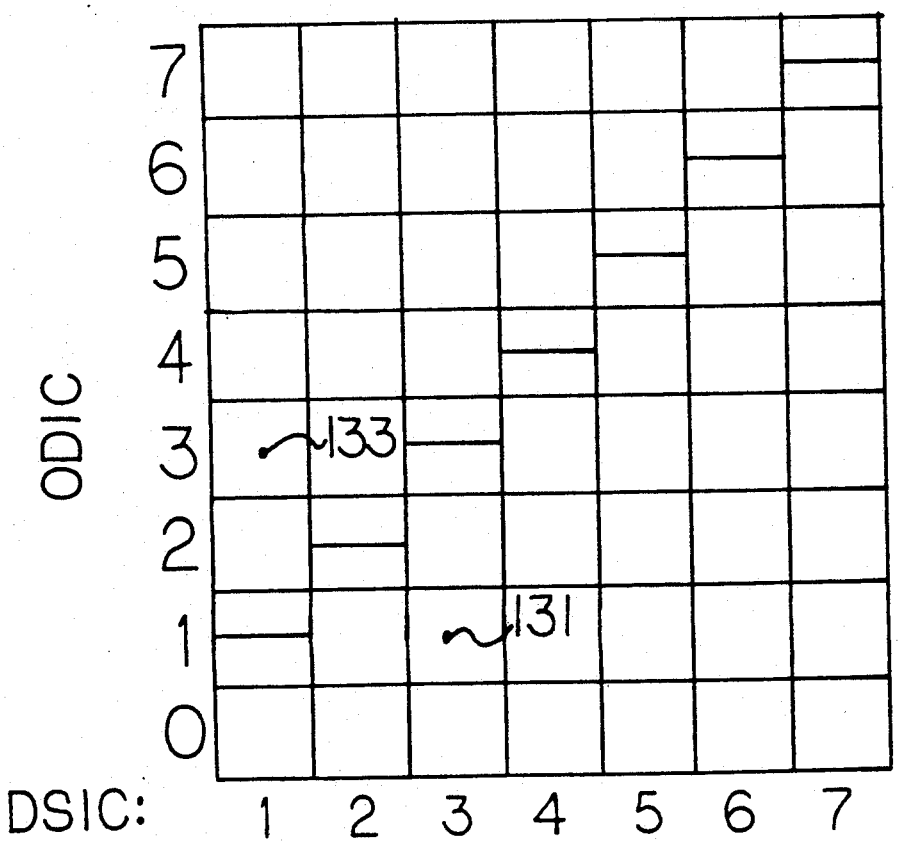

SUMMARY FLOWCHART

FIG. 6A
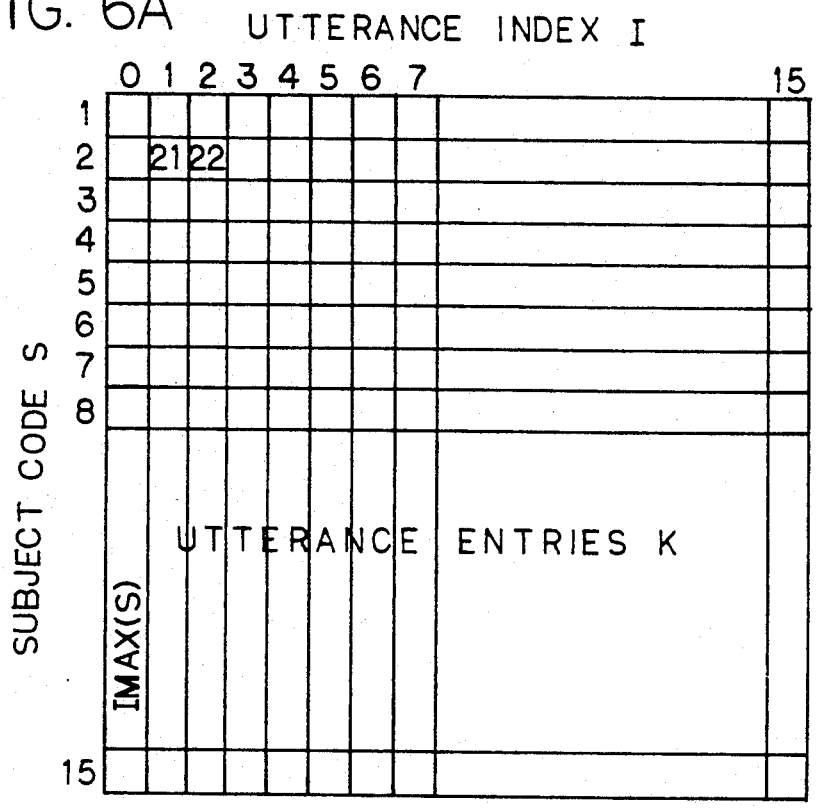
CONVERSATION TABLE
FIG. 7A
| K | ADR |
|---|---|
| ⋮ | |
| 21 | 1570 |
| 22 | 1573 |
| 23 | 1580 |
| ⋮ | |
FIG. 7
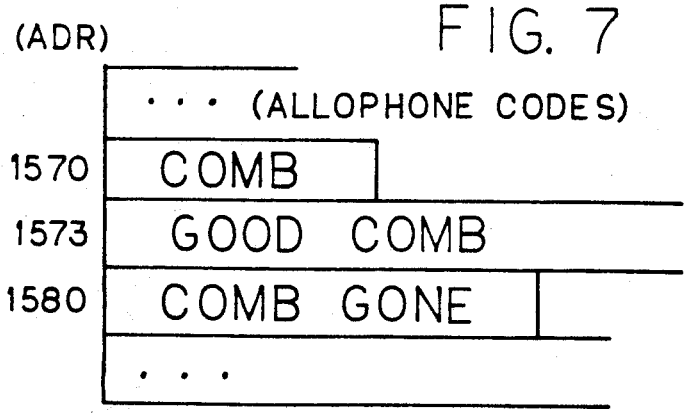
WORD-AND-PHRASE TABLE

BEGIN
201

IN 119
203
I > 1 ?
YES
NO
231
S = RNDM NR
NOT SO, SCR
I = 1
229
SAY: "I CHANGED MY MIND"
227
DC = 0
207
L = 1 AND DS = DR ?
NO
YES
209
S = SCR
SO = S
211
ODIC < DSIC ?
YES
NO
213
I = 2
SEND TDCC, INHIBIT
215
D
E
C

IN 119

IN 253
BEGIN
271
T<3 ?
273
YES
NO
RETURN
275
J1=J2=0 ?
277
YES
NO
3≤T≤7 ?
279
YES
NO
RETURN
275
UTTER CRY
281
J1=0 AND J2=1 ?
283
YES
NO
3≤T≤7 ?
285
YES
NO
SAY: "I DON'T KNOW"
287
SAY: "I REALLY DON'T KNOW"
289
RETURN
275
SAY: "I REALLY FEEL TENSE"
297
J1=1 ?
291
YES
NO
3≤T≤7
293
NO
YES
SAY: "I'M UNCOMFORTABLE ABOUT THAT"
295
RETURN
275

115

IN 117

IN 117

BEGIN
801
A
TM1 = RNDM. TMW
TM2 = RNDM. TML
805

FLW AND TIMER PROCESSING
FLW
TM2
TM1
810
105
FLD
R
READ FLD, R
820
827
825
911
913
923
YES
CL=3 ?
YES
I>1 & FLW=1 ?
CH=0
I=1 & S≠0 ?
YES
INR=0 ?
NO
NO
NO
NO
YES
830
871
925
CL=CL+1
CH=0
CL=0
TM1=RNDM. TMP
TM2=RNDM. TML
TM1=RNDM. TMP+TMW
TM2=RNDM. TML
835
875
915
SAY:
CL=1: 1st
CL=2: 2nd
CL=3: 3rd
FLD=1 ?
NO
YES
TM2
FLW AND TIMER PROCESSING
917
881
CH=CH+1
TM1
RETURN
921
885
SAY:
CH=1: 1st
CH=2: 2nd
CH=3: 3rd
903
DEC. TMD
895
SEND SSO
SET TMD
NO
901
NO
CH=3 ?
YES
TMO TIMEOUT ?
YES
891
101
START

810 OR 917

109

SEND TDCC

TDCC
1201
1203
1205
1207
1209
+9v
1401
1407
1405
LPF
S
D
183
79
1421
P17
WR/
75
RSR
Q8
7
Q1-Q7
SHIFT REG.
A
CK
R
1423
SW.
1435
IMP. MATCH
1437
BPF
1439
1441
AMP.
1443
AGC DET.
1451
1431
1415
40
40'

+5v.
CK
D
Q
R
1511
1521
1461
PULSE DET.
1463
.5 HZ. HPF
1471
+
-
Vref
1481
30 HZ. LPF.
HI
D
Q
R
110 msec. DELAY
1-SHOT
1501

IN 71

81

ELECTRONIC SPEECH CONTROL APPARATUS AND METHODS

BACKGROUND OF THE INVENTION

The present invention relates to electronic speech control apparatus and methods and more particularly to electronic apparatus for talking in a conversational manner on different subjects, deriving simulated emotions which are reflected in utterances of the apparatus, methods of operating same and applications in talking toys and the like.

In the prior art electronic voice synthesizers make sounds of speech upon receipt of a digital command representing a basic sound called an allophone. Different digital commands represent different allophones, and a succession of commands to the synthesizer causes intelligible speech sounds to be produced through a loudspeaker.

In prior work of the present inventor, electrical circuits simulate decisions and emotions in human relationships. see U.S. Pat. Nos. 3,971,142, 4,009,525 and 4,041,617. For example, in patent 4,041,617 two circuits have dials for decisional influences, personality factors, independence of relationship, and persuasive-contrary switches for setting factors involved in a human relationship. Lamps show decisions by each person, and electrical meters show emotions labelled Like-Dislike, Guilt-Pride, Good-Bad Feelings and Tension. The circuits are coupled by wires for communication from the first circuit to the second circuit and vice-versa.

Without limiting the scope of the present invention in its various apparatus and method aspects, the background of the invention is further described in connection with developments in the doll and toy industry. According to *Newsweek*, May 5, 1986, this industry is recognizing a public desire for more interesting dolls and toys. A touch-sensitive doll that contains a memory and recites phrases is mentioned.

Many problems need to be addressed, however, if dolls with conversational ability are to be achieved. Some means of controlling the timing of listening and talking functions is needed. It would be desirable to provide the doll with simulated emotions that are affected by the conversation and which in turn influence what the doll says. A single doll should be able to converse with a person as well as with one or more other dolls in its vicinity. The doll should be able to distinguish its own voice from that of other dolls and humans and should be able to recognize the participants in a conversation. A child or other person should not be expected to operate or interpret any complicated or inconvenient arrangement of input or display devices in the doll application.

SUMMARY OF THE INVENTION

Among the objects of the present invention are to provide electronic speech control apparatus and methods for conversation on a variety of subjects; to provide electronic speech control apparatus and methods which are compatible with apparatus of the same kind for carrying on meaningful conversational interchanges with each other and people; to provide electronic speech control apparatus and methods which can simulate decisions and emotions to guide or affect the conversational speech which is sought; to provide electronic speech control apparatus which requires a minimum of electrical adjustment by the user; to provide electronic speech control apparatus and methods which can interpret communications from additional apparatus of the same kind or from people in a way that affects the conversational speech and emotions produced; to provide electronic speech control apparatus and methods which can recognize animate and inanimate participants in a conversation; to provide electronic speech control apparatus and methods which are relatively inexpensive and reliable to implement; and to provide electronic speech control apparatus and methods which are suited in implementation for dolls, toys, and a wide variety of person-system interactive applications generally.

Generally, and in one form of the invention, electronic speech control apparatus includes a circuit for establishing and changing over time a subject code and an utterance index, the subject code generally indicating one of a plurality of sets of utterances and the utterance index identifying an utterance of at least one word in the set indicated by the subject code. Combined with the circuit is another circuit responsive thereto for generating the utterance identified by the utterance index in the set indicated by the subject code.

In a method form of the invention, steps are performed of establishing and changing over time a subject code and an utterance index, the subject code generally indicating one of a plurality of sets of utterances and the utterance index identifying an utterance of at least one word in the set indicated by the subject code. A further step electronically generates the utterance identified by the utterance index in the set indicated by the subject code.

In another form of the invention, electronic speech control apparatus includes a circuit for repeatedly computing an emotion combined with another circuit responsive thereto for generating an utterance representing the emotion so computed.

In another method form of the invention, the method includes the steps of repeatedly computing an emotion and generating an utterance representing the emotion so computed.

In still another form of the invention for use in talking toys and the like, a first circuit generates utterances electronically and a second circuit controls the first circuit so that it generates the utterances in an alternating conversational fashion in response to a person's speech.

In still another method form of the invention, the method includes the steps of generating utterances electronically and controlling the utterances in an alternating conversational fashion in response to a person's speech.

In a yet further form of the invention, apparatus includes a first circuit for generating utterances, a second circuit for sensing loudness of sound in its vicinity between utterances, and a third circuit for causing the first circuit to generate an utterance indicative of excessive loudness when the same occurs.

These and other objects are accomplished according to the present invention as is described in further detail hereinafter.

BRIEF DESCRIPTION OF THE DRAWING

FIG. 4A is a diagram of a Received Doll Communication Code (RDCC) used in the invention or an embodiment thereof;

FIG. 4B is a diagram of a Transmitted Doll Communication Code (TDCC) used in the invention or an embodiment thereof;

FIG. 6A is a conversation table diagram;

FIG. 6B is a diagram of a collection of conversation tables;

FIG. 7 is a diagram of a Word-and-Phrase table;

FIG. 7A is a diagram of an address table relating the conversation table to the Word-and-Phrase table;

Corresponding numerals refer to corresponding parts in the various figures of the drawing.

DETAILED DESCRIPTION OF THE PREFERRED EMBODIMENTS

Figure 1:
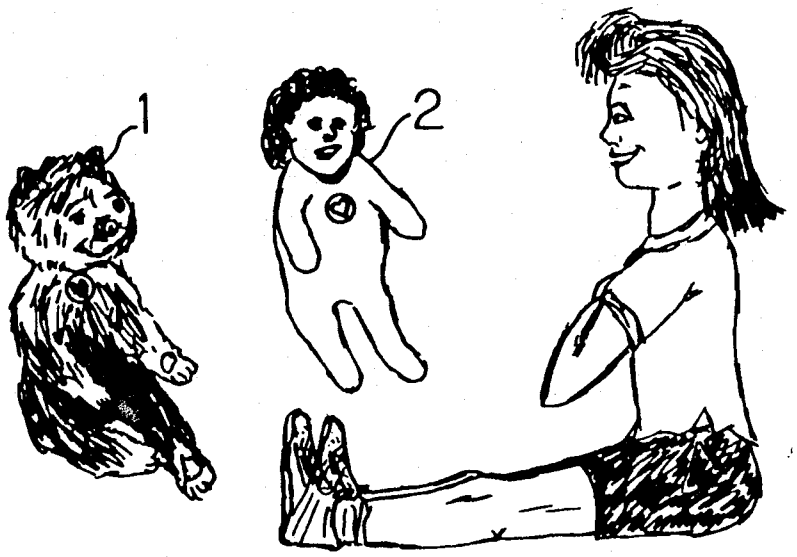
FIG. 1 is a pictorial sketch of a child playing with two dolls, each doll including electronic speech control apparatus of the invention operating according to methods of the invention.

In FIG. 1 a child (on right) plays with either one or both of dolls 1 and 2 of the present invention. Inside each doll 1 and 2 is electronic speech control apparatus of the same kind according to the invention operating according to methods of the invention. The child moves the dolls, cuddles them, stands them up, sits them down, lies them down and talks to them. Dolls 1 and 2 talk to the child and to each other, and their conversation is fascinatingly affected by what they hear. Robotic control circuitry in each doll 1 and 2 provides motion of head parts, arms and legs for self-expression and locomotion. The dolls converse with the child and each other on various subjects in unpredictable and meaningful manner, providing an entertaining play time for the child and other members of the family.

Each doll 1 and 2 has an optional adjustment dial with a symbol such as a heart, as shown in FIG. 1. The dial requires no adjustment in playing with the dolls, but can be used by the child to influence the personality of a doll and the course of conversation. The dolls 1 and 2 have simulated emotions which are affected by what they hear and which influence what they say. Dolls 1 and 2 recognize that the child is with them and one of the dolls can introduce the other by name to the child.

Figure 2:
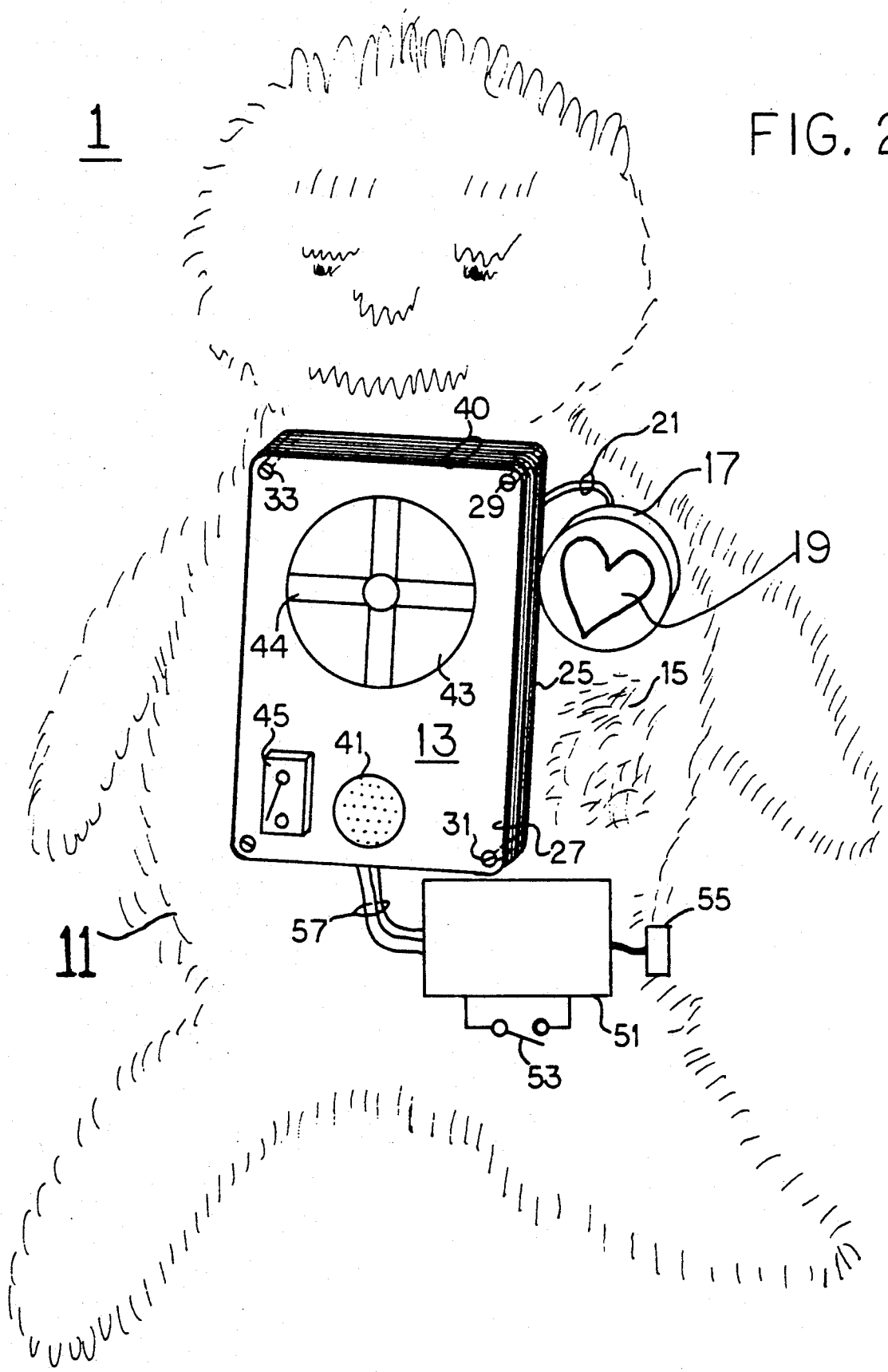
FIG. 2 is a pictorial sketch of the electronic speech control apparatus inside of one of the dolls of FIG. 1.

In FIG. 2 the general construction of doll 1 is shown. It is to be understood that the construction of doll 2 is identical except for such differences described hereinbelow which provide its separate identity. Doll 1 has a soft plastic or cloth doll body covering 11 which encloses an electronics assembly 13 which is suspended in body 11 in ample soft packing 15. A variable resistor 17 with a hard rubber heartmarked dial 19 is mounted on body covering 11 and physically floats with covering 11 relative to electronics assembly 13 to which variable resistor 17 is connected by two flexible wires 21.

Electronics assembly 13 is constructed illustratively of two printed circuit boards 25 and 27 mounted parallel to one another by spacers 29, 31, 33 and a fourth spacer out of view. Circuit board 27 has mounted thereon a microphone 41 and a loudspeaker with protective grill 44. A motion sensitive switch 45 is mounted on board 27 and activates doll 1 assembly 13 when doll 1 is moved, cuddled or otherwise adjusted in position.

A battery holder 51 is firmly mounted beneath an access flap (not shown) on the inside lower back of the doll body covering 11. One or more 9 volt batteries are held by battery holder 51 and their weight with that of electronics assembly 13 provides a comfortably located center of gravity for the doll 1. A multiturn magnetic induction coil 40 is mounted like a collar around the rest of electronics assembly 13.

Affixed to battery holder 51 is a slide switch 53 for electrically disconnecting battery power from doll 1 without removing the batteries in holder 51. In this way a parent or older child can turn off the sound produced by doll 1 if desired. Ordinarily, however, switch 53 is always in the "on" position, because electronics assembly 13 automatically shuts itself off upon the expiration of a time interval after the last previous motion of the doll. In this way, the doll "sleeps" if the child merely leaves the doll alone for the time interval.

An optional microphone jack 55 affixed to battery holder 51 permits a play use of the doll 1 wherein an external microphone (not shown) is connected so that a child talking into the external microphone causes the child's own speech to be heard through loudspeaker 43. Ordinarily, however, doll 1 autonomously executes conversational speech when jack 55 is not connected to the external microphone. Three wires 57 connect battery holder 51 to electronics assembly 13, for Battery, Mic, and Common. Electronics assembly 13 is an example of electronic speech control apparatus.

Figure 3:
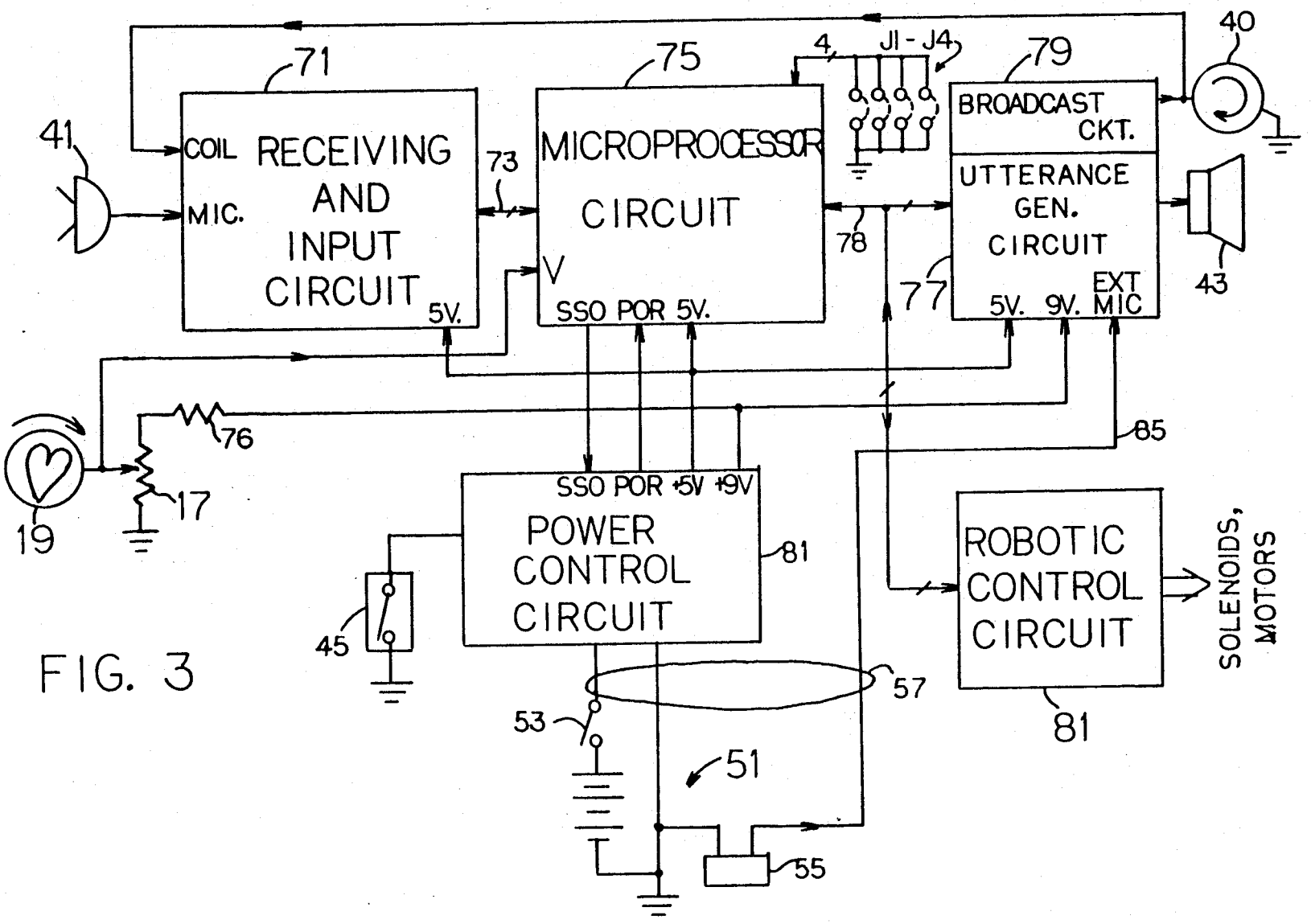
FIG. 3 is a block diagram of the electronic speech control apparatus.

Printed circuit boards 25 and 27 hold electronic circuitry shown in block diagram form in FIG. 3. In FIG. 3 microphone 41 is connected to a Receiving and Input Circuit 71 which is interconnected via a bus 73 to a microprocessor circuit 75. Magnetic induction coil 40 is also connected to Circuit 71 which detects codes from doll 2 identifying doll 2 and its subject of conversation. Variable resistor 17 is connected on a wiper lead to microprocessor circuit 75 and on a second lead to common. A resistor 76 is connected between the wiper lead of variable resistor 17 and +5 volts. In this way variable resistor 17 acts to vary an electrical voltage level on its wiper lead to microprocessor circuit 75.

Microprocessor circuit 75 is interconnected to an Utterance Generating Circuit 77 by a bus 78 and also interconnected to a Broadcasting circuit 79. Utterance Generating Circuit 77 drives loudspeaker 43 and Broadcasting circuit 79 drives magnetic induction coil 40. Bus 78 is also connected to a robotic control circuit 80 which has outputs for controlling solenoids and motors for the head and limbs of doll 1.

A power control circuit 81 supplies +9 volts battery voltage to Utterance Generating Circuit 77 and Broadcasting Circuit 79. Circuit 81 also supplies a +5 volt regulated output for powering low-power-low-dissipation complementary metal oxide semiconductor (CMOS) logic in circuits 71, 75 and 77. Power control circuit 81 has motion switch 45 connected between an input of circuit 81 and common.

When the +5 volt line from circuit 81 is activated, a power-on reset line POR holds microprocessor circuit 75 reset for a short time to prevent transient undesirable conditions. If microprocessor circuit 75 determines that excessive loudness at microphone 41 is occurring repeatedly, circuit 75 sends a Self Shut Off signal on line SSO to power control circuit 81, deactivating the 9 volt and 5 volt outputs.

Manufacture of dolls and toys must of course meet consumer product safety standards and all applicable legal requirements including electromagnetic emissions regulations, and implementation of the present invention should be in accordance with all such standards, laws and regulations.

In FIG. 3 microprocessor circuit 75 is an example of a circuit for establishing and changing over time a subject code and an utterance index. The subject code S generally indicates one of a plurality of sets of utterances. The utterance index I identifies an utterance of at least one word in the set or table indicated by the subject code S. Utterance generating circuit 77 is an example of a circuit which is responsive to the establishing and changing circuit (e.g. 75) for generating an utterance (e.g. through loudspeaker 43) identified by the utterance index in the set indicated by the subject code. The circuitry of FIG. 3 is compatible for use with additional electronic speech control apparatus of the same kind in doll 2. Broadcasting circuit 79 is an example of a circuit for broadcasting both the subject code S and a doll self-identity code (DSIC) to the additional apparatus by magnetic induction. Transmission by broadcasting is regarded as a subcategory of all the various ways of sending the information. Broadcasting makes the information available to all dolls in the vicinity, while other ways of sending may make the information go only to specific dolls, as by wire.

A set of wire jumpers J1–J4 in FIG. 3 are connected selectively between microprocessor circuit 75 and common. Jumpers J1–J4 are an example of means for supplying an identification code for the apparatus which is broadcasted by circuit 79, and acts as a cue for doll 2.

Circuit 71 of FIG. 3 is an example of a circuit that senses a subject code SCR analogous to subject code S except that subject code SCR is established in doll 2 as the subject code for doll 2. Circuit 71 receives a Received Doll Communications Code (RDCC) from doll 2. RDCC is received by circuit 71 magnetic induction from the additional apparatus of doll 2 through magnetic induction coil 40. Together, circuit 71 and microprocessor 75 are an example of a controlling means for utilizing the code (e.g. RDCC) to determine the utterances. RDCC includes an Other Doll Identification Code (ODIC) and the subject code SCR. Circuit 71 advantageously ignores the transmitted doll communications code (TDCC) from circuit 79 because circuit 71 can be inhibited by microprocessor circuit 75 at such time. Circuit 71 with microphone 41 also senses the loudness (e.g. the intensity at the microphone) of sounds in its vicinity and utilizes the sensed sounds by their loudness (or other parameter such as pitch) to determine the utterances.

Microprocessor circuit 75 in FIG. 3 is an example of a circuit for repeatedly computing emotions including hope, fear, surprise, boredom, glad-sad feelings, self-esteem or guilt-pride, like-dislike, and tension (or feeling "uncomfortable"). Circuit 77 responds to circuit 75 for generating an utterance representing each emotion so computed at selected times such as when the emotion changes. Circuit 77 includes a voice synthesizer circuit of commercially available type for producing the utterances electronically, as an example of utterance generating means. Microprocessor circuit 75 controls circuit 77 so that it generates the utterances in an alternating conversational fashion in response to a person's speech and in response to utterances of the additional apparatus in doll 2 and apparatus in other dolls.

Microprocessor circuit 75 has variable resistor 17 connected thereto to vary an electrical level as a decisional influence for the controlling means of which circuit 75 is part. The loudness of sound at microphone 41 also acts as a decisional influence R on circuit 75 through circuit 71. Circuit 71 with microphone 41 senses the loudness of sound in its vicinity between utterances from circuit 77, and circuit 71 with circuit 75 causes circuit 77 to generate one or more utterances indicative of excessive loudness or absence of sound above a threshold level, when the same occurs.

Microprocessor circuit 75 is an example of a circuit that determines utterances by selecting subjects thereof and for causing circuit 77 to generate an utterance (such as "All right" or "I changed my mind") when the selected subject code S, and thus the subject, is changed. It also repeatedly computes emotions and causes circuit 77 to generate a further utterance determined from the level and type of emotion so computed. Microprocessor circuit 75 by using the Other Doll Identification Code (ODIC) consults its memory for the name of the other toy having that ODIC and its relationship to the other toy (friend, enemy, mother, child, etc.) and then causes circuit 77 to generate an additional utterance identifying the other toy such as doll 2 by name when the other toy is in its vicinity. On the other hand, when sound is sensed but no ODIC is received, microprocessor circuit 75 deduces that the sound is coming from a person, a toy lacking ODIC, or other source, and causes utterances accordingly.

Robotic control circuit 80 is responsive to microprocessor circuit 75 for executing a visible motion, as of head, arms and legs, corresponding to the utterance identified by the utterance index in the set indicated by the subject code S.

The motion switch 45 is an example of means for sensing when the apparatus is moved. Power control circuit 81 is an example of a circuit connected to the sensing means for supplying power to the generating means (e.g. circuit 77) and the controlling means (e.g. circuits 71 and 75) so long as the apparatus is moved at intervals shorter than a predetermined time interval. Microprocessor circuit 75 causes circuit 77 to generate an utterance indicative of excessive loudness when the same occurs and generates a signal on Self Shut Off line to circuit 81 when the loudness exceeds a predetermined level repeatedly. In this way microprocessor circuit 75 disables circuit 77, itself, and circuits 71, 79 and 80 through power control circuit 81.

Communications between doll 1 and doll 2 occur by means of their utterances and also by occasional transmissions of communications code TDCC from doll 1 to doll 2 and RDCC from doll 2 to doll 1 (nomenclature is in doll 1 perspective). In the preferred embodiment the format of RDCC and TDCC are as shown in FIGS. 4A and 4B respectively.

In FIG. 4A a Received Doll Communications Code is in a register having bits Q1–Q8 in circuit 71. This code RDCC when read from right to left is a start bit followed by a three-bit Other Doll Identification Code ODIC by which the other doll 2 makes its identity known to any compatible doll such as doll 1 within broadcast range. In the preferred embodiment the broadcast range is about 5 feet (1.6 meters). With a 3-bit ODIC, seven different doll identities of dolls in a product family are available with zero (000) being reserved in this embodiment.

After ODIC in the code RDCC comes a four-bit subject code received from doll 2 by doll 1 which subject code is SCR. With a 4-bit SCR, fifteen different subjects are selectable, with zero (0000) being reserved. In this way the conversational subject repertoire of doll 1 is sufficient to attract and keep the child's play interest. Moreover, there are different subjects for different dolls and for conversation with the child, so that the actual number of subjects greatly exceeds fifteen. For example, subject 0011 for doll 001 talking to doll 010 can be established different from the same numbered subject 0011 for doll 001 talking to a different doll 011.

In FIG. 4B a Transmitted Doll Communications Code TDCC is in a register in microcomputer circuit 75 having bits 0–7. This code TDCC when read from left to right is a start bit followed by a three-bit Doll Self Identification Code DSIC by which doll 1 identifies itself. After DSIC comes a four bit subject code of doll 1 which is the subject code S.

Each doll 1 or 2 typically emits a communications code when beginning a new subject of conversation or when changing its decision and shifting to a different subject in midstream. Although each doll can be programmed to send the code with each utterance, the preferred embodiment sends the code with each change of subject code and makes utterances unaccompanied by any communications code in general as long as the same subject is maintained. The communications code, however, is also advantageously sent when each doll is in the midst of a subject and there is no subject change necessarily but the dolls are brought within each other's vicinity and they sense each other's presence.

When a doll hears speech unaccompanied by a communications code upon initiating a new subject of conversation, the circuitry knows that a person or other sound source not having an ODIC is present. Then electronics assembly 13 inside the doll makes appropriate utterances to take account of the child, for example, in conversation.

In this embodiment, then, the actual utterances generated by doll 1 are a detailed verbal counterpart of the meaning of the communications code. The actual utterances also communicate meaning by their loudness. For example, if doll 1 and doll 2 are placed one meter apart, they have less loudness sensed by microphone 41 in each than when they are placed a half meter apart. Consequently, the physically closer the dolls are the greater their loudness is to each other and the greater influence (or relational closeness) they have each to the other.

The electronics assembly 13 in each doll waits for a randomly selected period of time before making an utterance, advantageously minimizing the chances of the dolls talking simultaneously. The doll with the longer random time period of waiting hears the other doll commencing speech and then waits for a further time period until the first doll has stopped talking before commencing its own speech. A second randomly selected time period, or pause, is then executed before the doll replies, to prevent the utterances of dolls 1 and 2 from continuing collectively without a break.

If the sound heard by a doll exceeds a comfortable loudness, such as from yelling, blaring radio, or excessively rough handling of the doll, then the doll interrupts its conversation to say so. If necessary, the doll turns itself off for a predetermined period of time or makes no further utterances until the excessively loud sound disappears.

Although the invention is advantageously implemented in embodiments with sophisticated voice recognition or automatic speech recognition input circuitry in circuitry 71, the present embodiment is believed to offer economic and performance advantages by distributing communication functions between the communication codes of FIGS. 4A and 4B and the actual utterances produced by utterance circuit 77.

Transmission of the communications code is unobtrusive to the child-user. In the preferred embodiment the transmission occurs soundlessly by magnetic induction at an ultrasonic frequency. In other embodiments, the transmission is advantageously performed by very short range radio, or by wire or acoustically at a high pitch or ultrasonically. In the present embodiment the transmission is a series of short (logic 0) and long (logic 1) duration bursts of pulses at about 22 KHz. and occupying about one second to transmit the entire code.

In other embodiments two different frequencies are used to represent logic 1 and logic 0 for each of the 8 bits in the communications code, as in frequency shift keyed transmission. In still other embodiments there is a center frequency acting as an amplitude-modulated carrier for two-tone transmissions such as 200 Hz. for logic 0, 1000 Hz. for logic 1, and pure carrier at 5 KHz. for intervals between. If the carrier is made ultrasonic, then a frequency should be used which is not bothersome to dogs and other pets. Where radio transmission is used, it should be at a frequency which is not interfered with by children's walkie-talkies, nor should the doll interfere with home radios, TVs and other electronic equipment.

To permit the fullest utilization of the various embodiments it is to be understood that the particular type of transmission and format of the communications code, when such a code is employed, are merely a matter of convenience and may be selected for greatest advantage in a particular application.

In FIG. 3 jumpers J1, J2, J3 and J4 by their presence or absence encode the identity of the doll, thereby achieving many different doll identities with a circuit that is capable of manufacture in large volume. The jumpers J1–J4 control various options as detailed in Table I. The Doll Self Identity Code DSIC is formed from various permutations of the jumpers which are established so that they can be decoded into DSIC with relatively uncomplicated software. Table II shows jumpers and example DSICs (0=jumper off, 1=jumper on, X=don't care).

TABLE I

| | JUMPER OPTIONS | |
|---|---|---|
| Option | Jumper | Remarks |
| Maturity | J1 | 0 = child emotions<br>1 = adult emotions |
| J1 subclass | J2 | J1 = J2 = 0 baby<br>J1 = 0, J2 = 1 child<br>J1 = 1, J2 = 0 parent<br>J1 = J2 = 1 adult not parent |
| Gender Role option | J3 | 0 = male<br>1 = female |
| Gender or Age | J4 | 0 = high |

TABLE I-continued

| | JUMPER OPTIONS | |
|---|---|---|
| Option | Jumper | Remarks |
| voice register | | 1 = low |

TABLE II

| Doll Character | J1 | J2 | J3 | J4 | DSIC |
|---|---|---|---|---|---|
| Baby | 0 | 0 | X | 0 | 001 |
| Boy | 0 | 1 | 0 | 0 | 010 |
| Girl | 0 | 1 | 1 | 0 | 011 |
| Mother | 1 | 0 | X | 0 | 100 |
| Father | 1 | 0 | X | 1 | 101 |
| Adult Woman | 1 | 1 | X | 0 | 110 |
| Adult Man | 1 | 1 | X | 1 | 111 |

Figure 5:
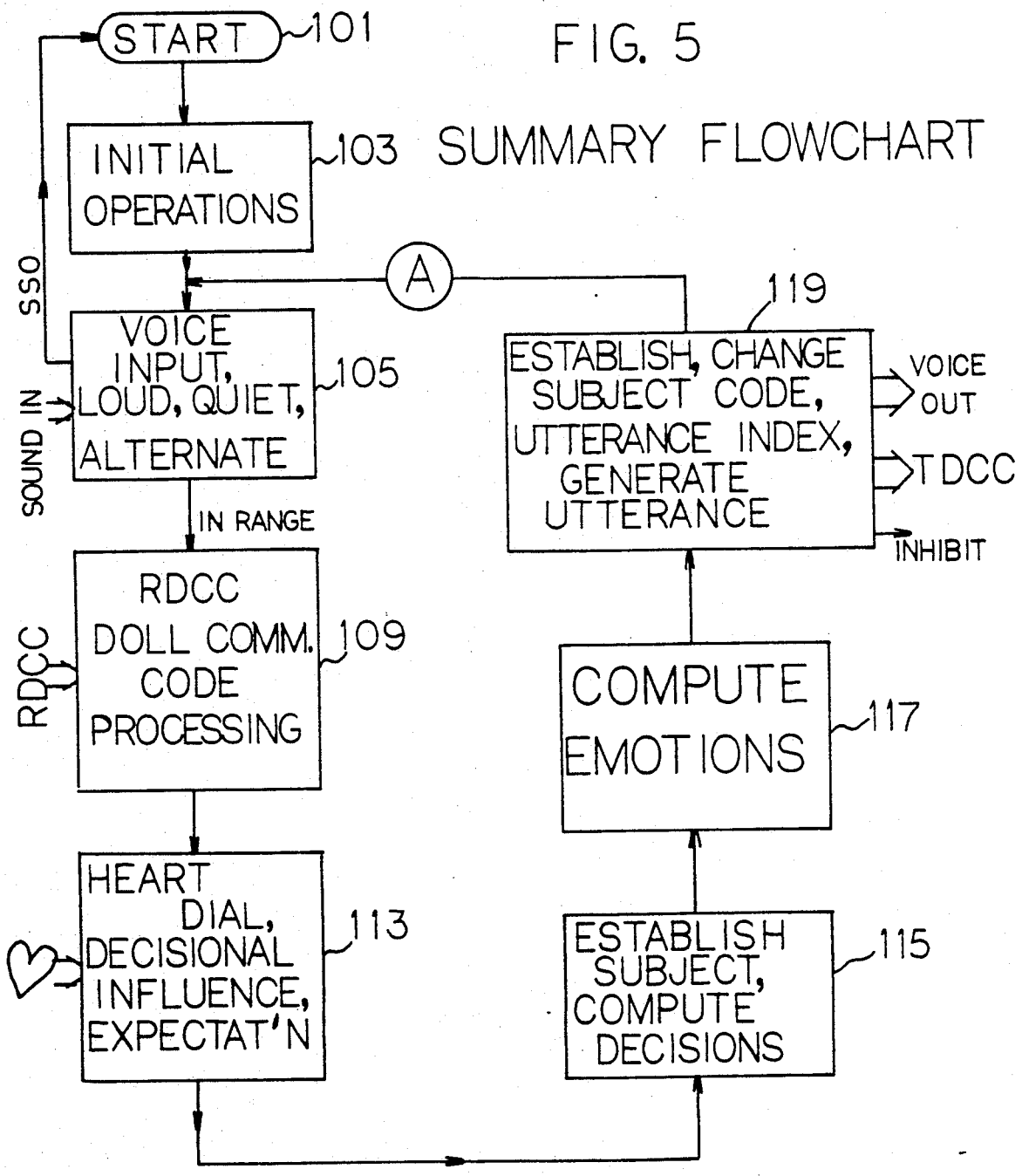
FIG. 5 is a summary flowchart of operations of the apparatus according to methods of the invention.

In FIG. 5 operations depicted in an Executive Summary Flowchart according to a method or process form of the invention and executed in microprocessor circuit 75 begin at a START 101. From START 101 operations proceed to a step 103 where power-on reset, initialization, conventional housekeeping, and reading and decoding of jumpers J1–J4 are performed.

Then in a step 105 microprocessor circuit 75 reads in information indicating the presence of sound and its loudness from input circuit 71. In step operations occur to determine whether the sound is too loud or too quiet. If too loud repeatedly a Self Shut Off SSO occurs and operations return to START 101. If the sound is in a normal range, timing operations are performed to ensure that the utterances to be produced will alternate with the received sound in a normal conversational fashion. In other words step 105 includes controlling the utterances in an alternating conversational fashion in response to a person's speech or in response to another doll.

If the sound is in range, then operations proceed to a step 109 where doll communications code RDCC is read in from circuit 71 if a logic 1 start bit is sensed. Next in a step 113, data regarding the emotional and personality state of the doll is read and generated from the variable electrical level produced by potentiomer, or variable resistor 17 of FIGS. 2 and 3. The position of the heart dial is here interpreted as two decisional influences and a value of expectation.

Operations proceed to a step 115 where a value of subject code S is initially established. Information in RDCC and the loudness R are translated into decisional influence values and decisions are imputed to the doll 1 itself and to the other doll 2. Next in a step 117 these decisional influence values, imputed decisions, and the expectation are used to compute emotions.

In the next subsequent step 119 microprocessor circuit 75 establishes and changes the subject code and the utterance index as appropriate to the situation. Depending on the decisions and emotions and changes therein, and the subject code and utterance index, microprocessor circuit 75 sends command bytes to utterance generating circuit 77 to produce the proper utterance or utterances. A communications code TDCC is sent to update doll 2 as necessary in step 119. An inhibit signal is passed on bus 73 of FIG. 3 to input circuit 71 to prevent the doll's own utterances and TDCC from being misinterpreted as the speech of another doll or child or code from another doll by circuit 71.

Operations loop back to step 105 through a point A and repeatedly execute steps 105, 109, 113, 115, 117 and 119 so those steps are part of the continual normal operation of the electronics assembly 13. In this way, each doll repeatedly computes its emotions, for instance, and controls its utterances in an alternating conversational fashion.

In FIG. 6A a conversation table has rows in erasable programmable read only memory (EPROM) (or in a random access memory made nonvolatile by a dedicated miniature battery) for the different subjects of conversation. The conversation table C has a set of columns (15 for example) corresponding to values of the utterance index. In other words, a particular utterance entry in table C is specified by its subject row S and utterance index I for the column. Each entry is a byte (8 bits) of digital information which can identify any one of 2-to-the-8th-power utterances. Since many utterances are frequently used, 2-to-the-8th or 256 possibilities are ample. Also associated with the conversation table in the I=0 column are entries corresponding to each subject indicating the number IMAX of utterances in a conversation on each subject S.

The manner of preparing conversation tables for the dolls is now described. First, several doll conversations for every possible pair of dolls in the doll product family are written. For example, Table III shows three doll conversations

TABLE III

THREE CONVERSATIONS BETWEEN GIRL DOLL (NUMBERS) AND BABY DOLL (LETTERS)

| | Puzzle | Comb Hair | Ball |
|---|---|---|---|
| 1 | Let's do a puzzle | Let's comb hair | Let's play ball |
| A | Puzzle | Comb | Ball |
| 2 | Where is the puzzle? | I have a comb | Here it is |
| B | I don't know | Good comb | Good ball |
| 3 | Closet | I'm combing your hair | Good throw |
| C | OK . . . Puzzle | Comb gone | Ball |
| 4 | Here it is | The comb fell down | You missed the ball |
| D | Colors | Here | Get ball |
| 5 | Put the puzzle together | I'm combing you more | Go get the ball |
| E | So many | Ouch! | Whee |
| 6 | I got a piece in | I'll stop | Oops, I missed the ball |
| F | Good puzzle | Me comb | Haha! |
| 7 | Here's a puzzle piece that fits | You comb my hair | The ball is under the table |
| G | Big picture | Comb, comb, comb | Get ball |
| 8 | The puzzle is almost done | You comb very well | I found the ball |
| H | Piece in | Comb, comb, comb | Ball |
| 9 | Here are more pieces | OK that's enough | Go get it |
| J | Piece in | Comb away | Whee! |
| 10 | Very good! | No, put it in drawer | I caught it |
| K | Done | Comb away | Good ball |

between one pair of dolls—a girl doll and a baby doll (identity codes 011 and 001 in Table II respectively). The person writing the conversation finds it convenient to write the conversation as it would be heard, of course, in the manner of a playwright writing a play. However, only the utterances that the girl doll makes, for instance, will be entered in the conversation that the girl doll accesses to talk to the baby doll. Therefore, each row of the Table III which represents an utterance of the girl doll is given a consecutive number. Each row of Table III which represents an utterance of the baby doll is given a consecutive letter.

Next, all the utterances in Table III are encoded as a series of allophone codes which are digital codes that command the voice synthesizer in utterance generating circuit 77 to produce a corresponding series of allophones which are basic units of speech which when output serially through loudspeaker 43 are heard as the corresponding selected utterance at any given point in Table III. Each distinct utterance from Table III is then entered as a separate series of bytes in a Word-and-Phrase Table shown in FIG. 7.

The starting addresses of each series of bytes in FIG. 7 are entered in an address table as shown in FIG. 7A. Corresponding to each value that a computer byte can have, K, (0, 1, 2, . . . 255) and consecutively up to the highest number needed to address the Word-and-Phrase Table, is an address value ADR. Different values of K are entered in different cells of the conversation table of FIG. 6A depending on which utterance is to be accessed.

For example, assume that in the baby doll the entry for subject 2, utterance 1 is 21. Microprocessor circuit 75 when it is ready to cause utterance of utterance 1 in subject 2 looks up in the conversation table and finds the number 21 in binary form. Then it addresses the address table of FIG. 7A in memory at address 21 and finds address ADR=1570 in the Word-and-Phrase Table of FIG. 7. Next it asserts address ADR=1570 to memory and increments the address pointer asserting each address from 1570 to the address which is one less than the address corresponding to address 22 next to address 21 in the table of FIG. 7A. That address ADR, is 1573. Therefore, the series of addresses ADR which are asserted is 1570, 1571, 1572. When these are asserted to the Word-and-Phrase Table, memory retrieves three prestored allophone codes which are sent to circuit 77 and make it say the utterance "Comb", which has three allophones in it.

Assume that the next time the baby doll is to talk, the utterance index reaches 2 in subject 2 in the conversation table of FIG. 6A. Memory retrieves the number 22 in binary and circuit 75 asserts the 22 to the FIG. 7A table. Memory retrieves address number ADR=1573. Circuit 75 asserts addresses from 1573 in order up to one-less-than 1580 which is the next ADR value in the table of FIG. 7A. Memory retrieves seven allophone codes which are sent to circuit 77 to form the utterance "Good comb".

In preparing each doll, the conversational utterances of Table III are then divided in the following manner:

A. Load series of allophone codes for all distinct utterances of the numbered rows into the Word-and-Phrase Table (FIG. 7) of the girl doll.

B. Load the corresponding memory addresses of each utterance for the girl doll as ADR values in sequence into the address table of FIG. 7A.

C. Load the K values corresponding to the ADR values in the address table of FIG. 7A into the conversation table of FIG. 6A in the order in which those utterances to which the K values ultimately correspond appear in the numbered rows for each subject (Puzzle, etc.) in Table III.

D. Repeat steps A, B and C for the baby doll by using the lettered rows of Table III.

If the girl doll initiates a conversation with a baby doll, it makes an utterance from column 1 of its conversation table of FIG. 6A. Then the baby doll replies from the first column of its conversation table. Now assume that in a different situation the baby doll begins the conversation starting with the first column of its conversation table. Then the girl doll, instead of beginning from column 1 of its conversation table, is programmed in the preferred embodiment to start at column 2 of the table in order to keep the conversation in sequence.

The test by which this advantageous result is obtained, is to compare the doll identification code of the initiating doll with the initiating doll with the identification code of the responding doll. If this identification code is greater than or equal than the identification code of the listening doll, then the listening doll begins with its column 1. Otherwise, the listening doll begins with its column 2. However, when a doll initiates a subject, it starts with its column 1 for that subject in its conversation table.

Since it is contemplated that conversations between different pairs of dolls in the product family will differ, separate conversation tables for each pair of dolls are suitably provided in memory. In FIG. 6B a collection of conversation tables of FIG. 6A is provided in memory. The particular conversation (set of subjects) which is accessed is determined by Doll Self Identity Code DSIC and Other Doll Identity Code ODIC. Each cell in FIG. 6B is a conversation table of FIG. 6A. For example a girl doll (DSIC=011 or 3) talks to a baby doll (ODIC=001 or 1) by using cell 131 as its conversation table. Baby doll handles its part of the conversation using cell 133 from its own memory as its conversation table.

Where memory cost is not an important economic consideration, all conversation tables for all seven dolls (identity DSIC established by jumpers J1–J4) are stored in each doll. Otherwise only a column of conversation tables in FIG. 6B is stored in the memory of the doll having DSIC corresponding to the column. It is noted that two dolls with the same identity DSIC=ODIC may talk to each other in which case two conversation tables (one for the initiating doll and one for the listening doll are provided as indicated by the divided cells in FIG. 6B. Each half of each divided cell is the same actual size as any other cell in the collection. The row for ODIC=0 in FIG. 6B is conversation tables for each doll talking to a child user in the absence of another doll. If each conversation table has 225 bytes and a column of 9 cells in FIG. 6B is stored, then about 2 K bytes of memory is occupied. Assuming 12 bytes of Word-and-Phrase table for every byte of conversation table results in 24 K bytes of Word-and-Phrase table. 6 K bytes of memory in a 32 K byte memory would remain for program software.

The Word-and-Phrase table of FIG. 7 suitably also includes codes interspersed with the allophone codes for controlling robotic actuating solenoids or motors in the doll's head and limbs through robotic control circuit 80. In general, fewer than all 8 bits (256 permutations) of a byte are needed to define the allophone codes, so there are codes left over to provide instructions for the eyes, nose, mouth, arms, hands, and legs of a doll.

Table IV provides a glossary of variables for the software that controls the electronic speech of each doll.

Figure 8:
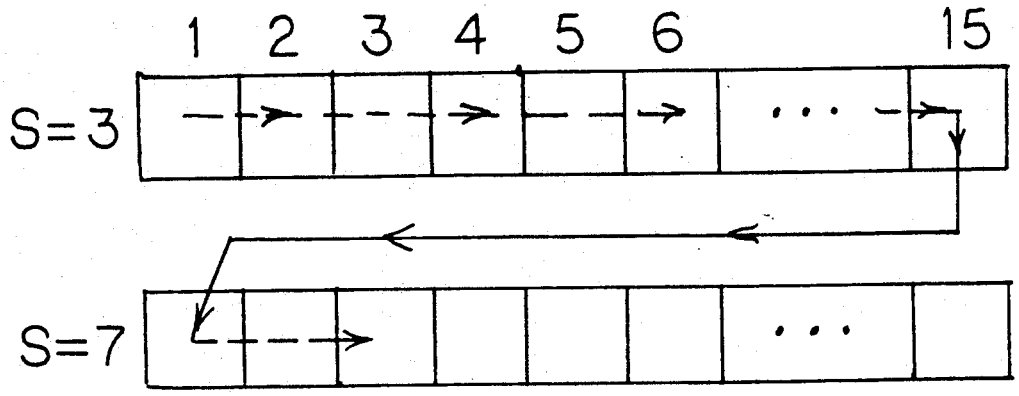
FIG. 8 is a diagram of two rows in a conversation table showing a transition therebetween in the operations of the apparatus.

In FIG. 8 doll 1 begins a subject of conversation with utterance index I=1 on subject 3. As the conversation proceeds, doll 1 progresses to utterances 2, 3, . . . until it reaches IMAX for that subject 3 which is shown as I=15. At this time doll 1 picks a new subject S=7 at random and returns to utterance index I=1 whence it proceeds through the row S=7.

Figure 9:
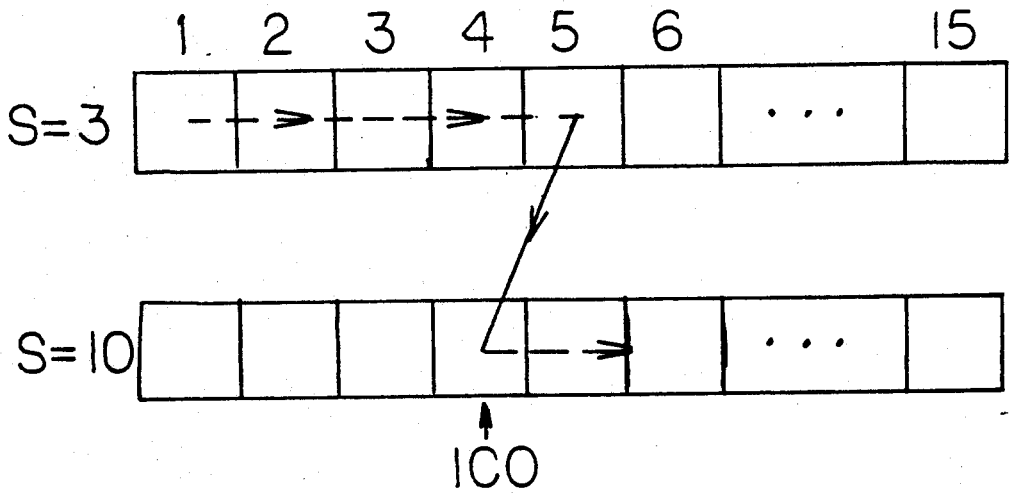
FIG. 9 is a diagram of two rows in a conversation table showing another type of transition therebetween in the operations of the apparatus.

In another example in FIG. 9 doll 1 begins a subject of conversation with utterance index I=1 on subject. Conversation proceeds until doll 1 reaches utterance 5. Then because of decisional influences upon doll 1, it makes a transition to a new subject S=10 which perhaps is the subject that doll 2 is on so that doll 1 can interact with doll 2 on the same subject.

TABLE IV

| GLOSSARY OF CONTROL VARIABLES | |
|---|---|
| DS | Decision of Self |
| DSO | Previous Decision of Self |
| DR | Decision of Other Doll imputed from RDCC |
| DRO | Previous Decision of Other Doll |
| RDCC | Received Doll Communications Code |
| TDCC | Transmitted Doll Communications Code |
| SCR | Subject Code Received |
| S | Subject of Conversation of Self: Subject Code |
| L = NOT INR | Logic 1 is Doll is a Listener, i.e. conversation initiated by other doll, else logic zero is Doll is Initiator (INR = 1) |
| I | Utterance Index |
| C (I, S) | Conversation Table with column index I, row S |
| ODIC | Other Doll Identification Code in RDCC |
| DSIC | Doll Self Identity Code in TDCC |
| DC | Decision Change by doll self 1 = change, 0 = no change |
| ICO | Index Counted from Other doll |
| EC | Emotion Change: 1 = change; 0 = no change |
| SO | Previous S |
| SCRO | Previous SCR |
| CH | Counter of High loudness |
| CL | Counter of Low loudness |
| FLW | Low loudness Flag |
| FLD | Loud Flag |
| R | Relational influence of other doll related to loudness here |
| W5 | Decisional inertia or hysteresis, habituation |
| D1 | Decision of Self on +10, −10 basis |
| D2 | Decision of Other Doll on +10, −10 basis |
| TM1 | Timer 1 |
| TM2 | Timer 2 |
| TMW | Waiting Time-maximum |
| TML | Listening Time-maximum |
| TMP | Pause Time-maximum |
| SSO | Self Shut Off |
| ODICS | Previous ODIC |
| Q8 | Start bit in RDCC |
| U(1), U(2) | Decisional Influences or Utilities |
| U(3) | Decisional Influence imputed to other doll |
| U(4) | Decisional Influence due to decisional inertia W5 |
| X | Expectation |
| S3 | Sum of U(1), U(2) and U(4) divided by 3 |
| J | Counting index for U(J) |
| TSN | Sum of negative U's |
| TSP | Sum of positive U's |
| T | Tension |
| L12 | Like-dislike |
| J1–J4 | Option jumpers |
| P | Self-esteem, guilt-pride |
| K1, K2 | indices for object matrix Q |
| Q | object matrix |
| H | Hope |
| F | Fear |
| B | Glad-Sad Feelings |
| BF | B Flag to tell when to compute Surprise |
| SRP | Surprise |
| BDM | Boredom |

Doll 1 has been keeping count of doll 2 utterances ICO and consequently doll 1 makes a transition to utterance ICO=4 in subject 10 and progresses through conversation on that subject with doll 2. When the transition occurs, doll 1 utters a decision change phrase such as "All right" followed by one or more emotion change phrases such as "I'm glad" before uttering statements controlled by the conversation, which statements are called action utterances herein. A TDCC communication code is broadcast to doll 2 from doll 1 at this time in order to update doll 2.

Next discussed are flowcharts detailing the steps of FIG. 5 in methods, processes and operations according to the invention in a preferred embodiment thereof. The flowcharts are used by the skilled worker to write software corresponding to the steps of the flowcharts for microprocessor circuit 75. It is to be understood that the flowcharts are illustrative of one of numerous ways of implementing the inventive methods and software in the practice of the invention. FIG. 5 shows the main steps and the order in which the steps are executed. In the discussion which follows, the steps of FIG. 5 are discussed in detail individually and not necessarily in the order of their actual execution in FIG. 5 so that the operations in later steps are understood before operations preparatory thereto, and requiring an understanding of the later steps, are explained.

Figure 10:
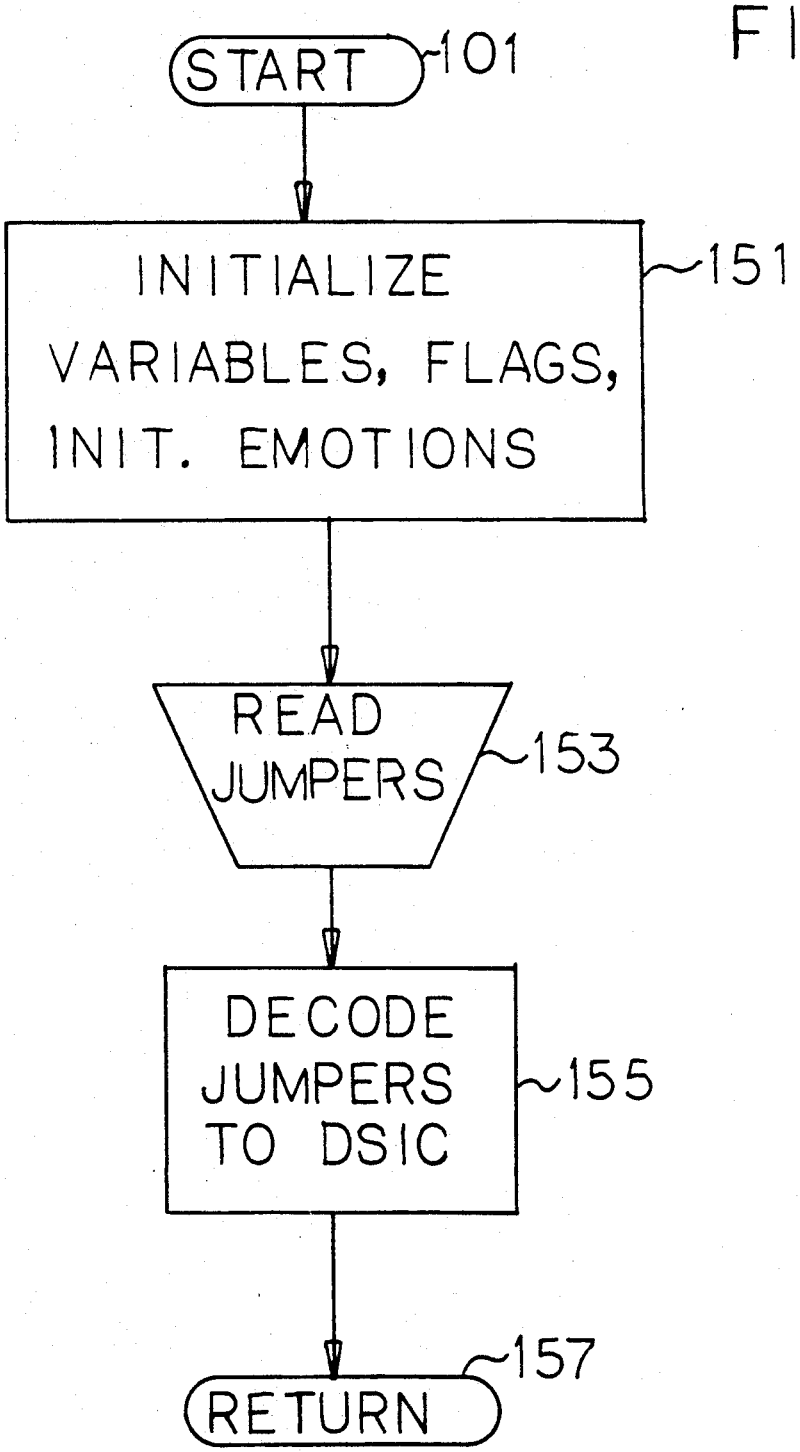
FIG. 10 is a detailed flow diagram of initial operations in FIG. 5.

In FIG. 10 operations of FIG. 5 begin with START 101 and proceed to the operations of step 103. In step 103 several steps included therein are executed. First, in a step 151 variables are initialized so that I=1, S=SCR=SO=0, ICO=0, ODIC=0, CH=CL=FLW=FLD=R=0, Dl=D2=10, DC=0, DR=DRO=1, DS=DSO=1, and a habituation weight W5=0.1. Next in a step 153 jumpers J1-J4 are read in as ones and zeros depending on whether the jumpers are present or absent respectively. Then in a step 155 the DSIC code is obtained by decoding the jumpers J1-J4 according to Table II, whence a RETURN 157 is reached.

Figure 11A:
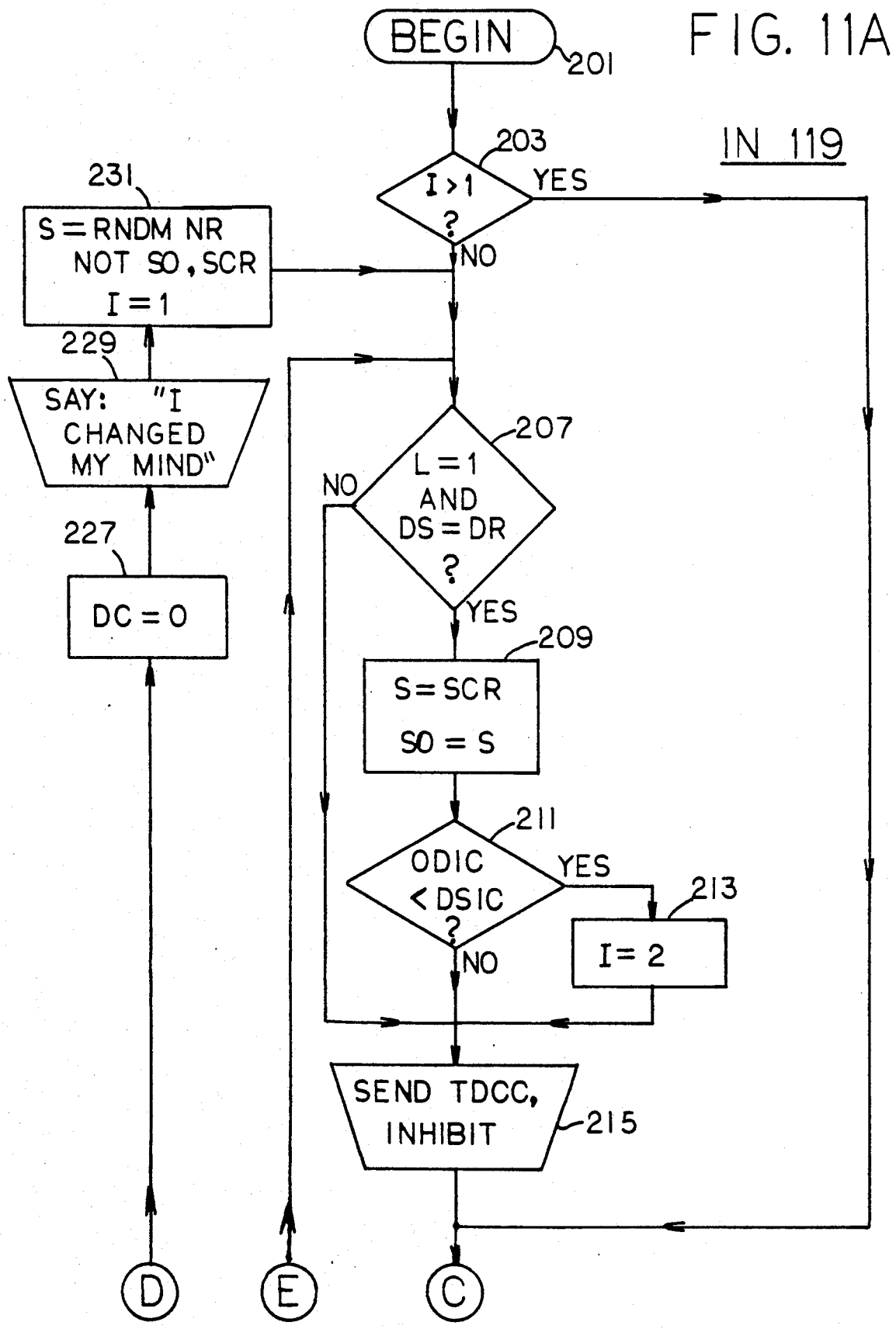
FIGS. 11A and 11B are two halves of a detailed flow diagram of operations for establishing and changing a subject code and an utterance index in more detail compared to FIG. 5.
Figure 11B:
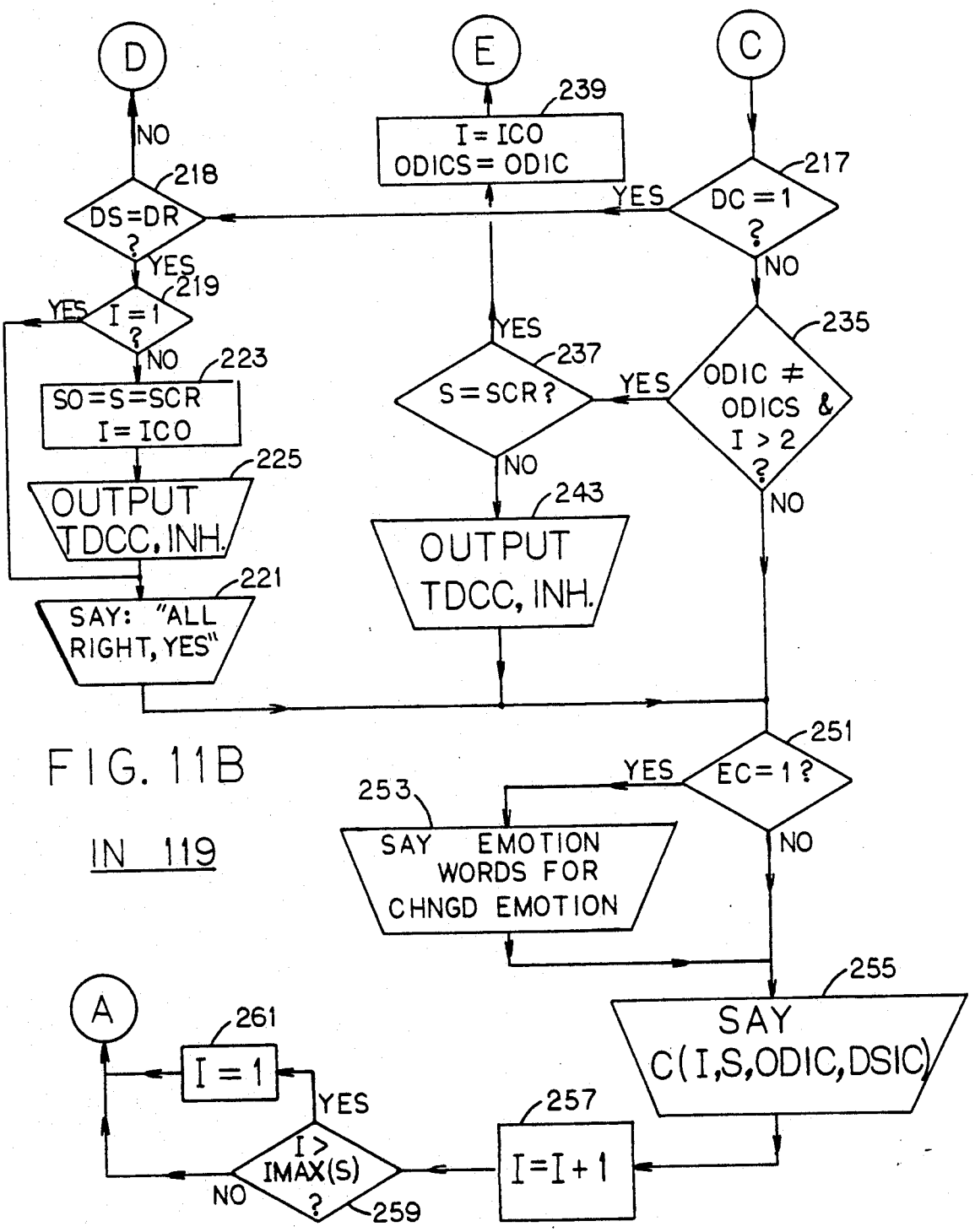

Step 119 of FIG. 5 is shown in greater detail in FIGS. 11A and 11B. Operations commence with a BEGIN 201 and proceed to a decision step to test whether utterance index I exceeds one. If not (I=1), operations proceed to a decision step 207 from the decision step 203. In step 207 a test is made to determine whether L=1 and DS=DR. If so, this means that the doll is a listener and the decisions of the two dolls are the same, so operations proceed to a step 209. In step 209, the subject code S for the doll is set equal to the subject code SCR received from the other doll, and subject storage SO is set equal to subject code S=SCR. Next, in a step 211 ODIC is compared with DSIC. If ODIC is less than DSIC, the utterance index I is set to 2 instead of 1 in a step 213 because the sequence of conversation would otherwise be out of order between the two dolls as discussed earlier hereinabove. After step 213 input circuit 71 is inhibited and communications code TDCC (which includes DSIC and S) is broadcast in a step 215. If in step 211, ODIC is not less than DSIC, operations proceed directly to step 215 since there is no need to modify index I. In step 207 if L is not one or the decisions DS and DR are not the same, there is no need to update subject code S or index I, and operations branch from step 207 directly to step 215.

After step 215 operations proceed through a point C to a decision step 217 of FIG. 11B to test whether there has been a decision change of the doll (DC=1). If so, operations proceed to a decision step 218 to test whether decisions DS and DR are the same. If so, a test 219 is made to determine whether index I=1. Test 219 is needed since I may be 1, or 2 as discussed just above, or 2 or more by virtue of a branch from step 203 in FIG. 11A directly through point C to step 217 of FIG. 11B if I exceeds 1. If I is 1 in test 219 operations proceed directly to a step 221 to cause a decision change utterance "All right, yes" to be made by circuit 77. If in test 219 index I exceeds one, then operations go to a step 223 to set subject code S equal to received subject code SCR and to make SO the same as the new S. Also, index I is set to the index counted ICO from the other doll 2 to place doll 1 conversation in sequence with that of doll 2 when doll 1 has decided to change over to doll 2 subject. After step 223 operations proceed to a step 225 to inhibit input circuit 71 and send TDCC to update doll 2 that doll 1 has changed its subject code. After step 225 step 221 is executed to say "All right, yes."

If there was a decision change DC=1 in step 217 but the decisions in step 218 are different, then operations branch from step 218 through a point D to a step 227 of FIG. 11A to set DC to zero whence a step 229 causes circuit 77 to say a decision change utterance "I changed my mind." Next, in a step 231, the subject code is set equal to a random number between 1 and 15 (the range of the conversation table rows in this example) which number is exclusive of previous subject SO and received subject code SCR. (Example: SO=5, SCR=10. The new S is any number such as 3 which is in the range 1-15 but is neither 5 nor 10). In step 231 the index I is initialized to 1 and operations go to step 207.

In FIG. 11B step 217 if there is no decision change so DC is not one, then operations go to a decision step 235 to test whether ODIC is different from previous value ODICS and index I exceeds two. If so, doll 2 has been brought into the vicinity of doll 1 while doll 1 is in the midst of a conversational sequence, and operations test whether the subject codes S and SCR are the same, in a step 237. If S=SCR then a branch is made to a step 239 to set index I the same as ICO and update ODICS to be the same as ODIC whence operations pass through a point E to step 207 of FIG. 11A. In FIG. 11A operations as earlier described set variables and send TDCC in step 215 to update the newly arrived doll 2.

If in FIG. 11B step 237, subject code S is not the same as SCR, then operations proceed to a step 243 to send TDCC to update newly arrived doll 2 whence a decision step 251 is reached. Also, if there was no change in ODIC so that ODIC=ODICS in step 235, operations proceed directly to step 251. Step 251 is also reached directly after step 221 discussed earlier. It will be understood that the steps described above in FIGS. 11A and 11B can take a myriad of paths the result of which is to remarkably respond in correct manner to a wide variety of situations in doll play so that the doll has the right index I, subject code S, other doll identification code and its own DSIC to make an appropriate utterance at any given time.

In step 251 of FIG. 11B, emotion change flag EC is tested to determine if it is one. If so, operations proceed to a step 253 to say emotion words descriptive of the emotion as shown in Table V and FIG. 11C, whence a step 255 is reached and an action utterance is obtained from the correct conversation table in memory C(I,S-,ODIC,DSIC) and caused to be heard through loudspeaker 43. If EC is not one in step 251 the emotion words of step 253 are bypassed and operations pass directly to step 255. After step 255 is executed, index I is incremented by one in a step 257 and a test is made in a step 259 to determine whether index I exceeds IMAX(S) the maximum number of utterances on that subject in the conversation table for ODIC and DSIC. If not, operations loop directly through point A back to step 105 of FIG. 5. If index I exceeds IMAX in step 259, a branch is made to initialize I back to one in a step 261 whence operations loop back through point A to step 105 of FIG. 5.

Figure 11C:
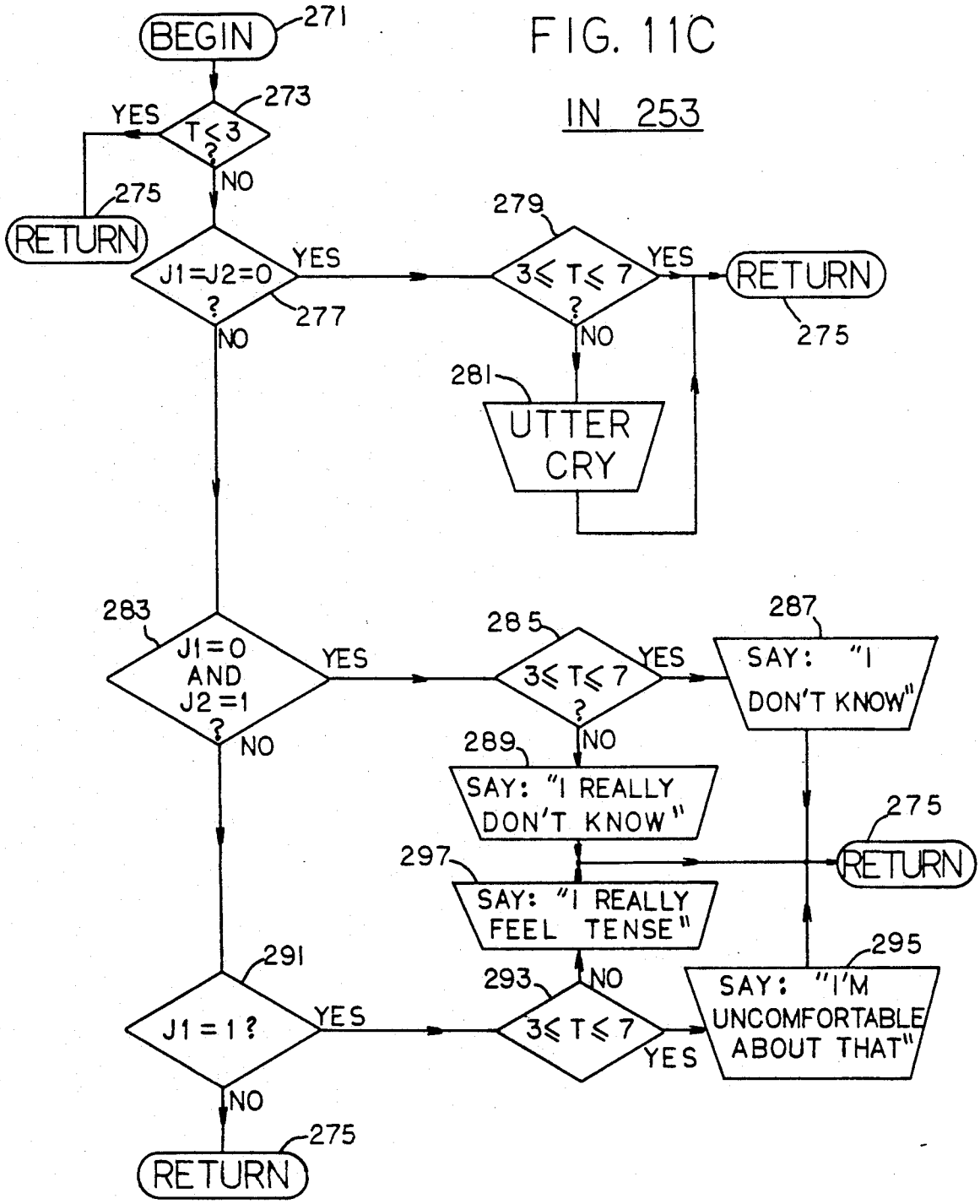
FIG. 11C is a further detail of a step in FIG. 11B for determining an utterance for an emotion depending on doll identity.

In FIG. 11C only the operations in step 253 of FIG. 11B for saying tension emotion words are shown, since the rest of the operations can be straightforwardly programmed from Table V. Operations in FIG. 11C commence with a BEGIN 271 and proceed to test whether tension T is less than 3, in a step 273. If so, tension is not significant, and a RETURN 275 is reached.

TABLE V

| Emotion | Utterance |
|---|---|
| Tension | (Depends on maturity and magnitude; see FIG. 11C.) |
| Like L12 3 to 7 | "I like you" |
| Like L12 8 to 10 | "I love you" |
| Dislike L12 −7 to −3 | "I don't like that" |
| Dislike L12 −10 to −8 | "I really don't like that" |
| Self-esteem P 3 or more | "I'm doing a good thing" |
| Self-esteem P −3 or less | "I shouldn't be doing this" |
| Hope H 3 or more | "I hope" |
| Fear F 3 or more | "I am afraid" |
| Glad B 3 to 7 | "I'm glad" |
| Glad B 8 to 10 | "I'm really glad" |
| Sad B −7 to −3 | "I feel sad" |
| Sad B −10 to −8 | "I feel awful" |
| Surprise SRP 3 or more | "Wow" |
| Boredom BDM 3 or more | "I'm bored" |

(Emotions having insignificant levels of less than 3 cause no utterance in the present embodiment. It is emphasized that other embodiments can use different emotional ranges, more or fewer ranges, and different utterances as appropriate.)

If not, tension is significant, and a test 277 determines whether jumpers J1 and J2 (Table I) are both zero. If so, the doll 1 is a baby and operations proceed to a step 279 to test whether T is in the range 3 to 7. If so, no utterance occurs and RETURN 275 is reached. If not, T must exceed 7 and a branch is made to a step 281 to utter a baby crying sound whence RETURN 275 is reached.

If in step 277, J1 and J2 are not both zero because the doll is not a baby, operations proceed to a step 283 to test whether J1=0 and J2=1 indicating that the doll is an older child. If so, a branch is made to a step 285 and if T is in the range 3 to 7, the doll says "I don't know" in a step 287 whence RETURN 275 is reached. If T exceeds 7 in step 285 a branch is made therefrom to a step 289 and the doll says "I really don't know" whence RETURN 275 is reached.

If in step 283 the test is not met, the doll is an adult, and operations proceed to test whether J1 is one in a step 291. If not, RETURN 275 is reached. If so, a test 293 determines whether T is in the range 3 to 7. If so, the doll says "I'm uncomfortable about that" whence after 295 RETURN 275 occurs. If not, a branch is made from step 293 to a step 297 because T exceeds 7 and the doll says "I really feel tense" whence RETURN 275 occurs.

As shown in FIG. 11C microprocessor circuit 75 acts as a circuit example for computing a tension emotion and causing the generating circuit (e.g. 77) to also generate an utterance representing the tension emotion. The apparatus includes means for supplying an identification code (e.g. jumpers) and the utterance represents the tension emotion depending on the identification code. Also, microprocessor circuit 75 also thus causes the generating circuit to generate different utterances to represent the same emotion depending on the identification code established.

Referring again to FIGS. 11A and 11B some general remarks can be made. Circuit 75 in the steps including step 223 of FIG. 11B acts as an example of a circuit connected to a sensing circuit (e.g. 71) for changing the subject code in the first-named apparatus (e.g. assembly 13 of doll 1 in response to the sensed subject code (e.g. SCR). In step 257 circuit 75 acts to change the utterance index when each utterance is generated to progress through the set of utterances indicated by the subject code. Sensed loudness R can change the dolls decision so that DC=1 and steps like 223 and 231 make circuit 75 change the subject code S as a function of the loudness, in the manner of a step function. Step 253 makes circuit 75 act as an example of means for producing an additional utterance representing the emotion computed. As discussed in connection with FIG. 6B and FIG. 11B step 255, circuit 75 also selects one of a plurality of collections of the sets of utterances depending on the identification code for the apparatus (e.g. DSIC), the subject code determining one of the sets of utterances within the selected collection of sets (or collection of conversation tables). Circuit also selects the proper conversation table based on the identification code for the additional apparatus (e.g. ODIC).

In FIG. 11A the operations including steps 211 and 213 make circuit 75 an example of a circuit that compares the identification code of the additional apparatus with an identification code of the first-named apparatus (e.g. DSIC) and determines the utterance index as a function of the identification codes. In FIG. 11B, the steps including steps 251 and 253 cause utterance generating circuit 77 to generate an utterance representing an emotion computed only when the emotion has changed in value.

Now that the manner of using decision change and emotion information in causing various utterances has been described in connection with FIGS. 11A and 11B, it is useful next to describe how microprocessor circuit 75 derives the decisions and emotions.

Figure 12:
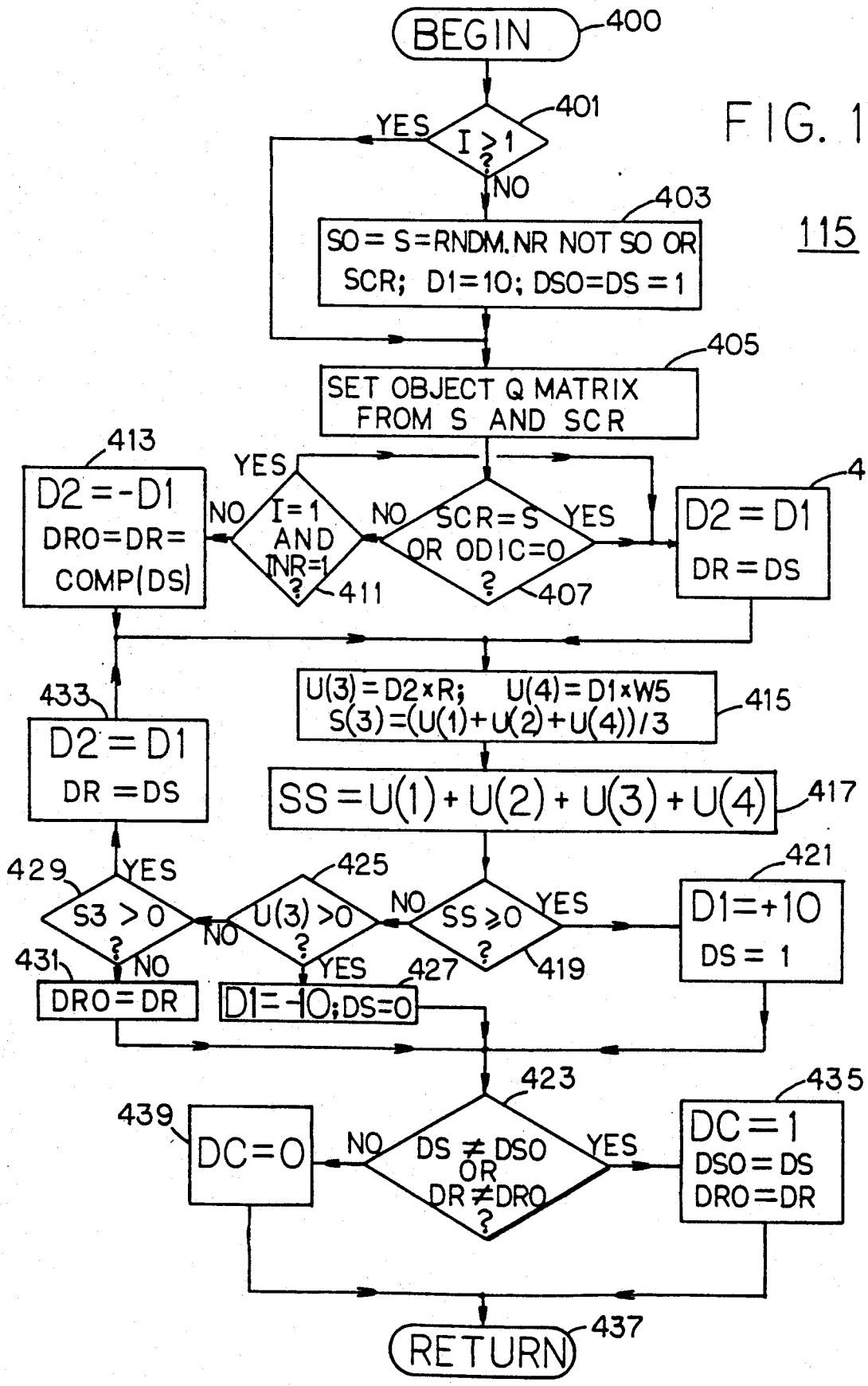
FIG. 12 is a further detailed flow diagram of operations for establishing a subject and computing decisions imputed to each doll, detailing a step of FIG. 5.

In FIG. 12 a detailed flowchart of step 115 of FIG. 5 for the decisions is shown. Operations commence with a BEGIN 400 and proceed to test index I in a step 401. If I is not greater than one, subject code S is in a step 403 set to a random number in the range 1–15 exclusive of the previous subject SO and the received subject code SCR. Decision value Dl is initialized to 10. Previous subject SO is set equal to the new value of subject code S, and self decision value DS and past decision value DSO are both set to 1 whence a step 405 is reached. If in step 401, index I exceeds one, operations branch directly to step 405.

In step 405 an object Q matrix is established. The Q matrix is a 2×2 matrix which depends on the decisions of the doll 1 and the doll 2, which decisions are regarded as taking on one of two values DS and DR. In other words, DS is a zero or 1 at any given time. DR is a zero or a one at any given time. There are four possible corresponding states. There are four entries in the Q matrix which relates the decisions to the presence or absence of the object of desire to which the decisions relate. Each Q matrix entry is a +1 or −1. Since the Q matrix has four entries, there are 2-to-the-4th power, or 16, possible Q matrices. In general, the Q matrix to be used depends on the subjects S and SCR. For simplicity in the preferred embodiment a Q matrix is arbitrarily but carefully selected as shown in Table VI.

TABLE VI

| Q MATRIX | | | |
|---|---|---|---|
| | | Decision DR Imputed to Doll 2 | |
| | | 1 | 0 |
| Decision | 1 | 1 | −1 |

TABLE VI-continued

| | Q MATRIX Decision DR Imputed to Doll 2 | | |
|---|---|---|---|
| | | 1 | 0 |
| DS Imputed to Doll 1 | 0 | −1 | −1 |

The meaning of the Table VI Q matrix is that if dolls 1 and 2 have agreeing decisions DS=DR=1 they will obtain the object (1 in upper left corner of matrix). However, if the dolls have any other combination of decisions, then they will not obtain the object (−1 in other three cells of matrix). If the Q matrix had all +1 entries, the dolls would obtain the object regardless of their decisions. In FIG. 12 step 405 the Q matrix is either set to various constant entries as in Table VI or set depending on subject codes S and SCR in a more general solution.

After step 405, a decision step 407 tests whether either the subject codes S and SCR are the same or ODIC is zero (no other doll present). If either condition is true, operations proceed to a step 409 where the decision imputed to the other doll is set equal to the decision imputed to the doll 1. D2 is the decision of other doll which can be either +10 or −10. DR represents the same decision of other doll on a logic basis of 1 or 0 corresponding to +10 or −10 respectively. In step 409 D2 is set equal to Dl and DR is set equal to DS.

Dl is the decision of doll 1 on a +10, −10 basis and DS is the same decision of doll 1 on a 1,0 logic basis.

If SCR is different from S and ODIC is not zero in step 407, then a branch is made to a step 411 to test whether both index I is one and doll 1 is an initiator (INR=1). If so, operations go to step 409. If not, operations proceed to a step 413 to set decision imputed to other doll, D2=-D1. If D1 is +10, D2 is made −10. Logic decision DR and previous decision DRO are both set to the logical complement of DS. If DS is 1, DR and DRO are set to zero, for example.

After either step 409 and step 413, operations proceed to a step 415 where decisional influences U are calculated. A decisional influence U(3) imputed to the other doll is calculated as the product of decision D2 times loudness R. A decisional inertia influence U(4) is the product of decision D1 times weight W5. A total internal decisional influence S3 is calculated as the average of U(4) and two decisional influence levels U(1) and U(2) derived from the heart dial 19 in step 113 of FIG. 5. S3=(U(1)+U(2)+U(4))/3. Next, a combined total of the decisional influences SS is calculated by summing all four U values, in step 417.

Then in a step 419 the combined total SS is tested to determine whether it is zero or greater. If so, the decision imputed to doll 1 itself is established as D1=+10 and DS=1 in a step 421, whence a step 423 is reached. Otherwise, a branch is made from step 419 to a step 425 where influence of other doll U(3) is tested for positiveness. If positive, then decision values D1 and DS are set to −10 and zero in step 427 respectively, whence step 423 is reached. If not positive in step 425 then operations proceed to test S3 for positiveness in a step 429. If not positive, then past decision other doll DRO is set equal to DR whence step 423 is reached. If S3 is positive in step 429, then the decision imputed to the other doll is the same as the decision of doll 1 in step 433 and D2 is set equal to D1 and DR is set equal to DS, whence operations return to step 415.

The significance of the steps so far described in FIG. 12 is better understood by considering some examples. First, assume that dolls 1 and 2 are on the same subject. Their decisions D1 and D2 are the same +10. Second, assume that dolls 1 and 2 are on different subjects and step 413 is reached where D1=+10 and D2=−10. If doll 2 loudness R is not great, the imputed decisions are established. If doll 2 loudness R is great enough to get SS negative, operations proceed through steps 425, 429 and 433 to set the decisions the same. This is done because doll 2 has influenced doll 1 to agree with it, producing a decision change and D1 and D2 are imputed to be +10. In a third case, assume that the heart dial is down, not up, making S3 negative, not positive. Then step 429 branches to step 431 which leaves the dolls in disagreement and cancels any decision change that might have occurred by forcing DRO to equal DR. In a fourth case, assume the heart dial is down, making S3 negative but the dolls are on the same subject S=SCR so that D1=D2 initially. The influence of other doll U(3) is positive but the internal influence S3 due to the heart dial is overwhelming. Step 427 is reached and the doll 1 self decision D1 is changed to be negative while other doll decision D2 is positive. The decision change ultimately causes doll 1 to disagree with doll 2 by jumping to another subject S not the same as SCR, see FIG. 11A step 231. It should be clear that this complex and important decision logic of FIG. 12 accommodates many interesting examples and this description cannot be exhaustive.

In step 423 of FIG. 12 a test is made to determine whether either DS does not equal DSO or DR does not equal DRO. If so, a decision change has occurred and operations proceed to a step 435 to set Decision Change flag DC to one, and to set DSO=DS and DRO=DR initializing for a future pass through FIG. 12, whence a RETURN 437 is reached. If the test in step 423 is not met then no decision change has occurred and DC is set to zero in a step 439 whence RETURN 437 is reached.

Based on FIG. 12 it is observed that by the steps such as step 403, microprocessor circuit 75 is an example of a circuit that subsequently changes the subject code at random initially and after a set of utterances indicated by the subject code has been completed and the utterance index is reset. Because circuit 75 in steps 415–419 can change its decision as a function of loudness R, it is also caused to change the subject code S, as a function of the loudness. It can also change the subject code S as a function of the electrical level from the heart dial and variable resistor 17 by virtue of steps such as 415 to 419 influencing the decision.

The operations of FIG. 12 also constitute circuit 75 as an example of a circuit for sensing a subject code of additional apparatus (e.g. SCR in doll 2) and comparing the subject codes of the first-named and additional apparatus (e.g. dolls 1 and 2) and for producing one of two decision values representing a decision imputed to the additional apparatus depending on whether or not the subject codes are the same (see e.g. steps 407–413), for establishing levels of decisional influence for the first named apparatus and for producing one of two decision values representing a decision imputed to the first-named apparatus depending on whether a combined total of the levels of decisional influence exceeds a predetermined level.

Circuit 75 also is an example of a circuit that produces one of two decision values representing a decision imputed to the additional apparatus (e.g. doll 2), establishes a first level of decisional influence as a function of the imputed decision value and the loudness, and a second level of decisional influence, and modifies the imputed decision value (e.g. steps including step 433) as a function of the first and second levels of decisional influence. The various U values of step 415 represent aiding influences if the values are of the same sign and represent opposing influences if they are of opposite sign, positive and negative.

Figure 13:
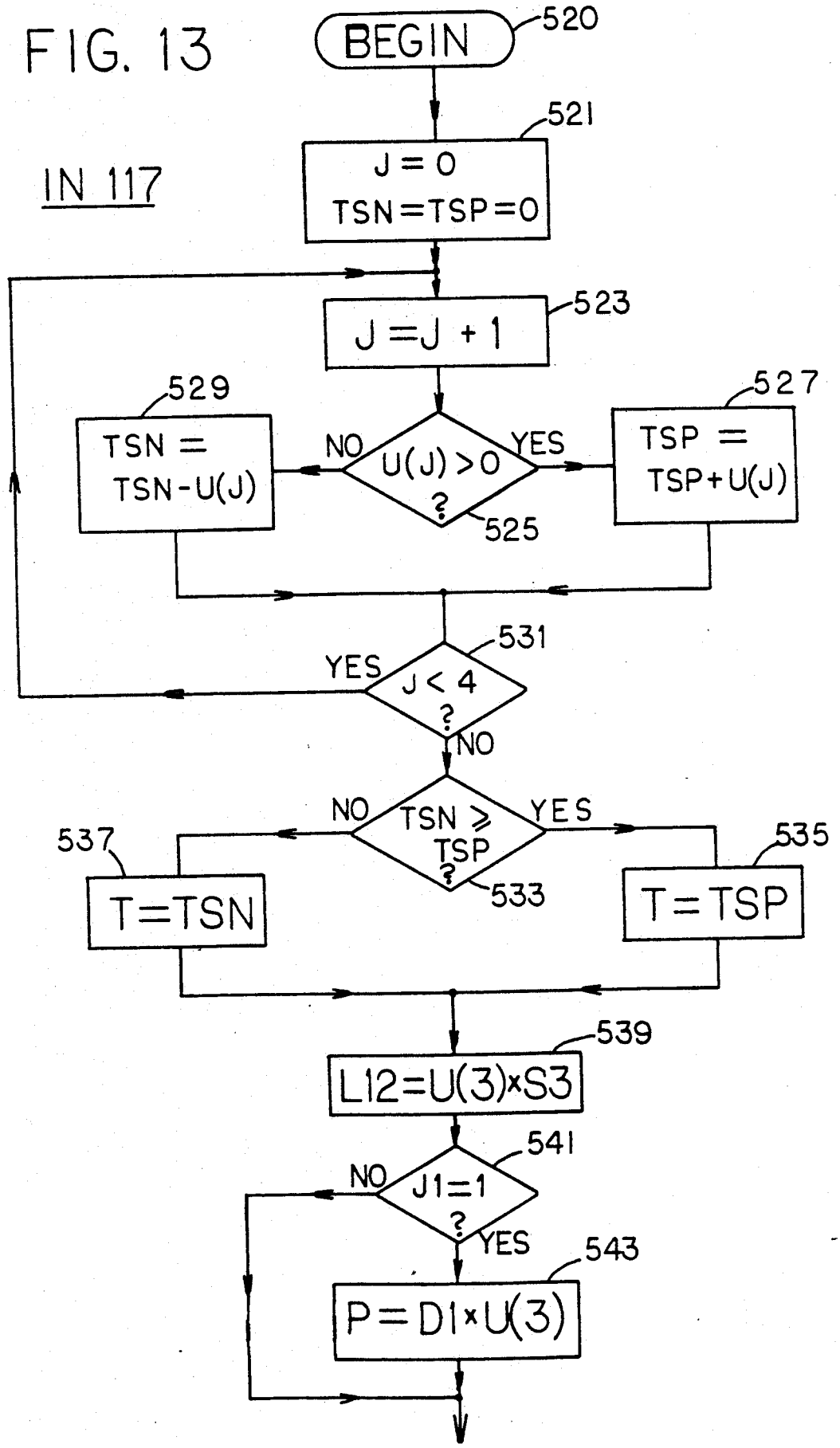
FIGS. 13, 14 and 15 are three parts of a detailed flow diagram of FIG. 5 operations for computing emotions.
Figure 14:
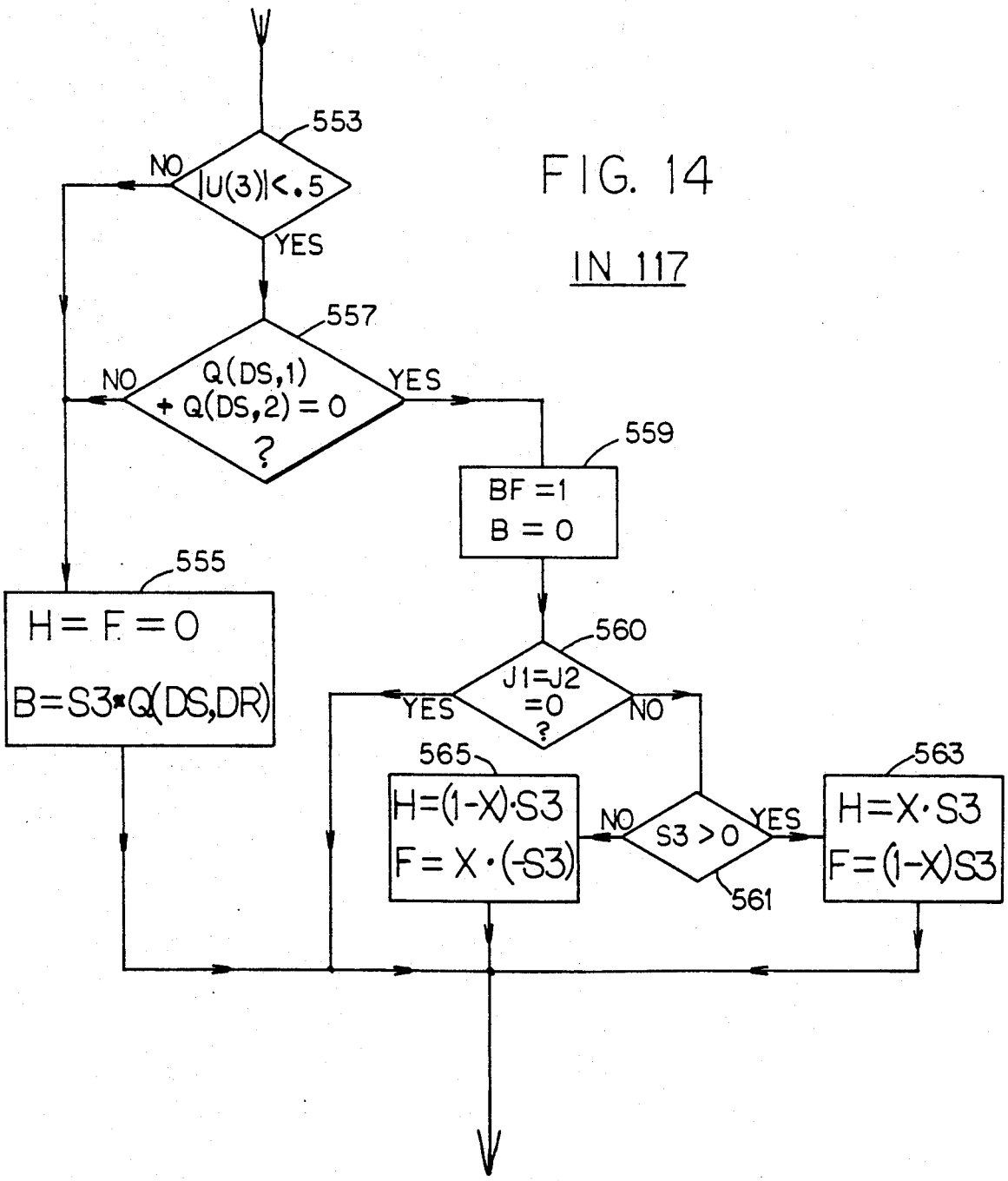
Figure 15:
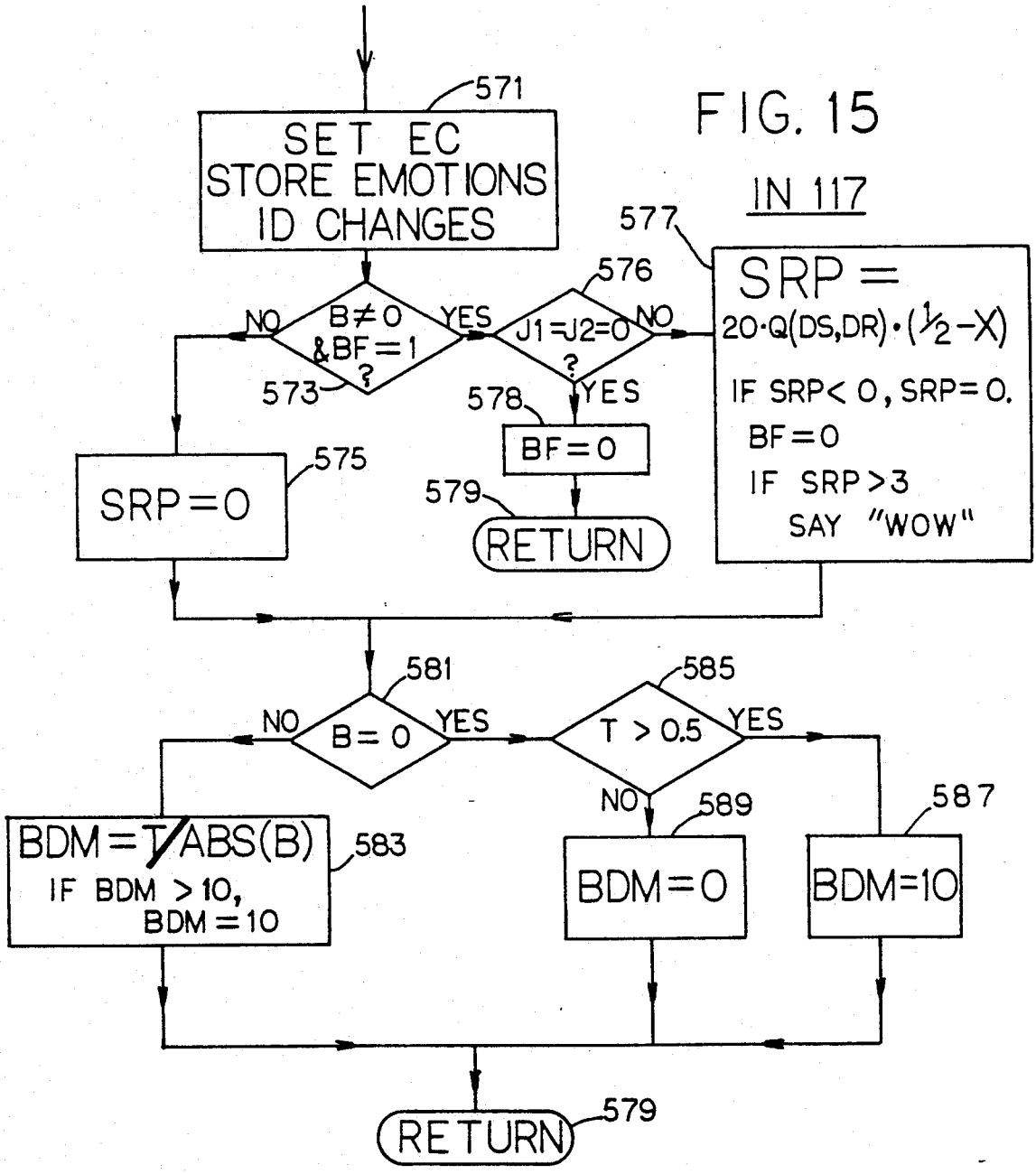

In FIG. 5 the emotion computing step 117 is detailed by the flowcharts of FIGS. 13, 14 and 15.

In FIG. 13 operations commence with a BEGIN 520 and proceed to set a count J to zero as well as variables TSN=TSP=0 in a step 521. Next in a step 523 J is incremented by one and decisional influence U(J) is tested in a step 525. If U(J) is positive operations proceed to a step 527 where TSP has the decisional influence value U(J) added to it whence a step 531 is reached. If U(J) is not positive in step 525 a branch is made to a step 529 where TSN has U(J) subtracted from it, whence step 531 is reached. In step 531 the count J is tested. If less than 4, then a loop is made back to step 523 until a sum of the magnitudes of the positive decisional influences is achieved in TSP and a sum of the magnitudes of the negative decisional influences (if any) is achieved in TSN. When J reaches four at step 531 operations proceed to a step 533 where TSP is compared with TSN. If TSN equals or exceeds TSP, then tension emotion T is set equal to TSP in a step 535. If TSN is less than TSP, a branch is made from step 533 to a step 537 where tension emotion T is set equal to TSN. In this way tension is computed as the sum of the magnitudes of decisional influences which did not prevail in determining D1, the doll 1 decision. If there are no opposing decisional influences, tension is zero.

Operations go from each of steps 535 and 537 to a step 539 where Like-Dislike emotion L12, the feeling of doll 1 toward doll 2, is computed as the product of the decisional influence U(3) of doll 2 on doll 1 multiplied by the average inner decisional influence S3 (cf. step 415 of FIG. 12).

After step 539, a step 541 tests jumper J1. If J1=1, the doll is an adult and Self-Esteem P is computed as the product of doll 1 decision D1 times decisional influence U(3) of doll 2 on doll 1, in a step 543 whence operations go to a step 553 of FIG. 14. If J1 is not 1 in step 541 of FIG. 13, the doll is not an adult and operations branch directly from step 541 to step 553 of FIG. 14 in this embodiment.

Because decisional influence U(3) is related to loudness R, and the decision imputed to other doll D2 which in turn is a function of the subject code sensed SCR, microprocessor 75 circuit in executing the steps of FIG. 13 acts as a means for computing an emotion repeatedly as a function of the loudness and the subject code sensed.

In FIG. 14 operations in step 553 to determine whether decisional influence U(3) has an insignificant magnitude wherein U(3) is in the range −0.5 to +0.5. If not, the magnitude is significant and operations proceed to a step 555 in which hope H and fear F are both set to zero and Glad-Sad Feelings B is computed. Glad-Sad Feelings B is regarded as the product of the Q matrix entry for the decisions DS and DR imputed to the two dolls in FIG. 12 multiplied by the decisional influence sum S3. Put another way, feelings B are glad when the product is positive, meaning that the object obtained is the same in sign as the decisional influences for it. Feelings B are said when the product is negative, meaning that the decisional influences did not obtain their object. The magnitude of feelings B is greater when the decisional influence sum S3 is greater, i.e. the more doll 1 wants something the stronger it feels to get it or to be deprived of it.

In FIG. 14 when decisional influence U(3) is insignificant in step 553, operations go to a step 557 to test whether the sum of the Q matrix entries, in the row defined by the particular value of DS at the time, is zero. If not, this means that the decision DR of the other doll is immaterial to whether the object is obtained, and a branch is made to step 555. Hope and fear are set to zero and feelings B is computed in step 555 in such case because there is no uncertainty about whether the object will be obtained and thus there is no occasion for hope or fear.

On the other hand, if the Q matrix entries of step 557 do sum to zero, then one entry is +1 and the other is minus one in the DS row. This means that the value of DR, the decision of the other doll, will determine whether or not the object is obtained. (Such is the case only if DS=1 in Table VI Q matrix) In such case operations proceed from to step 557 to a step 559 to set Glad-Sad Feelings B to zero and set a flag BF to one, because there is no occasion for gladness or sadness until doll 1 knows whether the object is obtained. Next, in a step 560 a test is made to determine whether jumpers J1=J2=0 indicating that doll 1 is a baby. If not, hope and fear emotions are computed by proceeding to a step 561 to test whether the inner decisional influence sum S3 is positive, and if so, going on to a step 563 to compute hope H as the product of expectation X times sum S3 and fear H as sum S3 times the difference between X and unity. The concept is that expectation is the subjective probability that the object of a positive desire sum will be obtained. If the desire sum is negative for S3, then the subjective probability that the +1 object will be obtained is 1-X as a matter of probability. Hope is proportional to desire or decisional influence sum S3 discounted by the subjective probability of obtaining the object. Fear is also proportional to sum S3 but is discounted by the subjective probability of not obtaining the object. Accordingly, if sum S3 is not positive in step 561 operations branch to a step 565 to compute hope H as sum S3 times the difference between unity and expectation X and compute fear F as the negative of S3 times expectation X.

Upon completion of any of steps 563 and 565, or if doll 1 is a baby in step 560, operations next go to a step 571 in FIG. 15. In step 571, the Emotion Change flag EC is set to one if any of the emotions computed in FIG. 14 have changed. The computed emotions are stored in a table identifying which ones have changed. In this way the appropriate emotion words can be uttered by doll 1 when operations later reach step 253 of FIG. 11B. In the meantime, however, operations go from step 571 of FIG. 15 to a decision step 573 to test whether it is both true that Glad-Sad feelings B is not zero and also that flag BF is set to one. If the test is not met, a branch is made to a step 575 that sets Surprise emotion SRP to zero because there is no occasion for surprise either because uncertainty remains or surprise is already in the past and no longer exists.

If the test of step 573 is met, operations proceed to step 576 to test whether J1=J2=0 (baby) and if not a baby proceed to compute the Surprise emotion in a step 577. In step 577 the Surprise emotion is evaluated as 20 times the Q matrix entry for decisions DS and DR, times the difference between one-half and expectation X. If SRP so computed is negative then SRP is set to zero since surprise is not negative, in this embodiment. The concept behind the computation is that if expectation X is one-half, doll 1 regards the occurrence of object +1 and object 31 1 as equally likely and there is no surprise. However, if object +1 occurs that doll 1 did not expect (X less than half), there is surprise. Or if object −1 occurs when doll 1 expected +1 (X greater than half), there is also surprise. Operations continue in step 577 to set flag BF back to zero now that surprise has occurred. If the level of surprise is significant, e.g. SRP greater than 3, then microprocessor 75 causes circuit 77 to say "Wow". Other utterances for various levels of surprise can be programmed in step 577 as suits the application.

If the test of 576 is met wherein doll 1 is a baby, operations branch therefrom to a step 578 to reset the flag BF to zero whence a RETURN 579 is reached. In this way if doll 1 is a baby the computations of surprise and boredom emotions are bypassed. If operations have reached either step 575 or 577, however, they then proceed to a step 581 to test if Glad-Sad Feelings B is zero, and if not, compute a boredom emotion BDM. in a step 583. The concept of boredom herein is that boredom occurs when there is significant emotional tension between opposing decisional influences but Glad or Sad Feelings are lacking. Boredom occurs, for instance, when doll 1 is close to changing its mind to do something else on a different subject.

In step 583 this boredom concept is implemented by computing the ratio of tension T to the magnitude of feelings B. If the ratio exceeds 10, Boredom is set to 10 (ten). whence RETURN 579 is reached. To avoid computing a ratio with a zero denominator for B, operations branch from test 581 when B=0 to a test 585. If tension T is significant, e.g. greater than 0.5, in test 585, BDM is set to its maximum value ten in a step 587 whence RETURN 579 is reached. On the other hand, if tension T is insignificant in test 585, there is a state of apathy and a branch is made to set boredom BDM to zero in a step 589 whence RETURN 579 is reached.

This completes the description of the emotion computations of the preferred embodiment in FIGS. 13–15. It is to be understood that the emotion computations and operations can be refined or varied to accommodate the latest psychological understandings in this area and other emotions can be added as the application requires. Microcomputer circuit 75 thus constitutes an example of a circuit for computing an emotion repeatedly as a function of loudness, and for repeatedly computing emotions the presence or absence of which depends on the identification code (e.g. jumpers or DSIC) for the apparatus. In respect of emotions like Glad-Sad Feelings B and Surprise SRP (see steps 555 and 577), for example, microprocessor circuit 75 repeatedly produces one of two decision values representing a decision imputed to the additional apparatus (e.g. doll 2) and repeatedly produces one of two decision values representing a decision imputed to the first-named apparatus (e.g. doll 1) and repeatedly computes emotions as a function of each said one of the decision values imputed to the first-named and additional apparatus. As to boredom, which involves all the decisional influences in this embodiment, microprocessor circuit 75 acts as a means for establishing a decisional influence level and computing a boredom emotion as a function of the decisional influence level and the loudness sensed. Put another way, circuit 75 establishes levels of decisional influence representing aiding or opposing influences and computes a boredom emotion which represents significant boredom when the levels of the decisional influence represent opposing influences in approximate balance.

In regard to Like-Dislike L12, for example, circuit 75 is an example of a circuit that establishes levels of decisional influence representing aiding or opposing influences one of which (e.g. U(3)) is imputed to the additional apparatus, and computes a like-dislike emotion as a function of the magnitudes of the levels of decisional influence and representing a like emotion when the levels represent aiding influences and a dislike emotion when the levels represent opposing influences. In regard to Self-Esteem emotion P, circuit 75 computes self-esteem as a function of the level of the decisional influence imputed to the additional apparatus which represents a significant self-esteem when a combined total of the decisional influence levels is aiding in sense to the imputed influence. Circuit 75 computes a tension emotion of significant magnitude as a function of the levels of decisional influence when they are in opposing sense. Circuit 75 also computes a glad-said emotion as a function of a decisional influence level and determines a glad or sad character of the emotion as a function of the decisions imputed to the first-named and additional apparatus.

Figure 16:
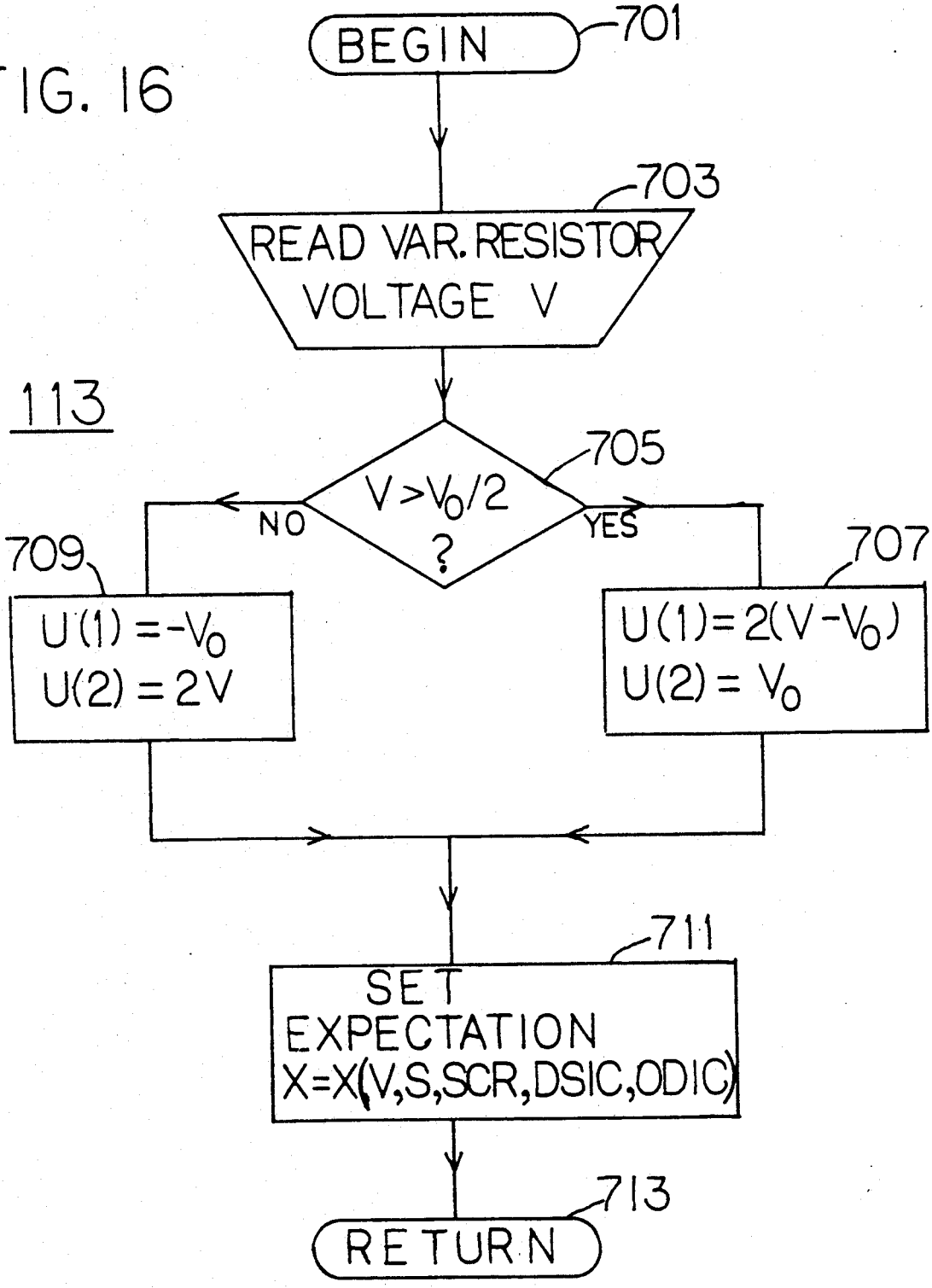
FIG. 16 is a further detailed flow diagram of operations of FIG. 5 for interpreting the orientation of a heart dial.

In FIG. 16 the operations in step 113 of FIG. 5 commence with a BEGIN 701 and proceed to read in a voltage V from variable resistor 17 by successive approximations analog to digital conversion in a step 703. Next in a step 705 variable voltage V is compared with half the maximum voltage Vo. (The maximum voltage is that voltage attained by the wiper of the variable resistor when the heart dial is up in the normal valentine position. The minimum voltage assumed by voltage V is zero when the heart dial is down with heart upside-down.)

If in step 705 the heart dial is in the upper part of its travel, voltage V exceeds half Vo and a step 707 sets decisional influence U(1) to twice the difference between voltage V and maximum voltage Vo. U(1) is thus negative except when it is zero with heart dial up. Decisional influence U(2) is set equal to Vo, which is positive.

In step 705 when the heart dial is in the lower part of its travel, a branch is made to a step 709 where decisional influence U(1) is set to the negative of Vo and U(2) is set to twice the voltage V, which is always positive in this embodiment.

Operations proceed from either step 707 or step 709 to a step 711 to establish a level of expectation X as a function of relevant variables V, subject code S and SCR, and identifications DSIC and ODIC, whence a RETURN 713 is reached.

Figure 17:
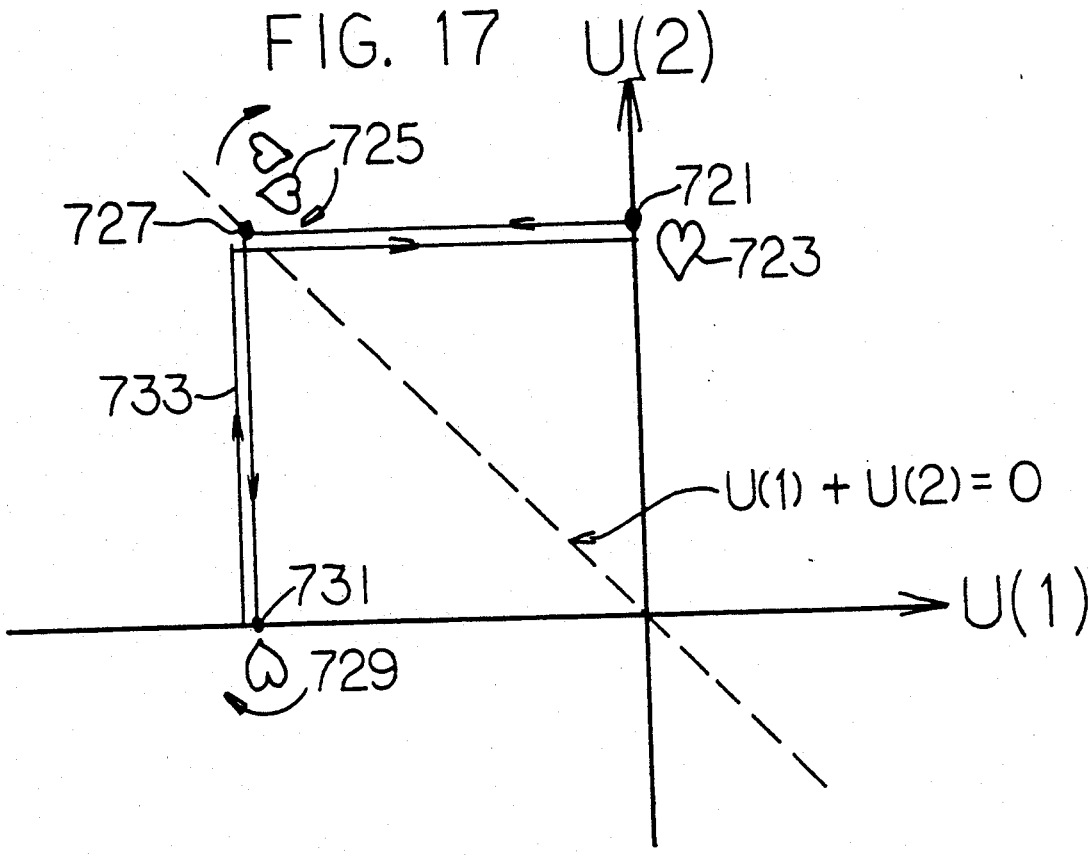
FIG. 17 is a diagram of a path traversed by the heart dial in a mathematical decisional influence space having coordinate axes corresponding to different decisional influences.

FIG. 17 is used to explain the concept behind steps 707 and 709. Since a multitude of dials is not preferable in a doll application, although within the contemplation of the invention nevertheless, heart dial 19 is made to perform multiple functions. Heart dial 19 is regarded as tracing out a path in a multidimensional decisional influence space defined, for instance, by two axes for U(1) and U(2). When the heart dial 19 is up, point 721 is established in the space corresponding to mnemonic heart symbol 723. As the heart dial is turned to orientation 725, the decisional influence point moves to position 727. In this embodiment, the decisional influences are the ordinate and abscissa coordinate values of the influence point established by the heart dial. As the heart dial is moved to orientation 729, the influence point moves down to position 731. The heart dial is turnable without end stops either clockwise or counterclockwise. As the dial is turned from down orientation 729 back to orientation 723, the influence point moves back in direction 733 to position 727 and then returns to position 721.

Figure 18:
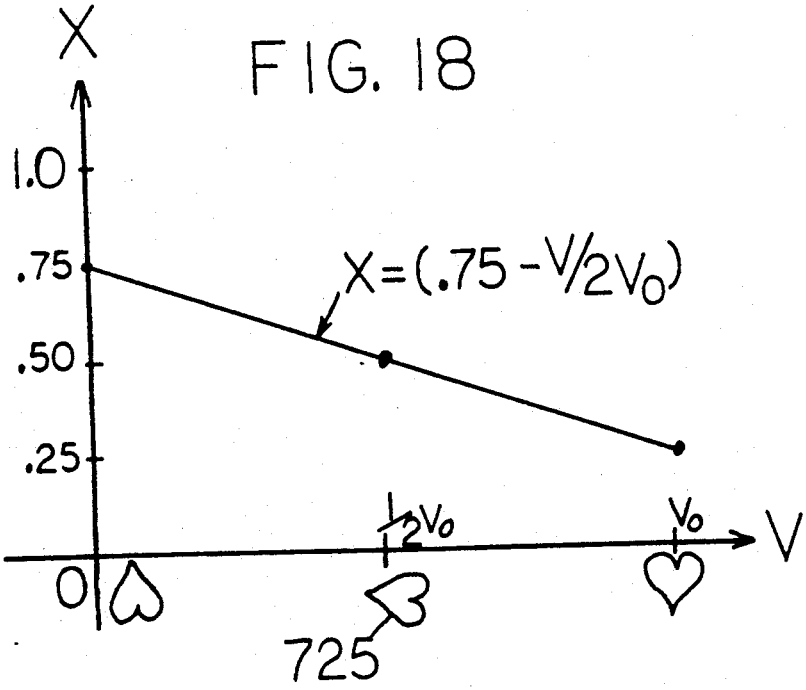
FIG. 18 is a diagram of expectation functionally related in value to a voltage generated from the orientation of the heart dial.

FIG. 18 shows a simple function for computation in step 711 for setting expectation X as a function of variable voltage V alone, wherein $X=0.75-V/2Vo$. When the heart dial 19 is up, voltage $V=Vo$ and expectation is 0.25. As the heart dial 19 is moved to the down position where voltage $V=0$, expectation X progressively rises to a value of 0.75. When heart dial 19 is pointing sideways in orientation 725, expectation X is 0.5, a point of no-surprise. Orientation 725 in FIG. 17 also corresponds to a point of opposing influences in approximate balance (other influences neglected for purposes of example) where significant boredom is likely to occur. In this way, the orientation of the heart dial affects the personality and activity of the doll.

Figure 22:
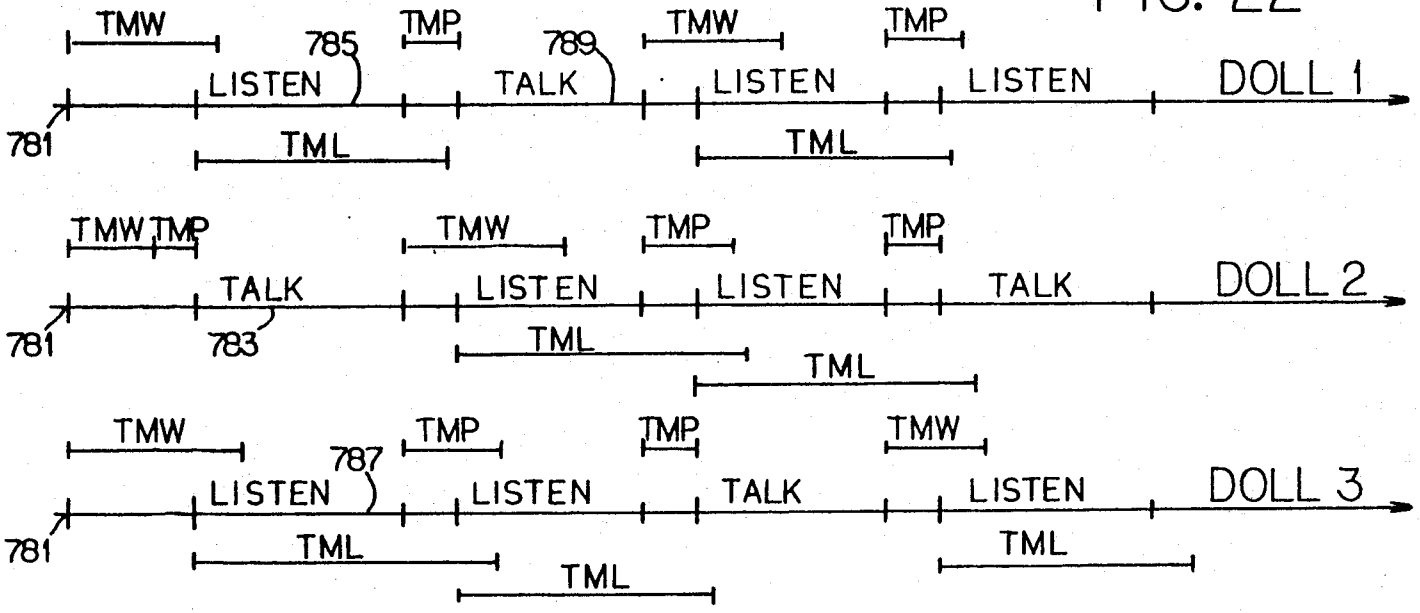
FIG. 22 is a set of three related linear time diagrams showing operations of three dolls of the invention operating in alternating conversational fashion.
Figure 23:
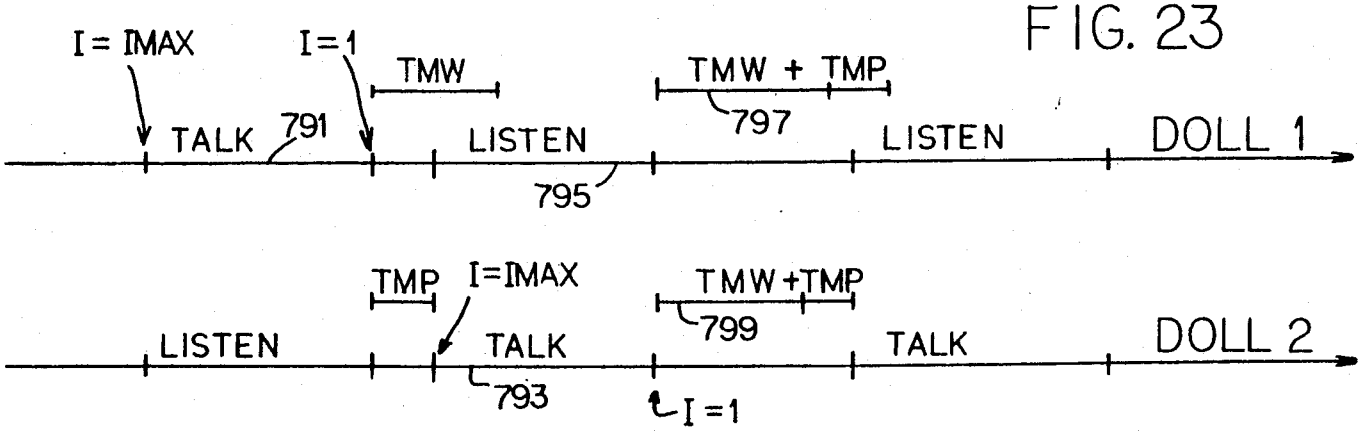
FIG. 23 is a pair of related linear time diagrams showing operations of a pair of the dolls changing a subject code with appropriate pause.
Figure 24:
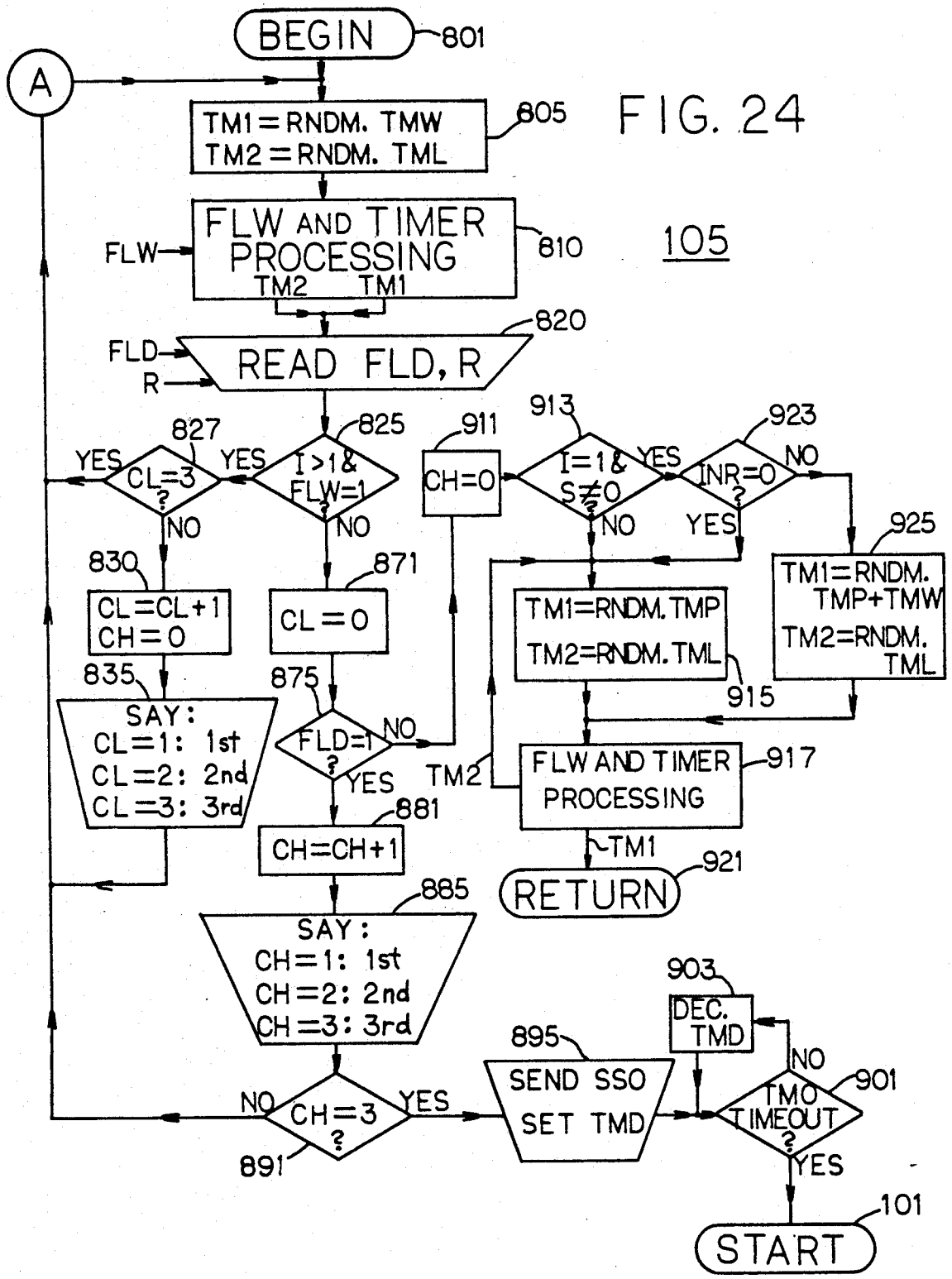
FIG. 24 is a further detailed flow diagram of FIG. 5 operations for voice input, responses when too loud or too quiet and for producing alternating conversational operation.

FIGS. 19–23 are used to describe various desirable operations of the dolls over time which are implemented in step 105 of FIG. 5 and shown in detail in FIG. 24.

Figure 19:
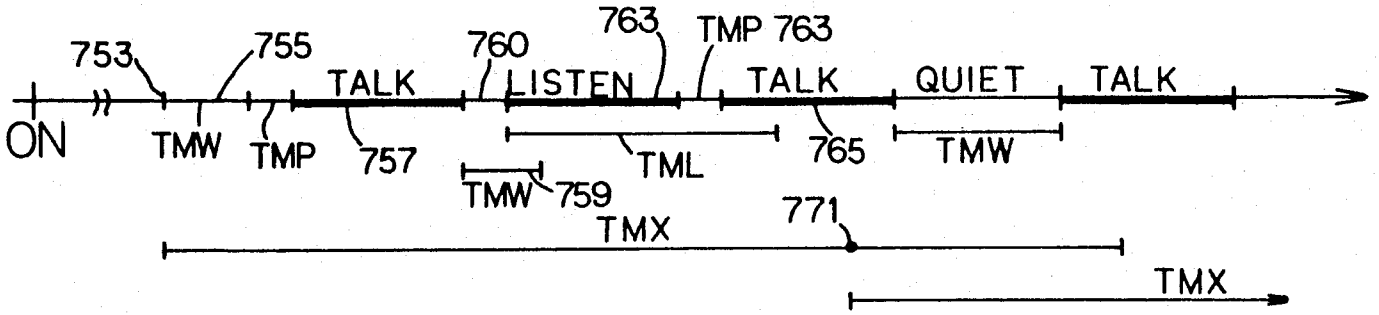
FIG. 19 is a linear time diagram of operations of a doll of the invention in normal conversation.

In FIG. 19 doll 1 is activated when turned ON. When doll 1 is moved at time 753 a waiting period TMW occurs followed by another shorter waiting period or pause TMP. If doll 1 hears nothing above its threshold during TMW and TMP, it begins TALK 757, according to operations to talk already discussed at length hereinabove. When TALK 757 is completed, doll 1 again listens in the established waiting period TMW, marked 759. If sound above threshold occurs, however, the period is terminated after shorter interval 760 whereupon the doll 1 monitors the loudness of the sound in a listening period 761 LISTEN. As soon as doll 1 begins listening to above-threshold loudness it sets a time period TML running to set an upper limit on the length of time it will listen. In FIG. 19 the loudness disappears before TML times out, whereupon pause time TMP is executed before doll 1 begins its own TALK 765. After TALK 765, a normal alternation of conversation usually occurs. However, assume for example that doll 2 is removed or the child leaves doll 1. Then in FIG. 19 a QUIET interval consumes all of wait time TMW whereupon doll 1 makes an utterance indicative of the too-quiet condition in order to elicit more play, if possible. Also shown in FIG. 19 is a time interval of activation by hardware in power circuit 81. This maximum time interval TMX commences with motion 753 and will expire eventually unless it is restarted by occurrence of a motion 771.

Figure 20:
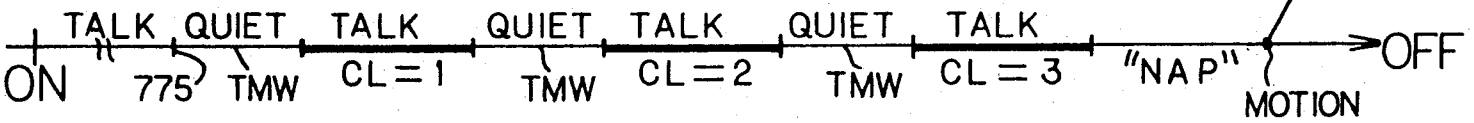
FIG. 20 is a linear time diagram of operations of the doll when the surroundings are too quiet.

In FIG. 20 a series of preferable operations in response to a too-quiet condition are shown. Suppose that after a motion 775 doll 1 is left alone in a quiet room. Wait time TMW expires, and doll 1 sets a counter CL to 1 and says "Please talk louder to me." Nothing happens and TMW expires again. Counter CL is incremented to 2 and doll 1 says "I'm lonely. Please talk to me." Nothing happens and TMW expires again. Counter CL is incremented to 3 and doll 1 says "I will take a nap." TMW expires again, doll 1 senses that counter CL has reached 3 and goes into a loop in which no more utterances occur unless there is an occurrence of sound. Doll 1 will deactivate unless there is motion before TMX expires.

Figure 21:
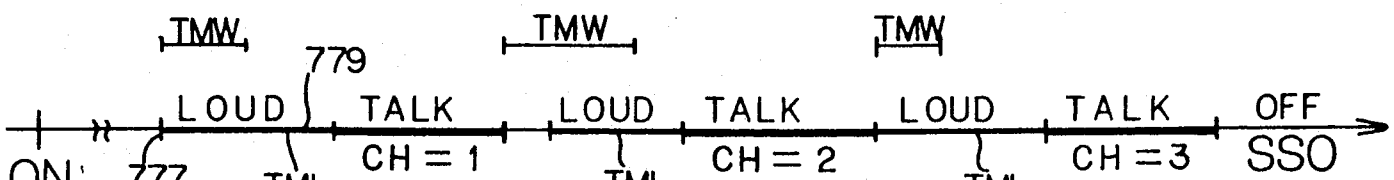
FIG. 21 is a linear time diagram of operations of the doll when the surroundings are too noisy.

In FIG. 21 a series of preferable operations to respond to too-loud conditions are shown. Assume that after a motion 777 an excessive loudness occurs within wait time TMW and that loudness 779 consumes part or all of listening time TML. Doll 1 immediately without pause sets a counter CH to 1 and says "More softly, please". The excessive loudness or mishandling again occurs. Immediately, CH is set to 2 and doll 1 says "I will stop talking." The excessive loudness again occurs. CH is set to 3 and doll 1 says "I stopped talking." The excessive loudness, whether or not still present, is thereupon faced with self shut off by doll 1 which is an immediate hardware deactivation by power control circuit 81 and cannot be overcome during a predetermined time period of shut off by either loudness or motion.

FIG. 22 shows how doll 1 accommodates the complexities of conversation with two or more other dolls in the vicinity. Times TMW and TMP are advantageously set randomly with a constraint that the random values. are confined to ranges bracketing longer and shorter average TMW and TMP times respectively. In this way, the preferred embodiment avoids simultaneous talking by more than one doll and a sequence of participation among a group of dolls that randomly brings each doll into the conversation in a remarkably complex, fascinating and natural way.

Operations in FIG. 22 begin for three dolls 1, 2 and 3 at a time 781. Since their wait time TMW is set randomly TMW for each doll is different. By chance TMW for doll 2 is the shortest and doll executes TALK 783 after a short random pause TMP. Dolls 1 and 3 execute LISTEN 785 and 787 whereupon they enter their random pauses TMP when doll 2 stops TALK 783. Doll 2 reenters its wait TMW which is always longer than any TMP due to the constraint on randomness in time selection ranges. Because the TMW of doll 2 is longer than any TMP doll 2 will not be the next to talk. Instead, one of the dolls 1 and 3, which are both executing shorter random pause TMP, will talk next. By chance, doll 1 has the shorter TMP and executes TALK 789. When TALK 789 is completed dolls 2 and 3 execute random, short, TMP pauses while doll 1 is in longer wait time TMW. By chance, doll 3 is next to talk, and so on. Advantageously, the provision of more than one randomly selected timer time adapts the preferred for these remarkably natural alternating interchanges.

An example range within which TMP i randomly selected, is 1.0–3.0 seconds. An example range within which TMW is randomly selected, is 3.5–10.0 seconds.

In FIG. 23 doll 1 and doll 2 have progressed across a subject row S=SCR of their conversation table. Utterance index I of doll 1 reaches IMAX and doll executes TALK 791 while doll 2 does a corresponding LISTEN by a random pause TMP and utterance IMAX TALK 793 in doll 2. In the meantime doll 1 has reset its index I to one and runs wait time in the midst of which doll executes LISTEN 795. Ordinarily, a random short pause TMP would follow LISTEN 795 in the operation of the preferred embodiment. However, this time, doll 1 augments the random value of TMP with a random value of TMW. As a result, respective random time periods 797 and 799 are respectively set up in doll 1 and doll 2. The chances are 50–50 as to which doll will complete the time period first and thus initiate the next subject of conversation. This time augmentation feature further contributes to the naturalness of timing of doll conversation in the preferred embodiment.

In FIG. 24 detailed operations implementing the just-discussed time diagrams in step 105 of FIG. 5 are shown. Operations commence with a BEGIN 801 and then in a step 805 set a first timer TM1 to a random wait time TMW and set a second timer TM2 to a longer random maximum listening time TML (e.g. in the range 15–20 seconds). Step 805 is also reached through point A from FIG. 11B. After step 805 of FIG. 24 a step 810 tests a too-quiet flag FLW input on a line from input circuit 71 to microprocessor circuit 75. Step 810 has several operations under the control of timers TM1 and TM2 as discussed hereinbelow in connection with FIG. 25. If operations are completed in step 810 by exit through either timer TM1 or TM2 flow outputs of step 810, then a step 820 is reached. In step 820 a value of a Too Loud flag FLD on a line from circuit 71 is read in. Also, in step 820 an analog level of loudness R on another line from circuit 71 is converted to a digital form by a conventional successive approximations procedure.

After step 820, a decision step 825 tests whether both index I is greater than one and also Too-Quiet flag FLW is set to one. If the test is met, a branch is made to a step 827 and if counter CL has not reached 3, operations proceed to a step 830 to increment CL by one and initialize or reset counter CH to zero. Then in a step 835, the appropriate utterance discussed with FIG. 20 is made, depending on the counter CL number, whence operations loop back to step 805. When counter CL is 3 in step 827, a branch is made directly back to step 805 because doll 1 is taking a "hap".

If the test of step 825 is not met, then either index I is one or the sound is not too quiet, and counter CL is reset to zero in a step 871 whence Too Loud flag FLD is tested in a step 875. If FLD is set, a counter CH is incremented in a step 881 and an appropriate utterance discussed with FIG. 21 is made, depending on the counter CH number in a step 885. After step 885, a test 891 is made to determine whether counter CH has reached 3. If not, operations loop back to step 805. If so, operations go to a step 895 to send Self Shut Off signal SSO to power control circuit 81. To permit an orderly shut-down of microprocessor circuit 75 and due to the electronic speed of the microprocessor even during the brief power-down phase, a timer TMO is set for 2 seconds in step 895. Next, a step 901 tests whether TMO is timed out and if not decrements it in a step 903 looping back to step 901. Power should be shut off by circuit 81 long before time out of TMO and circuit 75 ceases operation gracefully. If TMO does time out in step 901, operations default to START 101 of FIG. 5.

If in step 875 the Too Loud flag was not set, then the loudness is in a normal range and operations proceed to a step 911 to reset CH to zero. Next, in a step 913 a test is made to determine whether index I is one and also subject code S is not zero. The test is not met unless circumstances are as discussed for FIG. 23 augmentation feature. If the test is not met, as is the case on first power-up of the doll and in the midst of a conversation, then operations proceed to a step 915 to set first timer TM1 to a random pause time TMP and set second timer TM2 to randomly selected maximum listening time TML. Next, a step 917, which is the same subroutine as in step 810 (FIG. 25), is executed to further monitor sounds in the vicinity. If operations flow out of the TM1 flow line indicating that TMP has expired, then RETURN 921 is reached. Otherwise, operations loop back along the TM2 flow line to step 915.

If the test of step 913 is met, the augmentation feature of FIG. 23 is executed by proceeding to a step 923. If the Initiator flag INR=0 (L=1) meaning that the doll is not the initiator, then a branch is made directly to step 915 since no augmentation is needed. If in step 923 the initiator flag is set INR=1, then operations go to an augmentation step 925 wherein first timer TM1 is set to the sum of a randomly selected TMW value plus a randomly selected TMP value. Also, second timer TM2 is set to a randomly selected TML value. Operations proceed from step 925 directly to step 917.

Microcomputer circuit 75 by virtue of the software of FIG. 24 thus constitutes an example of a circuit connected to the sensing means (e.g. circuit 71) for causing the generating means (e.g. circuit 77) to generate an utterance indicative of insufficient loudness if the loudness does not exceed a predetermined level within a time period. Circuit 75 also disables the generating means (e.g. by SSO control of circuit 81) for a time period if the loudness exceeds a predetermined level repeatedly (e.g. CH=3). Circuit 75 also is an example of a circuit for monitoring the sensing means during a first random time period until the loudness falls below a predetermined level and for preventing operation of the generating means for a further random time period before the utterance is generated. Microprocessor circuit 75 enables the generating circuit 77 only after the loudness falls below a level during a first time period followed by expiration of a second time period that is extended, if the loudness recurs, for a third time period commencing when the loudness recurs, until the sooner of the expiration of the third time period or the time when the loudness again falls below the level.

Figure 25:
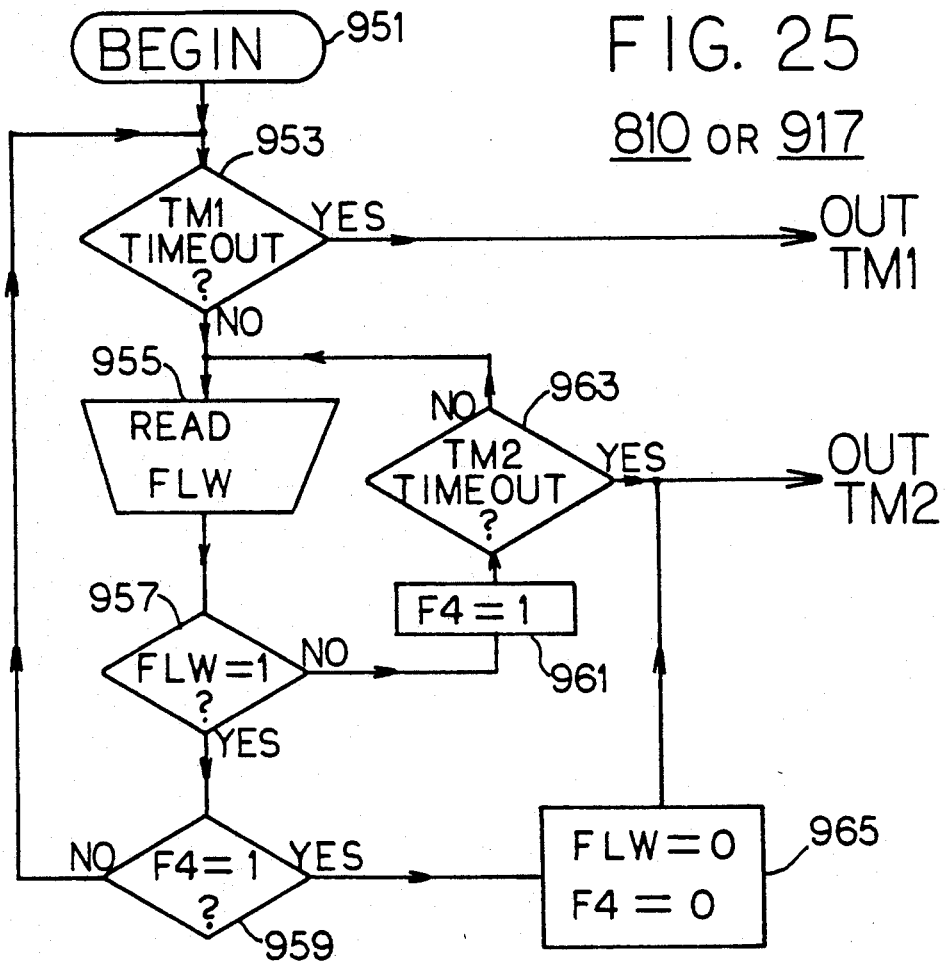
FIG. 25 is a detailed flow diagram of a step in FIG. 24 for monitoring the sound from the surroundings.

In FIG. 25 operations of the subroutine used in steps 810 and 917 of FIG. 24 commence with a BEGIN 951 and proceed to test for TM1 timeout in a step 953. If TM1 first timer is not timed out, operations go to a step 955 to read Too Quiet flag FLW and then in a step 957 test whether FLW is set to one. If so, no significant loudness is yet present and a flag F4 that was initialized to zero in step 151 of FIG. 10 is next tested in a step 959. If flag F4 is not set, operations loop back to step 953. If no loudness occurs, the loop continues until first timer TM1 times out and a branch is then made from step 953 to the TM1 flow line output.

If significant loudness occurs before TM1 times out, flag FLW is turned off so that it is no longer one in step 957. Then a branch is made to a step 961 that sets flag F4 to one. Next, in a step 963 second timer TM2 is tested for time out. If not timed out, operations proceed to loop to step 955 to execute an inner loop of steps 955, 957, 961 and 963 until either TM2 times out o the loudness disappears again. If the loudness disappears again, flag FLW is set to one in step 955 and operations pass through step 957 to step 959 to test F4. Now F4 is one because of the intervening loudness. A branch is made from step 959 to a step 965 to initialize FLW and F4 back to zero whence operations flow out the TM2 flow line. Also, if the loudness continues until TM2 timeout, operations branch from step 963 out the TM2 flow line.

Figure 26:
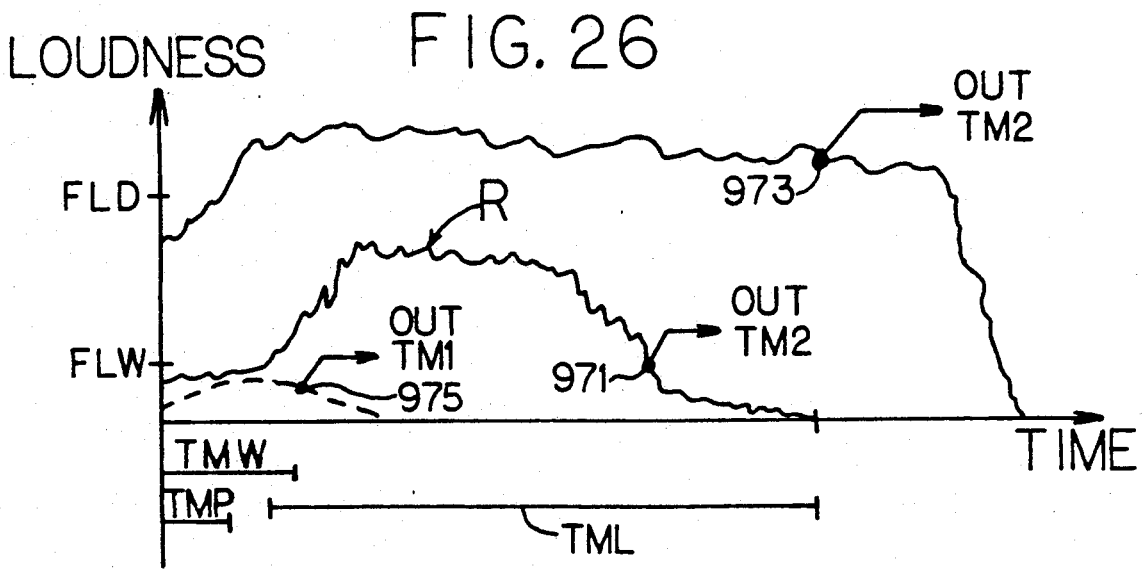
FIG. 26 is a loudness versus time diagram of various sound possibilities indicating the operations of FIG. 25 in response thereto.

FIG. 26 shows a loudness waveform R over time. When the waveform goes below threshold at point 971 operations flow out the TM2 flow line. A prolonged loudness causes operations to flow out the TM2 flow line at loudness-time point 973 of FIG. 26. If there is no significant loudness, operations flow out the TM1 flow line of FIG. 25 at point 975 of FIG. 26 as soon as TMW (or TMP is TM1 value) is timed out.

Figure 27:
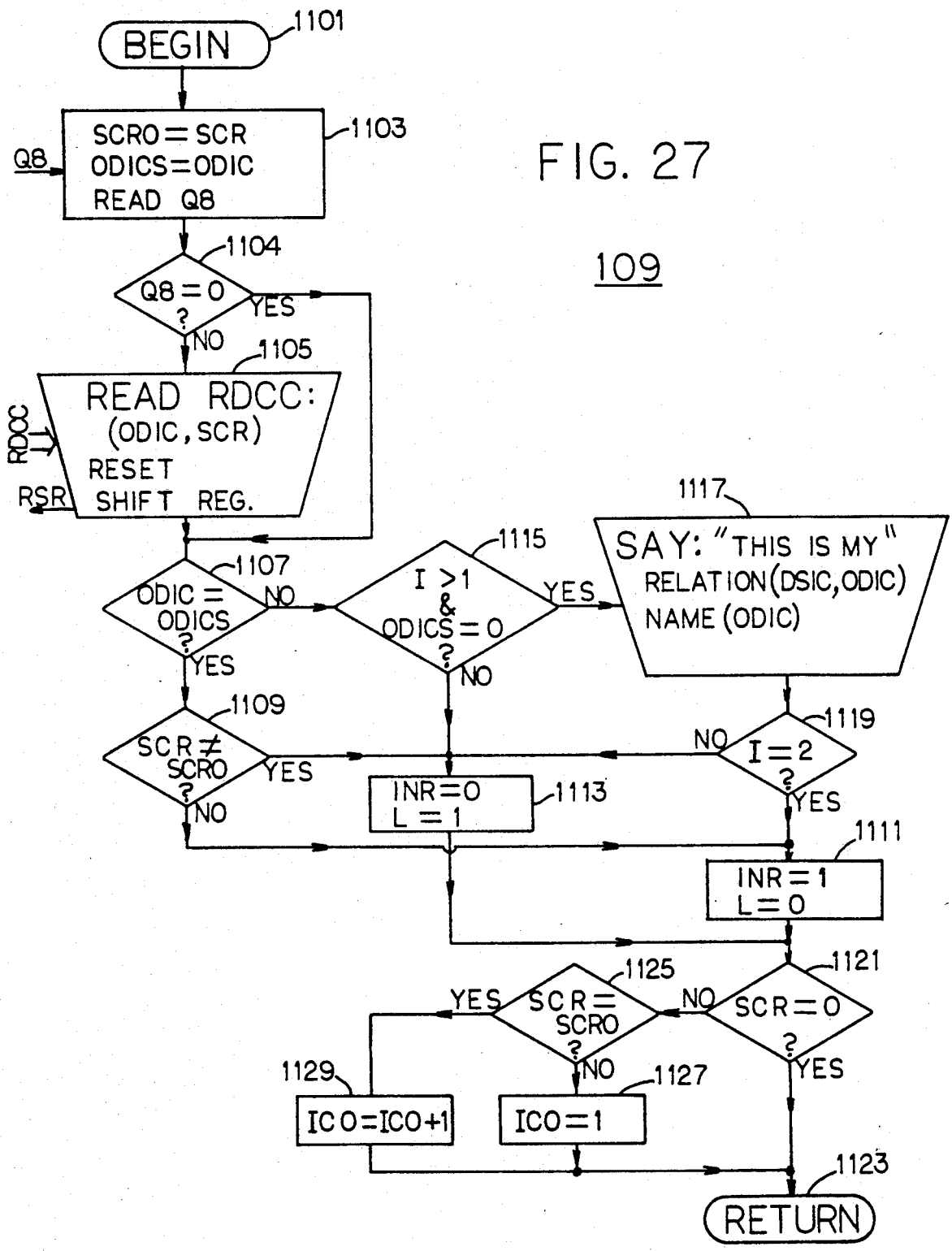
FIG. 27 is a further detailed flow diagram of FIG. 5 operations for Received Doll Communication Code RDCC processing to introduce another doll, set an initiator status flag, and keep count of utterances of the other doll.

FIG. 27 details operations in step 109 of FIG. 5 for Received Doll Communication Code RDCC processing. Operations commence with a BEGIN 1101 and proceed to a step 1103. In step 1103, previous subject code SCR0 is updated by setting it equal to subject code received SCR. Previous ODICS is updated by setting it equal to ODIC. The start bit location for RDCC in circuit 71 of FIG. 3 and FIG. 4A is read to determine whether a RDCC has come. Then a step 1104 tests Q8 and if it is not zero, then RDCC has newly arrived and operations proceed to a step 1105. In step 1105 the entire RDCC is read in from a shift register in circuit 71 to obtain the latest ODIC and SCR and then the shift register is reset whence a step 1107 is reached. If in step 1104 no Q8 start bit one was found, step 1105 is bypassed.

Next follows a set of steps that determine whether doll 1 is itself an initiator or a listener in the conversation, in order to properly set the initiator flag INR and its listener complement L.

If for example doll 1 is in actual fact an initiator because it sensed no RDCC and is about to make its first I=1 utterance, then ODIC in step 1107 has not changed and still equals ODICS. Operations proceed to a step 1109 to test whether subject code received SCR has changed from its previous value SCR0. If not, initiator flag INR is set to one and L is set to zero in a step 1111 because doll 1 is the initiator. On the other hand, if SCR has changed from SCR0 in the course of a conversation with another doll, then the other doll is initiating a new subject. In that case, operations branch from step 1109 to a step 1113 to set INR to zero and L=1, because doll 1 is not the initiator.

If in step 1107 the Other Doll Identification Code ODIC has changed from its previous value ODICS, then a branch is made from step 1107 to a step 1115 to test whether it is true that both index I exceeds one and ODICS is zero. If so, the other doll has entered the conversation after doll 1 began talking, and operations proceed to a step 1117 in which circuit 75 causes circuit 77 to introduce the other doll by saying the phrase "This is my" followed by a relation word (e.g. "baby", "sister", "mother", "friend", etc.) stored in a table as a function of DSIC and ODIC, followed by the other doll's name stored in another table as a function of ODIC. After step 1117 a test 1119 determines whether index I is 2, which indicates that doll 1 initiated a subject to which doll 2 is now responding. If I=2, then operations proceed to step 1111 to set the INR flag to one because doll 1 is the initiator. If I is not 2, it must exceed 2 at this point in the logic, and doll 2 is initiating in the midst of a doll 1 conversation sequence. Therefore, a branch is made from step 1119 to step 1113 to make INR=0 because doll 1 is not the initiator.

Operations from either step 1111 or 1113 then go to a step 1121 to test whether subject code received SCR is zero. If so, there is no other doll in the vicinity and RETURN 1123 is reached. Otherwise, there is a doll and count ICO should be maintained on its utterances, and a branch is made to test whether SCR=SCR0 in a step 1125. If SCR is changed from SCR0, then count ICO is initialized to one in a step 1127 whence RETURN 1123 is reached. If SCR=SCR0 in step 1125, then doll 2 is progressing on the same subject SCR as previously, and count ICO is incremented by one in a step 1129 whence RETURN 1123 is reached.

Microprocessor circuit 75 using the software of FIG. 27 with steps including steps 1107, 1115 and 1117 constitutes an example of a circuit for causing said generating means (e.g. circuit 77) to generate an utterance identifying the additional apparatus (e.g. other doll). With steps such as 1121, 1125, 1127 and 1129 circuit 75 is an example of a circuit that also counts utterances of the additional apparatus and resets the counting when the subject code of the additional apparatus changes.

This completes the detailed steps for all Figures detailing FIG. 5.

In hardware for transmitting the doll communications code TDCC between the dolls, many competing considerations must be taken into account. The child may be playing near other children or in the same room as adults who are talking. At a birthday party or other gathering of children, many dolls of the invention should be usable simultaneously in a group or in separate groups. Dolls in one group should not interfere with dolls in another group while communicating with dolls in the same group. One or more pets such as dog or cat may be in the room. The child may have a TV, walkie-talkie, AM transistor radio, doll with tape recorder inside, motorized toy or record player running while playing with the doll. Someone in the room may be talking on the telephone. An adult in the same room or nearby room may be watching television, using a video cassette recorder, home computer, stereo, tape deck, FM radio or short wave radio receiver or amateur radio transmitter. A family member may be running an appliance such as a hair dryer, washing machine and clothes dryer, microwave oven, garbage disposal or microwave oven. A refrigerator, air conditioner, or furnace blower may be running. None of these domestic items should interfere significantly with the doll circuitry, and the doll circuitry should not interfere significantly with the electrical items in the household. And in the midst of all these conditions the doll should be capable of transmitting and receiving TDCC and RDCC effectively in its preferred embodiment.

The doll communications code is suitably transmitted in any of the following ways:

A) By a flexible wire such as a twisted pair or a shielded cable.

B) Acoustically through doll loudspeaker 43 at a high audible frequency such as 5–15 KHz.

C) Acoustically through doll loudspeaker or other transducer above audible range, ultrasonic frequency higher than 20 KHz.

D) By radio by wireless broadcasting in AM broadcasting band or on a short wave walkie-talkie frequency.

E) By radiant energy such as light or infrared.

F) By capacitive electrical induction or coupling.

G) By magnetic induction or coupling.

H) By other suitable information transfer modes.

In the present embodiment, and without deemphasizing the applicability of other communication alternatives according to the invention, a remarkable arrangement for transmitting and receiving the doll communications code by magnetic induction is now described.

A frequency between 5 and 50 KHz. and illustratively 22 KHz. is transmitted in bursts of long or short length corresponding to logic levels of the TDCC, to cue the other doll. The bursts have a width suitable for the purpose such as at least 30 milliseconds.

The magnetic induction coupling has a very short range of 4 to 5 feet (1.3 to 1.6 meters) which permits the use of dolls with each other in one group while not interfering with another group of dolls in the same room. By virtue of the low 22 KHz. frequency, interference to radios, televisions and other electronic equipment is negligible, and radio, TV, FM, and short wave frequencies are not received by the doll. Magnetic induction coupling of 60 Hz. vertical sweep and 15,750 Hz. horizontal sweep frequencies from a nearby television set is readily filtered out by the doll circuitry.

The child user and pets cannot hear the doll communications code when it is transmitted by magnetic induction coupling, making the doll even more lifelike. Because the code cannot be heard it is suitably sent as often as necessary.

The magnetic induction next described in detail is circuitry driven by microprocessor circuit 75 by uncomplicated software, and receiving circuitry of relatively uncomplicated type interfaces with circuit 75 also.

The magnetic induction coupling is substantially omnidirectional so that two or more dolls in physical proximity can communicate with each other in various orientations relative to each other.

Direct coupling of the 22 KHz. magnetic induction signal into audio sections of radios, televisions, tape recorders and the like is negligible beyond about a foot (0.3 meter) of distance, and the ultrasonic 22 KHz. is inaudible to the human ear and so poorly amplified in most equipment to be no annoyance to pets if there was less than a foot of separation.

Magnetic induction coupling from loudspeakers of electronic equipment into the doll is also negligible beyond about a foot, and such coupling is ignored because the doll circuitry is sensitive to the 22 KHz. signal which is outside the audible range at which the loudspeakers are driven. Coupling from the motor of a hair dryer is in the 60 Hz. and audio range which can be filtered out readily because the 22 KHz. communication code is far higher in frequency.

Figures 28, 30:
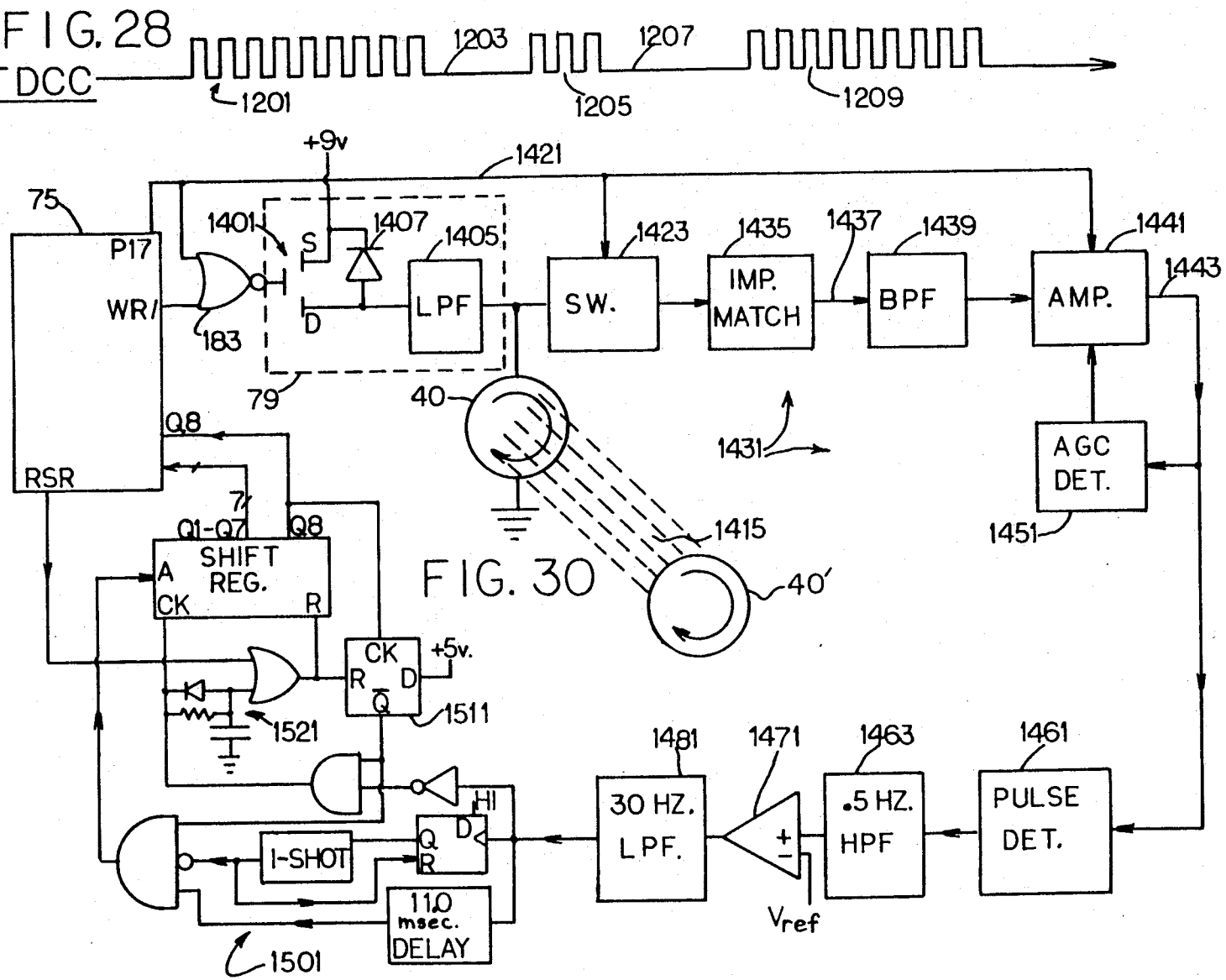
FIG. 28 is a diagram of long and short bursts of pulses for transmitting TDCC.
FIG. 30 is a partially block, partially schematic diagram of circuitry connected to the microcomputer for transmitting TDCC, and receiving RDCC by magnetic induction.

In FIG. 28, microprocessor circuit 75 is programmed to produce TDCC as a series of long and short bursts of pulses having a repetition rate F, such as 22 KHz.

For example, a long burst of pulses 1201 lasts for illustratively 150 milliseconds followed by a period 1203 of no pulses for 100 milliseconds followed by a short burst of pulses 1205 at repetition rate F for 50 milliseconds. Then there is another period 1207 of no pulses followed by a long burst of pulses 1209. The ratio of length of a long burst to the length of a short burst is suitably 3:1, and the length of a period of no pulses to a short burst is suitably 2:1. A long burst represents a "1" bit in TDCC and a short burst represents a "0" therein.

Advantageously, the microcomputer circuit 75 has a high clock frequency compared to pulse rate F, so that the microcomputer both synthesizes the pulses and keys them on and off by software described in connection with FIG. 29.

Figure 29:
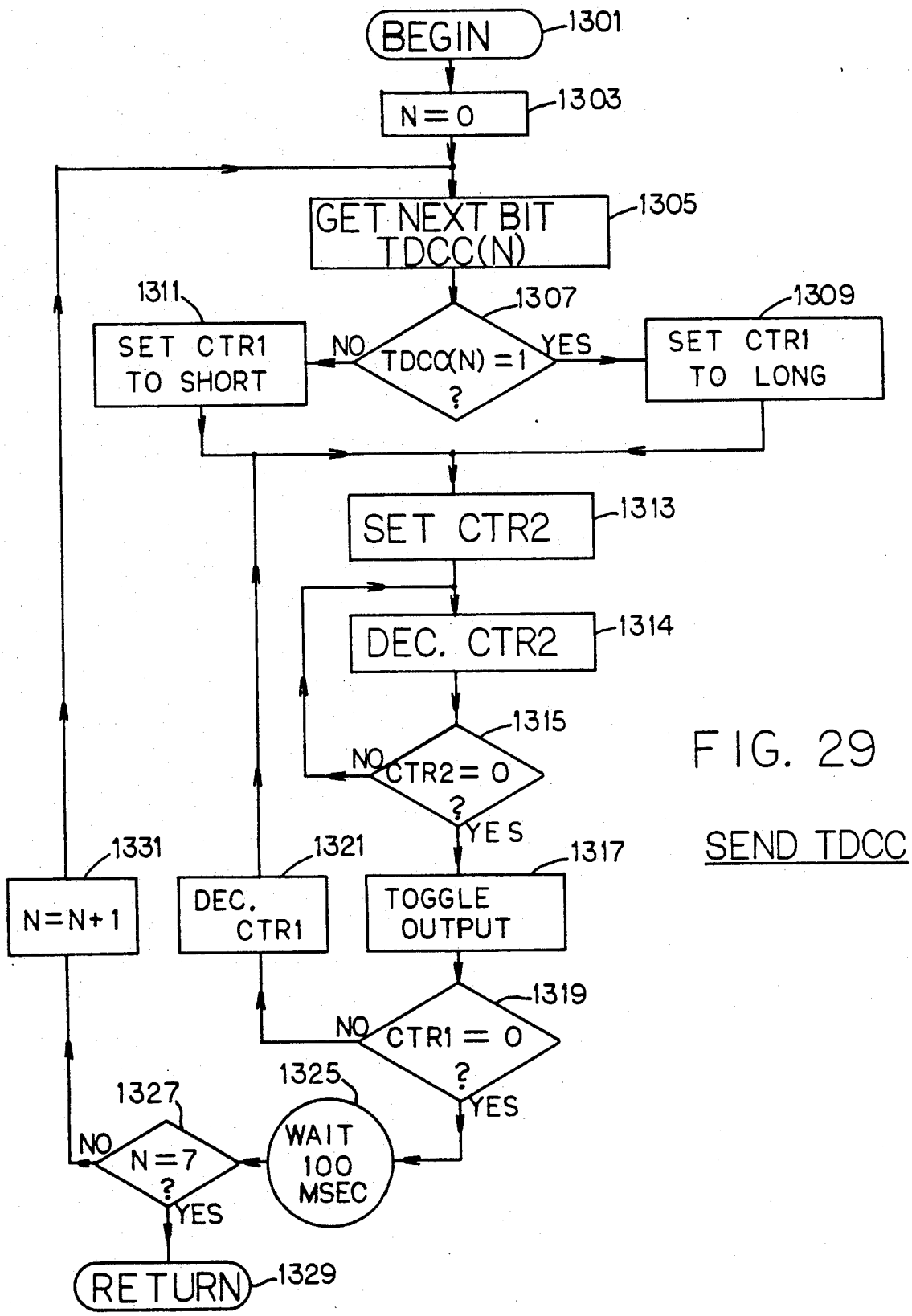
FIG. 29 is a flowchart of microcomputer operations for producing the long and short bursts of pulses of FIG. 28.

In FIG. 29 operations commence with a BEGIN 1301 and proceed to a step 1303 to initialize a bit index N to zero. Next in a step 1305, the value "1" or "0" of the TDCC bit with bit index is looked up in memory. The routine sends TDCC bit by bit serially.

Next, a step 1307 tests the TDCC bit value to determine if it is a "1". If so, operations proceed to set a first counter register to a value corresponding the width of a long burst. If not, operations branch to a step 1311 where the first counter register is instead set to a value representing the width of a short burst.

After either step 1309 or 1311, step 1313 sets a second counter to a number representing the pulse width (half the repetition period, e.g. 23 microseconds) of the pulses individually. Next, the second counter is decremented in a step 1314.

In a next step 1315 the second counter is tested and operations loop back to step 1314 until second counter reaches zero, whence an output line of the microcomputer is complemented or toggled from its previous state in a step 1317. Then a step 1319 tests whether the first counter has timed out by reaching zero. If not, the first counter is decremented in a step 1321 and a loop is made back to step 1313. This outer loop results in transmission of pulses until the first counter is timed out in step 1319 whence operations proceed to a 100 millisecond wait step 1325. Then a test step 1327 determines whether bit index N has reached 7, see FIG. 4B. If so, all 8 bits of TDCC have been sent, whence a RETURN 1329 is reached. Otherwise, a loop is made back through a step 1331 where N is incremented and then to step 1305 to continue transmission until the TDCC is entirely transmitted.

In FIG. 30 the TDCC bursts of pulses of FIG. 28 produced by the operations of FIG. 29 are sent on a Write line WR/ through a NOR gate 1831 to the gate of a field effect transistor FET switch 1401. The source of FET 1401 is connected to the +9 volt supply, and the drain D is connected to a low pass filter LPF 1405. LPF 1405 has a rolloff frequency set somewhat higher than the repetition rate F to suppress the harmonic content of the square wave pattern of the pulses of FIG. 28 and thereby prevent radio interference. A freewheeling diode 1407 is connected in reverse bias sense across FET 1401 source and drain to prevent transients due to the action of LPF 1405.

LPF 1405 has an output connected to magnetic induction coil 40 of FIG. 3. Coil 40 is illustratively 30 to 50 turns of wire formed into collar around the rest of electronics assembly 13 of FIG. 2 so that it encompasses an area a few inches (about 0.1 meter) in length and width. The wire is wound with some depth, about 2.5 centimeters; to improve the omnidirectionality of the magnetic induction field created thereby. Coil 40 thus is connected between the output of LPF 1405 and common so that the +9 volt battery supply delivers enough current into the coil at repetition rate F to communicate TDCC by magnetic induction for 4 to 5 feet to doll 2, and induction coil 40' therein.

In FIG. 30 microprocessor circuit 75 provides an inhibit low output on a line 1421 to an analog switch 1423 which isolates receiving circuitry 1431 next-described from the 9 volt excitation of coil 40. When line 1421 goes high, FET 1401 is prevented from operating and receiving circuitry 1431 is enabled to operate.

When doll 2 sends its doll communications code, the magnetic field from coil 40' in doll 2 induces a voltage in coil 40 of doll 1 which now acts as a sensing element. The voltage induced in coil 40 passes through analog switch 1423 to an impedance matching circuit 1435, such as a step-up audio transformer. The resulting signal is filtered by a bandpass filter 1439 which is designed to pass the doll communication code at frequency F (e.g. 22 KHz.) and sharply attenuate frequencies on either side. In this way, 60 Hz. voltage, audio voltages, and 15,750 Hz. TV horizontal sweep and their harmonics are rejected by filter 1439. Filter 1439 is provided advantageously in chip form as multipole Butterworth high and low pass filters designed to act together as a bandpass filter.

Following filter 1439, the pulse bursts of FIG. 28 are amplified by variable-gain operational amplifier 1441 which is also connected to inhibit line 1421. Output 1443 of amplifier 1441 is connected to a fast-attack-slow-release AGC (automatic gain control) detector 1451. The "1" start bit of RDCC sets up the AGC detector 1451 and amplifier 1441 gain so that the output 1443 is in a nominal range.

Output 1443 is connected to a diode detector 1461 which eliminates the 22 KHz. component and produces long and short high pulses corresponding to the burst lengths. The output of detector 1461 is filtered and shaped by a high pass filter (DC blocking condenser rolling off below 0.5 Hertz, followed by a comparator 1471 and a 30 Hertz rolloff low pass filter (RC filter) 1481.

In FIG. 30 the output of filter 1481 has its long and short highs converted to corresponding serial highs and lows by a logic circuit 1501. The serial output is fed to an A input of a shift register 1505 which converts it to parallel digital form at a set of outputs Q1–Q8 (compare FIG. 4A) for input to microprocessor circuit 75. A D flip-flop 1511 inhibits logic circuit 1501 when the shift register 1505 is loaded with RDCC so that Q8 goes high. A slow charge, fast discharge capacitive reset circuit 1521 resets shift register 1505 if the time interval between long and short highs from circuit 1481 becomes excessive.

The receiving circuitry of FIG. 30 is an example of means for sensing an identification code and a subject code established in doll 2. Coil 40 senses a magnetic induction to produce a signal. Filter 1439 is an example of a means for bandpass filtering the signal around a first frequency. Circuit 1461 is an example of a circuit for rectifying the signal. Circuits 1463, 1471 and 1481 are an example together of a means for bandpass filtering the rectified signal around a second lower frequency (e.g. between 0.5 and 30 Hz.) to detect the code. Circuit 1501 is an example of means for converting the bursts of pulses to a series of logic levels, e.g. circuit 1501 together with the receiving circuitry 1431 ahead of it. Shift register 1505 supplies logic levels to the controlling means.

Figure 31:
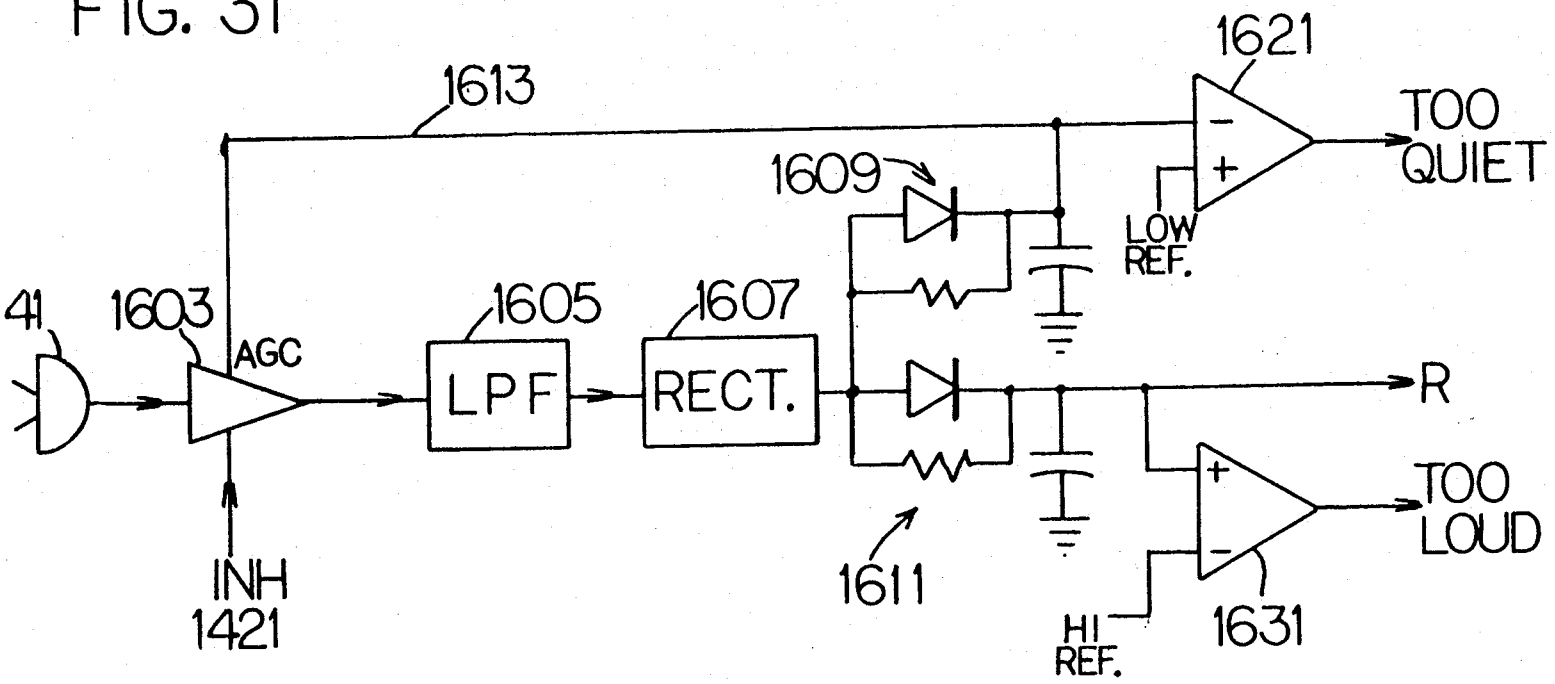
FIG. 31 is a partially block, partially schematic diagram of circuitry connected to an input microphone and to the microcomputer for sensing the loudness of sound in the vicinity of a doll.

In FIG. 31 loudness detection or sensing hardware for input circuit 71 of FIG. 3 is shown. Microphone 41 is connected to variable gain operational amplifier 1603 which is inhibited by inhibit line 1421 low. The output of amplifier 1603 is connected to a low pass filter LPF 1605 which has a rolloff frequency at the top of the audio range 4 KHz. Some filtering to reject any components below 150 Hz. is included. A circuit 1607 rectifies the output of filter 1605 and supplies it to first and second fast-charge-slow discharge circuits 1609 and 1611. Circuit 1609 has an approximately 0.25 second time constant for AGC purposes and supplies a line 1613 to amplifier 1603. Also, line 1613 is connected to a comparator 1621 which goes high on a TOO QUIET line if line 1613 voltage is below a threshold. Flag FLW is derived from the TOO QUIET line.

Circuit 1611 has an approximately 2.5 second discharge time constant to hold an output indicative of the general loudness of the sound which is supplied to the output line for voltage R and to a comparator 1631. Comparator 1631 goes high when the output of circuit 1611 exceeds a high level indicative of excessive loudness. The output of comparator 1631 is supplied to a TOO LOUD line from which flag FLD is derived.

In this way, the circuitry of FIG. 31 is an example of a microphone, means connected to the microphone for amplifying and rectifying the output of the microphone, automatic gain control means with fast attack and slow decay for controlling said amplifying and rectifying means, and comparing means connected to said automatic gain control means for providing a signal indicating when the loudness is below a predetermined level. Circuit 1611 is an example of means connected to the amplifying and rectifying means for supplying an electrical level with fast attack and slower decay than the automatic gain control means which level acts as a decisional influence for the controlling means. Comparator 1631 is an example of a second comparing means connected to said circuit means for providing a signal indicating that the loudness exceeds another predetermined level.

Figure 32:
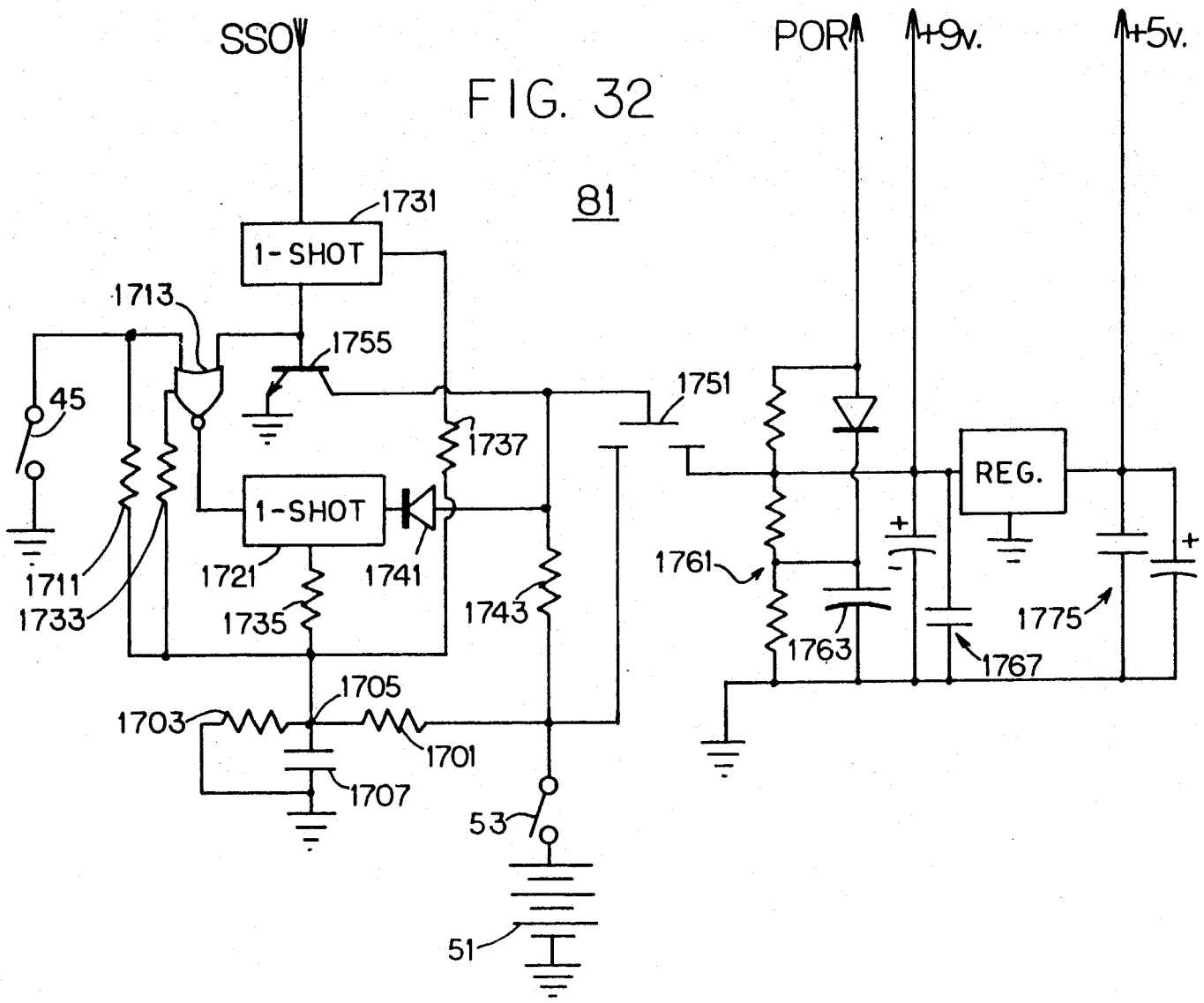
FIG. 32 is a schematic diagram of a power control circuit of FIG. 3.

In FIG. 32 power control circuit 81 is shown inside the dashed line. When switch 53 associated with the holder for batteries 51 is put in its ON position, the battery voltage of 9 volts energizes a network of resistors 1701 and 1703 to provide about 5 volts at a point 1705 which has a capacitor 1707 connected therefrom toground or common.

5 volt point 1705 is connected through a pullup resistor 1711 to motion switch 45, which is also connected to the input of a NOR gate 1713, the output of which is connected to a one-shot multivibrator 1721. In this way, if motion switch 45 is actuated it produces a low at NOR gate 1713. If NOR gate 1713 is qualified by a low at its other input from a one-shot 1731, then the output of NOR gate 1713 goes high and turns on one-shot circuit 1721. NOR gate 1713, and one-shots 1721 and 1731 are connected to point 1705 by resistors 1733, 1735 and 1737 respectively.

When one-shot 1721 is triggered, its output releases a disabling low through a diode 1741 and a resistor 1743 connected in series between 9 volts and the output of one-shot 1721. The anode of diode 1741 is connected to the gate of a FET 1751, the source of which is connected to 9 volts at switch 53 and the drain of which provides current for the rest of the doll.

The Self Shut Off SSO output from microprocessor circuit 75 activates 3-minute one-shot 1731 which produces an output high that turns on a transistor 1755. The collector of transistor 1755 goes low, forcing the gate of FET 1751 low and turning FET 1751 off, thus shutting off all of the doll circuitry except that in the power circuit 81 for processing SSO. The high from one-shot 1731 also forces the output of NOR gate 1713 low, preventing motion switch 45 from activating one-shot 1721.

The drain of FET 1751 energizes a divider network 1761 and delay capacitor 1763, the voltage of which supplies a Power-ON Reset output POR to microprocessor circuit 75.

The drain of FET 1751 is also connected to bypass capacitors 1767 for radio and audio frequency bypass, for +9 volt output to the rest of the doll circuitry. Logic level +5 volts is provided by a voltage regulator chip 1771 which has its input connected to the drain of FET 1751, and its output connected to the +5 volt Vcc line which is bypassed by capacitors 1775.

In FIG. 32 the circuitry thus constitutes an example of a motion sensitive switch and means for supplying power for the apparatus so long as the apparatus is moved at intervals shorter than a predetermined interval.

Figure 33:
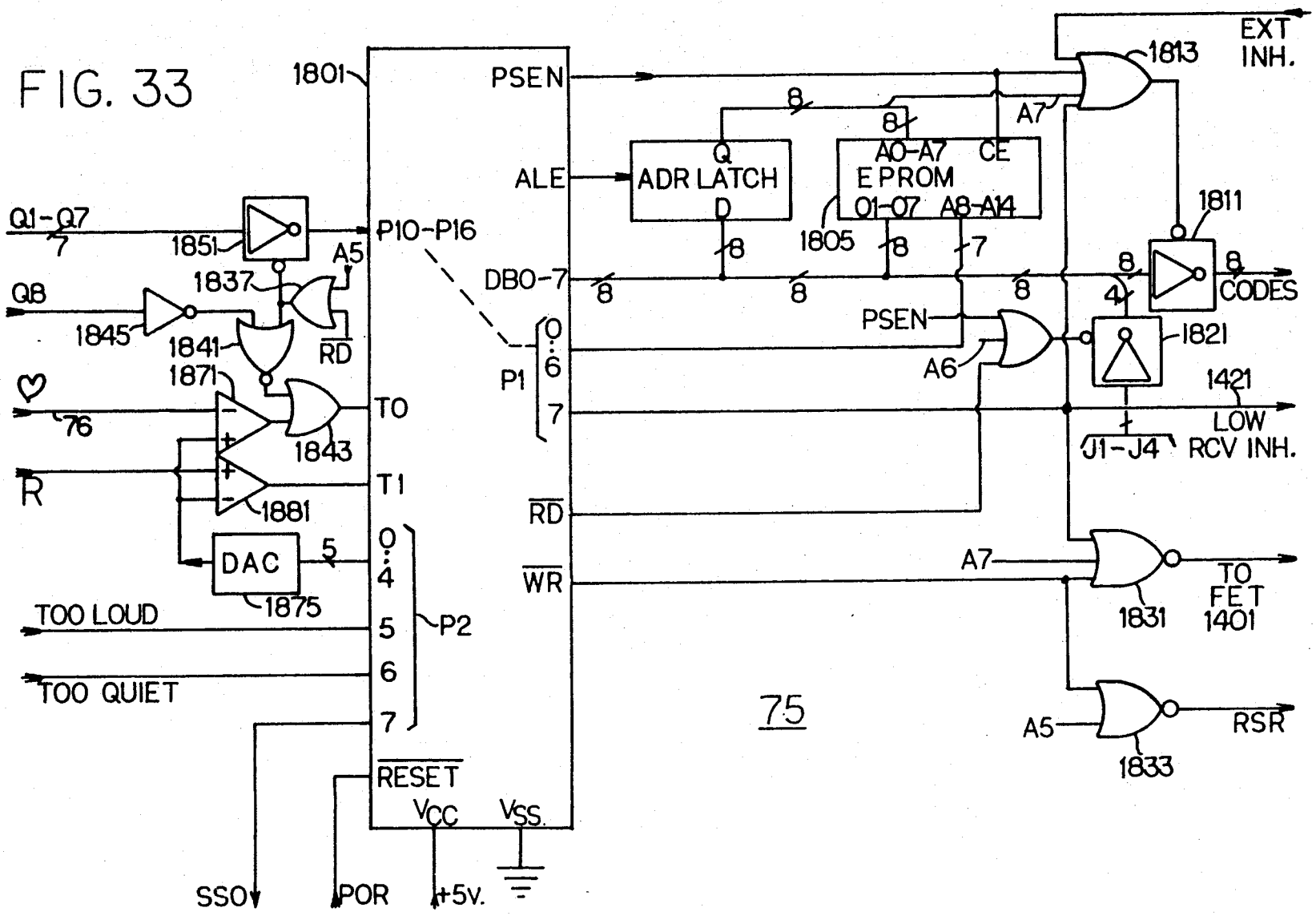
FIG. 33 is a schematic diagram of a microprocessor circuit of FIG. 3.

In FIG. 33 microprocessor circuit 75 has an 80C39 Intel CMOS microcomputer 1801, an erasable programmable read only memory EPROM 1805 and an 8-bit address latch 1807. EPROM 1805 holds the software shown in the flowcharts and discussed at length hereinabove and also the conversation tables and Word-and-Phrase table.

Microcomputer 1801 asserts a 15-bit address (32 K address space). The lower 8 bits A0–A7 are asserted in data bus lines DB0–7 to address latch 1807. A high on Address Latch Enable line ALE is supplied by microcomputer 1801 to latch 1807 to latch these address bits. The upper seven address bits A8–A14 are asserted directly to EPROM 1805 from P1 port pins 0–6 while EPROM 1805 is enabled by a high on a Program Store Enable line PSEN.

When lines DB0–7 are not used for transactions with EPROM 1805, they are available for sending allophone codes and robotic control codes to circuits 79 and 80 of FIG. 3. Lines DB0–7 are connected to bus 77 of FIG. 3 by an 8-bit inverting buffer 1811 which is enabled by and OR gate 1813. OR gate 1813 supplies an enabling low only when PSEN is low, address line A7 is low, and Receive Inhibit Line is active low.

Jumpers J1–J4 are read onto lines DB0–3 through an inverting buffer 1821 when the same is enabled by an OR gate 1825. OR gate 1825 supplies an enabling low when PSEN is low, address line A6 is low and Read RD/ is active low.

Transmissions of the doll communications code TDCC are made by toggling the Write WR/ output pin of microcomputer 1831 as discussed in FIG. 29. WR/ is connected to the input of a NOR gate 1831 which permits FET 1401 of FIG. 30 to be actuated when inhibit line 1421 is active low, address line A7 is low and WR/ is active low. The Reset Shift Register RSR output is activated when address line A5 is low and the Write line WR/ is low.

Reception of the doll communication code RDCC is accomplished by microcomputer 1801 sensing its testable input T0. Output Q8 is gated by logic elements 1837, 1841, 1843 and 1845 to input TO when Read RD/ is active low and address line A5 is low. If Q8 is present, the rest of RDCC on outputs Q1–Q7 is read in through a buffer 1851 to port 1 lines 0–6.

The heart dial resistor 17 voltage and loudness voltage R are respectively converted from analog to digital form by successive approximations using a 5-bit Digital to Analog Converter DAC 1875 and two comparators 1871 and 1881. DAC 1875 inputs are connected to port 2 pins 0–4 and its output is connected to the +input of comparator 1871 and minus input of comparator 1881. The outputs of comparators 1871 and 1881 are read at the T0 and T1 inputs. Contention at the TO input is eliminated by setting the DAC output low when Q8 is to be sensed.

The TOO LOUD line is connected to port 2 pin 5 and the TOO QUIET line is connected to port 2 pin 6. Pin 7 outputs the SSO shut off signal. POR is connected to the RESET pin.

Figure 34:
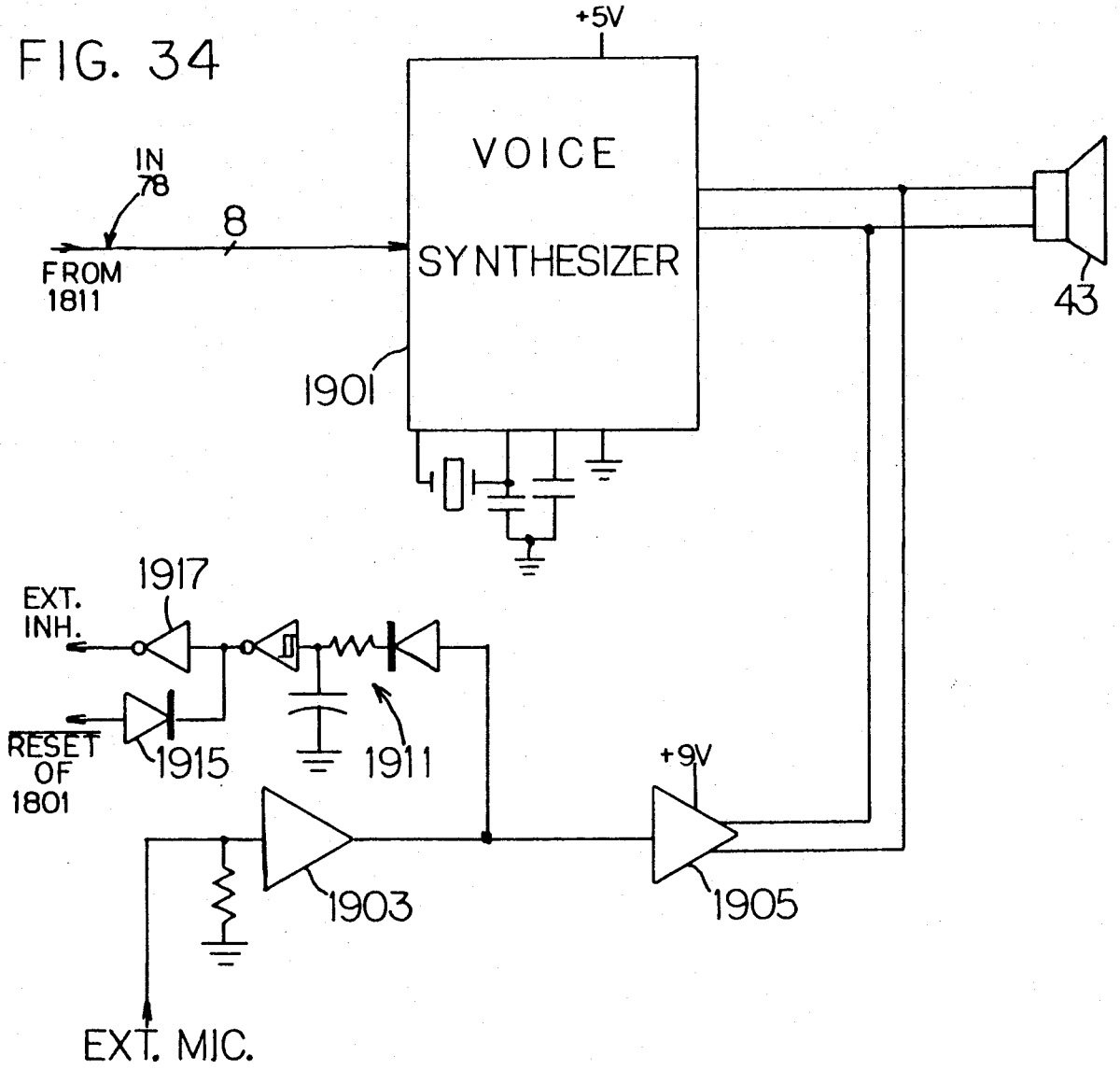
FIG. 34 is a schematic diagram of an utterance generating circuit of FIG. 3.

In FIG. 34 utterance generating circuit 77 has a voice synthesizer chip with 8-bit parallel digital input connected to the output of buffer 1811 of FIG. 33. In this way when buffer 1811 is enabled, allophone codes from microcomputer 1801 lines DB0–7 pass to voice synthesizer 1901, which produces each corresponding allophone through loudspeaker 43.

Several suitable voice synthesizer chips are commercially available, such as the S3620 from American Microsystems, Inc. Santa Clara, Calif.; the SP0256A-AL2 from General Instrument Corp., Clifton, N.J.; and the TMS 5220C from Texas Instruments, Inc. A speech synthesizer from Seiko Instruments & Electronics Ltd., Tokyo, Japan is described in U.S. Pat. No. 4,489,437 Fukuichi et al., Dec. 18, 1984.

For example, the S3620 is a single CMOS chip to which a ceramic resonator, two capacitors and +5 volts is connected. This chip uses linear predictive coding (LPC) and provides high quality men's voices, women's voices and children's voices. The chip includes an 8-bit input latch, synthesizer circuitry, and a balanced power amplifier that delivers about 30 milliwatts of audio power into a 100 ohm speaker. A technical description and block diagram of the S3620 are found in D. Parikh, "A Single-C C Speech Synthesizer" *Speech Technology* Sept./Oct 1982, pp. 86–88 and accompanying advertisement. Data sheets and further specific design information are available for each of the above-mentioned chips from their manufacturers.

In FIG. 34 an external microphone is optionally connected to the EXT. MIC input of doll 1. When the microphone is connected, its electrical output is fed to an operational amplifier 1903 which in turn drives an audio amplifier 1905 which has its output connected in parallel with the synthesizer 1901 output to loudspeaker 43. Operational amplifier 1903 is also connected to a speech detector circuit 1911.

Speech detector circuit 1911 has an output 1913 that goes low when speech is present. This low resets microprocessor circuit 75 through a diode 1915 to the RESET/ input of microcomputer 1801 of FIG. 33. The low also causes an inverter 1917 to provide a high-active external inhibit EXT INH to the input of OR-gate 1813 so that buffer 1811 between the microcomputer 1801 and voice synthesizer 1901 is disabled.

In this way, the circuitry of FIG. 34 constitutes an example of a circuit for amplifying an externally derived voice signal and resetting the establishing and changing means (e.g. circuit 75) when the externally derived voice signal is present. The synthesizer is an example of an utterance generating means.

As is apparent from the hereinabove description, the invention comprehends numerous embodiments in apparatus and method which may be made and practiced according to the spirit and scope of the invention so that its utility is fully realized.

What is claimed is:

1. Electronic speech control apparatus comprising means for establishing and changing over time a subject code and an utterance index, the subject code generally indicating one of a plurality of sets of utterances and the utterance index identifying an utterance of at least one word in the set indicated by the subject code; and means responsive to the establishing and changing means for generating the utterance identified by the utterance index in the set indicated by the subject code, said establishing and changing means also comprising means for changing the utterance index when each utterance is generated and for subsequently changing the subject code at random automatically.

2. Electronic speech control apparatus as set forth in claim 1 for use with additional electronic speech control apparatus of the same kind wherein the first-named apparatus further comprises means for broadcasting the established subject code thereto.

3. Electronic speech control apparatus as set forth in claim 1 for use with additional electronic speech control apparatus establishing a subject code, wherein the first-named apparatus further comprises means for sensing the subject code established in the additional apparatus.

4. Electronic speech control apparatus as set forth in claim 3 wherein said establishing and changing means in the first-named apparatus also comprises means connected to the sensing means for changing the subject code in the first-named apparatus in response to the sensed subject code.

5. Electronic speech control apparatus as set forth in claim 1 further comprising means responsive to the establishing and changing means for executing a visible motion corresponding to the utterance identified by the utterance index in the set indicated by the subject code.

6. Electronic speech control apparatus as set forth in claim 1 wherein said establishing and changing means also comprises means for changing the utterance index when each utterance is generated to progress through the set of utterances indicated by the subject code.

7. Electronic speech control apparatus as set forth in claim 1 wherein said establishing and changing means also comprises means for changing the utterance index when each utterance is generated until the set of utterances indicated by the subject code has been completed and for subsequently changing the subject code at random automatically.

8. Electronic speech control apparatus as set forth in claim 1 further comprising means for sensing loudness of sound in its vicinity and wherein said establishing and changing means also comprises means for changing the subject code as a function of the loudness.

9. Electronic speech control apparatus as set forth in claim 1 further comprising means for sensing loudness of sound in its vicinity and wherein said establishing and changing, means also comprises means for, computing an electrical representation of a simulated emotion repeatedly as a function of the loudness.

10. Electronic speech control apparatus as set forth in claim 1 further comprising means for varying an electrical level and wherein said establishing and changing means is connected to the varying means and also comprises means for changing the subject code as a function of the electrical level.

11. Electric speech control apparatus comprising means for establishing and automatically changing over time a subject code and an utterance index, the subject code generally indicating one of a plurality of sets of utterances and the utterance index identifying an utterance of at least one word in the set indicated by the subject code;

means responsive to the establishing and changing means for generating the utterance identified by the utterance index in the set indicated by the subject code; and means for varying an electrical level and wherein said establishing and changing means is also connected to the varying means and also comprises means for repeatedly computing an electrical representation of a simulated emotion as a function of the electrical level.

12. Electronic speech control apparatus as set forth in claim 11 wherein said generating means also comprises means for producing an additional utterance representing the simulated emotion so computed.

13. Electronic speech control apparatus as set forth in claim 1 further comprising means for sensing loudness of sound in its vicinity and wherein said establishing and changing means also comprises means connected to said sensing means for causing the generating means to delay generating the utterance until after the loudness has fallen below a predetermined level.

14. Electronic speech control apparatus as set forth in claim 1 further comprising means for sensing loudness of sound in its vicinity and wherein said establishing and changing means also comprises means connected to said sensing means for causing the generating means to generate an utterance indicative of insufficient loudness if the loudness does not exceed a predetermined level within a time period.

15. Electronic speech control apparatus as set forth in claim 1 further comprising means for sensing loudness of sound in its vicinity and wherein said establishing and changing means also comprises means connected to the sensing means for establishing randomly a time period and, if the utterance index has an initial value, for causing the generating means to generate an utterance after the time period when the loudness does not exceed a predetermined level within the time period.

16. Electronic speech control apparatus as set forth in claim 1 further comprising means connected to said establishing and changing means for sensing loudness of sound in its vicinity.

17. Electronic speech control apparatus as set forth in claim 1 further comprising means for sensing loudness in its vicinity and wherein said establishing and changing means also comprises means connected to said sensing means for causing said generating means to generate an utterance indicative of excessive loudness if the loudness exceeds a predetermined level.

18. Electronic speech control apparatus as set forth in claim 1 further comprising means for sensing loudness of sound in its vicinity and means for disabling said generating means for a time period if the loudness exceeds a predetermined level repeatedly.

19. Electronic speech control apparatus as set forth in claim 1 further comprising means for sensing loudness of sound in its vicinity and wherein said establishing and changing means also comprises means for monitoring said sensing means during a first random time period until the loudness falls below a predetermined level and for preventing operation of the generating means for a further random time period before the utterance is generated.

20. Electronic speech control apparatus as set forth in claim 1 further comprising means for sensing loudness of sound in its vicinity and wherein said establishing and changing means also comprises means for enabling operation of the generating means only after the loudness falls below a level during a first time period followed by expiration of a second time period that is extended if the loudness recurs, until the loudness again falls below the predetermined level.

21. Electronic speech control apparatus as set forth in claim 1 further comprising means for sensing loudness of sound in its vicinity and wherein said establishing and changing means also comprises means for enabling operation of the generating means only after the loudness falls below a level during a first time period followed by expiration of a second time period that is extended, if the loudness recurs, for a third time period commencing when the loudness recurs, until the sooner of the expiration of the third time period or the time when the loudness again falls below the level.

22. Electronic speech control apparatus as set forth in claim 1 further comprising means for sensing loudness of sound in its vicinity and wherein said establishing and changing means also comprises means for enabling operation of the generating means only after the loudness falls below a level during a first random time period followed by expiration of a second random time period.

23. Electronic speech control apparatus as set forth in claim 1 further comprising means for supplying an identification code for the apparatus and means for broadcasting the identification code.

24. Electronic speech control apparatus as set forth in claim 1 further comprising a motion sensitive switch and means for supplying power for the apparatus so long as the apparatus is moved at intervals shorter than a predetermined interval.

25. Electronic speech control apparatus as set forth in claim 1 further comprising means for supplying an identification code for the apparatus and wherein said establishing and changing means also comprises means for repeatedly computer electrical representation of simulated emotions the presence or absence of which depends on the identification code for the apparatus.

26. Electronic speech control apparatus as set forth in claim 1 for use with additional electronic speech control apparatus of the same kind and further comprising means for sensing an identification code of the additional apparatus and wherein said establishing and changing means also comprises means for causing said generating means to generate an utterance identifying the additional apparatus.

27. Electronic speech control apparatus as set forth in claim 1 for use with additional electronic speech control apparatus of the same kind and further comprising means for sensing an identification code of the additional apparatus and wherein said establishing and changing means also comprises means for comparing the identification code of the additional apparatus with an identification code of the first-named apparatus and determining the utterance index as a function of the identification codes.

28. Electronic speech control apparatus as set forth in claim 1 for use with additional electronic speech control apparatus of the same kind and further comprising means for sensing a subject code of the additional apparatus and wherein said establishing and changing means also comprises means for counting utterances of the additional apparatus and resetting the counting when the subject code of the additional apparatus changes.

29. Electronic speech control apparatus as set forth in claim 1 further comprising means for varying an electrical level and wherein said establishing and changing means also comprises means for establishing a plurality of levels of decisional influence as a function of the electrical level.

30. Electronic speech control apparatus as set forth in claim 1 further comprising means for varying an electrical level and wherein said establishing and changing means also comprises means for establishing a level of simulated expectation as a function of the electrical level.

31. Electronic speech control apparatus as set forth in claim 1 further comprising means for varying an electrical level and wherein said establishing and changing means also comprises means for establishing a plurality of levels of decisional influence as a function of the electrical level and a level of simulated expectation as a further function of the electrical level.

32. Electronic speech control apparatus as set forth in claim 1 for use with additional electronic speech control apparatus of the same kind and further comprising means for sensing a subject code of the additional apparatus and wherein said establishing and changing means also comprises means for comparing the subject codes of the first-named and additional apparatus and for producing one of two decision values as representing a simulated decision of the additional apparatus depending on whether or not the subject codes are the same.

33. Electronic speech control apparatus as set forth in claim 1 for use with additional electronic speech control apparatus of the same kind and further comprising means for sensing a subject code of the additional apparatus and wherein said establishing and changing means also comprises means for comparing the subject codes of the first-named and additional apparatus and for producing one of two decision values representing a decision imputed to the additional apparatus depending on whether or not the subject codes are the same, for establishing levels of decisional influence for the firstnamed apparatus and for producing one of two decision values representing a simulated decision of the first-named apparatus depending on whether a combined total of the levels of decisional influence exceeds a predetermined level.

34. Electronic speech control apparatus as set forth in claim 1 for use with additional electronic speech control apparatus of the same kind and further comprising means for sensing loudness of sound in its vicinity, and wherein said establishing and changing means also comprises means for producing one of two simulated decision values representing a decision of the additional apparatus, for establishing, a first level of decisional influence as a function of the simulated decision value and the loudness, and a second level of decisional influence, and for modifying the simulated decision value as a function of the first and second levels of decisional influence.

35. Electronic speech control apparatus as set forth in claim 1 for use with additional electronic speech control apparatus of the same kind and wherein said establishing and changing means, also comprises means for repeatedly producing one of two simulated decision values representing a decision of the additional apparatus and for repeatedly producing one of two simulated decision values representing a decision the first-named apparatus and for repeatedly computing emotions as a function of each said one of the simulated decision values of the first-named and additional apparatus.

36. Electronic speech control apparatus as set forth in claim 1 wherein said establishing and charging means also comprises means for computing an electrical representation of a simulated hope emotion and causing said generating means to also generate an utterance representing the simulated hope emotion.

37. Electronic speech control apparatus as set forth in claim 1 further comprising means for varying an electrical level and wherein said establishing and changing means also comprises means for computing an electrical representation of a simulated hope emotion as a function of the electrical level and causing said generating means to also generate an utterance representing the simulated hope emotion.

38. Electronic speech control apparatus as set forth in claim 1 further comprising means for sensing loudness of sound in its vicinity and wherein said establishing and changing means also comprises means for establishing a decisional influence level and computing an electrical representation of a simulated boredom emotion as a function of the decisional influence level and the loudness sensed.

39. Electronic speech control apparatus as set forth in claim 1 wherein said establishing and changing means also comprises means for computing an electrical representation of a simulated boredom emotion and causing said generating means to also generate an utterance representing the simulated boredom emotion.

40. Electronic speech control apparatus as set forth in claim 1 wherein said establishing and changing means also comprises means for computing an electrical representation of a simulated surprise emotion and causing said generating means to also generate an utterance representing the simulated surprise emotion.

41. Electronic speech control apparatus as set forth in claim 1 wherein said establishing and changing means also comprises means for computing an electrical representation of a simulated like-dislike emotion and causing said generating means to also generate an utterance representing the simulated like-dislike emotion.

42. Electronic speech control apparatus as set forth in claim 1 wherein said establishing and changing means also comprises means for computing an electrical representation of a simulated tension emotion and causing said generating means to also generate an utterance representing the simulated tension emotion, the apparatus further comprising means for supplying an identification code for the apparatus, and the utterance representing the simulated tension emotion depending on the identification code.

43. Electronic speech control apparatus as set forth in claim 1 wherein said establishing and changing means also comprises means for computing an electrical representation of a simulated fear emotion and causing said generating means to also generate an utterance representing the simulated fear emotion.

44. Electronic speech control apparatus as set forth in claim 1 for establishing a level of decisional influence and for computing one of two decision levels representing a decision in simulation by the apparatus as a function of the decisional influence and the subject code, and for changing the subject code when the decision changes.

45. Electronic speech control apparatus for use with additional apparatus of the same kind, and comprising means for establishing and automatically changing over time a subject code and an utterance index, the subject code generally indicating one of a plurality of sets of utterances and the utterance index identifying an utterance of at least one word in the set indicated by the subject code; and means responsive to the establishing and changing means for generating the utterance identified by the utterance index in the set indicated by the subject code; and means for sensing loudness of sound in its vicinity and for sensing a subject code established in the additional apparatus and said establishing and changing means also comprises means for computing an electrical representation of a simulated emotion repeatedly as a function of the loudness and the subject code sensed.

46. Electronic speech control apparatus as set forth in claim 45 and said establishing and changing means in the first-named apparatus also comprises means for supplying a value of a decisional influence and for computing an electrical representation of a simulated emotion repeatedly as a function of the value of the decisional influence, the subject code established, the loudness and the subject code sensed.

47. Electronic speech control apparatus comprising means for establishing and automatically changing over time a subject code and an utterance index, the subject code generally indicating one of a plurality of sets of utterances and the utterance index identifying an utterance of at least one word in the set indicated by the subject code;

means responsive to the establishing and changing means for generating the utterance identified by the utterance index in the set indicated by the subject code; and means for supplying an identification code for the apparatus and wherein said establishing and changing means also comprises means for selecting one of a plurality of collections of the sets of utterances depending on the identification code for the apparatus, the subject code determining one of the sets of utterances within the selected collection of sets.

48. Electronic speech control apparatus for use with additional electronic speech control apparatus of the same kind and the first-named apparatus comprising means for establishing and automatically changing over time a subject code and an utterance index, the subject code generally indicating one of a plurality of sets of utterances and the utterance index identifying an utterance of at least one word in the set indicated by the subject code;

means responsive to the establishing and changing means for generating the utterance identified by the utterance index in the set indicated by the subject code; and means for sensing an identification code of the additional apparatus and wherein said establishing and changing means in the first-named apparatus also comprises means for selecting one of a plurality of collections of the sets of utterances depending on the identification code for the additional apparatus, the subject code determining one of the sets of utterances within the selected collection of sets.

49. Electronic speech control apparatus as set forth in claim 48 wherein said sensing means comprises means for sensing the identification code for the additional apparatus by magnetic induction.

50. Electronic speech control apparatus comprising computer circuit means for repeatedly computing and storing an electrical representation of a level of an emotion in simulation as a computer control variable; and means responsive to the computing circuit means for generating an utterance selected in accordance with the control variable so computed as being a simulated emotion of the apparatus itself.

51. Electronic speech control apparatus as set forth in claim 50 wherein said, computing means also comprises means for computing a simulated hope emotion.

52. Electronic speech control apparatus as set forth in claim 50 wherein said computing means also comprises means for computing a simulated fear emotion.

53. Electronic speech control apparatus as set forth in claim 50 wherein said computing means also comprises means for computing a simulated surprise emotion.

54. Electronic speech control apparatus as set forth in claim 50 wherein, said computing means also comprises means for computing a simulated boredom emotion.

55. Electronic speech control apparatus as set forth in claim 50 wherein said computing means also comprises means for computing a glad-sad feelings simulated emotion.

56. Electronic speech control apparatus as set forth in claim 50 wherein said computing means also comprises means for computing a simulated self-esteem emotion.

57. Electronic speech control apparatus as set forth in claim 50 wherein said computing means also comprises means for computing a simulated like-dislike emotion.

58. Electronic speech control apparatus as set forth in claim 50 wherein said computing means also comprises means for computing a simulated tension emotion.

59. Electronic speech control apparatus as set forth in claim 50 further comprising means for establishing an identification code for the apparatus as a unit and wherein said computing means also comprises means for computing simulated emotions the presence or absence of which depends on the identification code for the apparatus as a unit.

60. Electronic speech control apparatus as set forth in claim 50 further comprising means for establishing an identification code for the apparatus as a unit and wherein said computing means also comprises means for causing said generating means to generate different utterances to represent the same simulated emotion depending on the identification code established.

61. Electronic speech control apparatus as set forth in claim 50 wherein said computing means also comprises means for establishing levels of simulated expectation and decisional influence and for computing a simulated hope emotion as a function of the levels of simulated expectation and decisional influence.

62. Electronic speech control apparatus as set forth in claim 50 wherein said computing means also comprises means for establishing a level of simulated expectation and computing a simulated surprise emotion as a function of the level of simulated expectation.

63. Electronic speech control apparatus as set forth in claim 50 wherein said computing means also comprises means for establishing levels of decisional influence representing aiding or opposing influences and computing a simulated boredom emotion which represents significant boredom in simulation when the levels of the decisional influence represent opposing influences in approximate balance.

64. Electronic speech control apparatus as set forth in claim 50 for use with additional electronic speech control apparatus of the same kind wherein said computing means also comprises means for establishing levels of decisional influence representing aiding or opposing influences one of which is related to operation of the additional apparatus, and for computing a simulated like-dislike emotion as a function of the magnitudes of the levels of decisional influence and representing a simulated liking emotion when the levels represent aiding influences and a simulated dislike emotion when the levels represent opposing influences.

65. Electronic speech control apparatus as set forth in claim 50 for use with additional electronic speech control apparatus of the same kind wherein said computing means also comprises means for establishing levels of decisional influence representing aiding or opposing influences one of which is related to operation of the additional apparatus, and for computing a simulated self-esteem emotion as a function of the level of the related influence which represents significant self-esteem when a combined total of the decisional influence levels is aiding in sense to the related influence.

66. Electronic speech control apparatus as set forth in claim 50 wherein said computing means also comprises means for establishing levels of decisional influence of aiding or opposing sense and for computing a simulated tension emotion of significant magnitude as a function of the level of decisional influence when they are in opposing sense.

67. Electronic speech control apparatus as set forth in claim 50 for use with additional electronic speech control apparatus of the same kind wherein said computing means also comprises means for establishing a decisional influence level and simulated decisions respectively related to the first-named apparatus and the additional apparatus and for computing a simulated glad-sad emotion as a function of the decisional influence level, and determining a glad, or said character of the simulated emotion as a function of the simulated decisions 68. Electronic speech control apparatus as set forth in claim 50 wherein said computing means also comprises means for causing said generating means to generate an utterance representing the simulated emotion computed only when the simulated emotion has changed in value.

69. Electronic speech control apparatus as set forth in claim 50 wherein said computing means also comprises means for establishing and changing over time an utterance index to identify at any given time a particular utterance in a set of utterances and for causing said generating means to also generate an utterance identified by the utterance index.

70. For use in talking toys and the like, apparatus comprising means for generating utterances electronically; and means responsive to a person's speech for automatically producing a subject code to organize its utterances to be on the same subject before and after an instance of a person's speech and for controlling said generating means so that it generates the utterances in an alternating conversational fashion.

71. Apparatus as set forth in claim 70 wherein said controlling means includes means for sensing sounds in the vicinity and utilizing the sensed sounds to determine the utterances.

72. Apparatus as set forth in claim 70 wherein said controlling means includes means for sensing the loudness of sounds in its vicinity and utilizing the loudness to determine the utterances.

73. Apparatus as set forth in claim 72 wherein said sensing means includes a microphone, means connected to the microphone for amplifying and rectifying the output of the microphone, automatic gain control means with fast attack and slow decay for controlling said amplifying and rectifying means; and comparing means connected to said automatic gain control means for providing a signal indicating when the loudness is below a predetermined level.

74. Apparatus as set forth in claim 73 wherein said sensing means further includes circuit means with fast attack and slower decay than said automatic gain control means and second comparing means connected to said circuit means for providing a signal indicating that the loudness exceeds another predetermined level.

75. Apparatus as set forth in claim 73 wherein said sensing means further includes means connected to said amplifying and rectifying means for supplying an electrical level with fast attack and slower decay than said automatic gain control means which electrical level acts as a decisional influence for said controlling means.

76. Apparatus as set forth in claim 70 wherein said controlling means also comprises means for repeatedly computing an electrical representation of a simulated emotion and causing said generating means to generate a further utterance determined from the simulated emotion so computed.

77. Apparatus as set forth in claim 70 wherein said controlling means also comprises means for determining the utterances by selecting a subject code representing a subject thereof and for causing said generating means to also generate an utterance when the selected subject code is changed.

78. Apparatus as set forth in claim 70 wherein the apparatus further comprises means connected to said controlling means for varying an electrical level as a decisional influence for said controlling means.

79. Apparatus as set forth in claim 70 wherein said controlling means also comprises means for sensing loudness of sound in its vicinity between utterances and for causing said generating means to generate an additional utterance indicative of an excessive loudness when the same occurs.

80. Apparatus as set forth in claim 70 wherein said controlling means also comprises means for causing said generating means to generate an additional utterance identifying another toy by name when the other toy is in its vicinity.

81. Apparatus as set forth in claim 70 further comprising means for sensing when the apparatus is moved and means connected to said sensing means for supplying power to said generating means and said controlling means so long as the apparatus is moved at intervals shorter than a predetermined time interval.

82. For use in talking toys and the like, talking apparatus comprising means for generating utterances electronically; and controlling means, for use with additional apparatus of the same talking kind, for automatically producing a subject code to organize its utterances to be on the same subject before and after an utterance of the additional apparatus and for controlling said generating means so that it generates the utterances in an alternating conversational fashion in automatic response to utterances of the additional apparatus.

83. Apparatus as set forth in claim 82 further comprising means for sending a code for cuing the additional apparatus.

84. Apparatus as set forth in claim 71 further comprising means connected to said controlling means for broadcasting a subject code for cuing the additional apparatus.

85. Apparatus as set forth in claim 82 further comprising means for broadcasting a code by magnetic induction for cuing the additional apparatus.

86. Apparatus as set forth in claim 82 further comprising means for broadcasting a code for cuing the additional apparatus and wherein said controlling means also comprises means for supplying the code to said broadcasting means as bursts of pulses.

87. Apparatus as set forth in claim 82 further comprising means for broadcasting a code for cuing the additional apparatus and wherein said controlling means also comprises means for supplying the code to said broadcasting means as bursts of pulses, the bursts having long or short length corresponding to logic levels.

88. Apparatus as set forth in claim 82 further comprising means for broadcasting a code for cuing the additional apparatus and wherein said controlling means also comprises means for supplying the code to said broadcasting means as bursts of pulses, the pulses having a frequency between 5 and 50 KHz.

89. Apparatus as set forth in claim 82 further comprising means for broadcasting a code for cuing the additional apparatus and wherein said controlling means also comprises means for supplying the code to said broadcasting means as bursts of pulses, the pulses having a frequency in excess of 5 KHz. and the bursts having a width of at least 30 milliseconds.

90. Apparatus as set forth in claim 82 further comprising means connected to said controlling means for receiving a code from the additional apparatus, said controlling means also comprising means for utilizing said code to determine the utterances.

91. Apparatus as set forth in claim 82 further comprising means connected to said controlling means for receiving a code by magnetic induction from the additional apparatus, said controlling means also comprising means for utilizing said code to determine the utterances.

92. Apparatus as set forth in claim 91 wherein said receiving means includes means for sensing a magnetic induction to produce a signal, means for bandpass filtering the signal around a first frequency, means for rectifying the signal, and means for bandpass filtering the rectified signal around a second lower frequency to detect the code.

93. Apparatus as set forth in claim 82 further comprising means for receiving a code from the additional apparatus as bursts of pulses, said receiving means including means for converting the bursts of pulses to a series of logic levels and means for supplying the logic levels to said controlling means.

94. Apparatus as set forth in claim 82 further comprising means for sending a code for cuing the additional apparatus, and means for receiving another code from the additional apparatus and ignoring the code from said sending means.

95. Apparatus as set forth in claim 71 wherein said means for controlling includes means for sensing a sound in its vicinity and utilizing the sensed sound to determine an utterance.

96. Apparatus as set forth in claim 71 wherein said means for controlling includes means for causing said generating means to generate an additional utterance identifying by name another toy incorporating the additional apparatus when the other toy is in its vicinity.

97. Apparatus as set forth in claim 71 further comprising means for supplying an identification code for the apparatus and means for broadcasting the identification code.

98. For use in talking toys and the like, apparatus comprising means for electronically generating utterances;

means for sensing loudness of sound in its vicinity between utterances; and means for causing said generating means to generate an utterance indicative of excessive loudness when the same occurs wherein said causing means also comprises means for disabling said generating means for a time period when the loudness exceeds a predetermined level repeatedly.

99. A method for control of electronic speech comprising the steps of establishing and automatically changing over time a subject code and an utterance index, the subject code generally indicating one of a plurality of sets of utterances and the utterance index identifying an utterance of at least one word in the set indicated by the subject code;

electronically generating the utterance identified by the utterance index in the set indicated by the subject code;

changing the utterance index when each utterance is generated; and subsequently changing the subject code at random automatically.

100. A method for control of electronic speech comprising the steps of repeatedly computing and storing an electrical representation of an emotion in simulation in an apparatus as a computed control variable; and generating an utterance in response to the repeated computing and storing, the utterance selected in accordance with the control variable so computed as being a simulated emotion of the apparatus itself.

101. A method for control of electronic speech for use in talking toys and the like comprising the steps of generating utterances electronically;

automatically organizing the utterances to be on the same subject before and after an instance of a person's speech; and controlling the utterances in an alternating conversational fashion in response to a person's speech.

102. For use in talking toys and the like, apparatus comprising means for establishing and automatically changing over time a subject code generally indicating one of a plurality of sets of utterances;

means for broadcasting the subject code to additional apparatus for the same kind;

means for sensing a subject code established in and broadcast from the additional apparatus; and means responsive to the establishing and changing means for generating an utterance in the set indicated by the subject code; and wherein said means for establishing and changing is connected to said means for sensing and includes means for controlling said generating means so that it generates utterances in an alternating conversational fashion in response to utterances of the additional apparatus.

103. Apparatus as set forth in claim 102 wherein said establishing and changing means in the first-names apparatus also comprises mans connected to the sensing means for changing the subject code in the first-names apparatus in response to the subject code sensed from the additional apparatus.

104. ApparatUs as set forth in claim 103 wherein said establishing and changing means in the first-names apparatus also comprises means connected to the sensing means for changing the subject code in the first-named apparatus so that said means for generating generates utterances on the same subject as the additional apparatus.

105. Apparatus as set forth in claim 103 further comprising means responsive to the establishing and changing means for executing a visible motion corresponding to an utterance so generated.

106. Apparatus as set forth in claim 103 wherein the establishing and changing means includes means for subsequently changing the subject code at random.

107. Apparatus as set forth in claim 103 wherein said means for establishing and changing includes means for controlling said means for generating so that it generates utterances on a first subject indicated by the subject code and for subsequently changing the subject code so that said means for generating generates utterances on another subject indicated by the subject code so changed.

108. Apparatus as set forth in claim 103 wherein said means for establishing and changing includes means for controlling said generating means so that it generates utterances in an alternating conversational fashion in response to utterances of the additional apparatus.

109. Apparatus as set forth in claim 103 further comprising means for supplying an identification code for the apparatus wherein said means for broadcasting includes means for also broadcasting the identification code.

110. Apparatus as set forth in claim 103 further comprising means for sensing an identification code of the additional apparatus and wherein said establishing and changing means also comprises means for causing said generating means to generate an utterance identifying the additional apparatus.

111. Apparatus as set forth in claim 103 wherein said establishing and changing means also comprises means for comparing the subject codes of the first-named and additional apparatus and for producing one of two decisions values as representing a decision related to the additional apparatus depending on whether or not the subject codes are the same.

112. For use in talking toys and the like, apparatus comprising means for establishing and changing over time a subject code generally indicating one of a plurality of sets of utterances;

means responsive to the establishing and changing means for generating an utterance in the set indicated by the subject code; and means for supplying an identification code selectively representing whether the utterances are those of a baby or a child, to said means for establishing and changing.

113. Apparatus as set forth in claim 114 further comprising means for broadcasting the identification code.

114. Electronic speech control apparatus comprising means for sensing loudness of sound in its vicinity;

means for generating utterances in response to control signals supplied thereto; and control means responsive to said means for sensing, for establishing values randomly of a first time period and a second time period and enabling operation of said generating means only after the loudness falls below a level during the first time period and then remains below the level throughout the second time period.

115. Electronic speech control apparatus, for use with additional electronic speech control apparatus of the same kind, comprising means for sensing operations of the additional apparatus;

means for generating utterances in response to control signals supplied thereto; and control means responsive to said means for sensing, for repeatedly producing either of two decision values selectively representing a decision related to the operations of the additional apparatus and for repeatedly producing either of two decision values selectively. representing a decision related to operations of the first-names apparatus and for repeatedly computing electrical representations of simulated emotions as a function of the decision values related to the first-names and additional apparatus, and producing control signals to control said means for generating utterances based on the decision values and simulated emotions so computed.

116. Electronic speech control apparatus, for use with additional electronic speech control apparatus of the same talking kind, comprising means for sensing loudness of sound in its vicinity;

means for generating utterances in response to control signals supplied thereto; and control means responsive to said means for sensing, for producing either of two decision values selectively, representing a decision related to the operation of the additional apparatus, establishing a first level of decisional influence, establishing a second level of decisional influence as a function of the decision value and the loudness, producing either of two decision values selectively, representing a decision related to operation of the first-named apparatus as a function of the first and second levels of decisional influence, and production control signals to control said means for generating utterances based on the decision values of the decision related to the first-named apparatus.

* * * * *